US006295702B1

(12) United States Patent
Bauer

(10) Patent No.: US 6,295,702 B1
(45) Date of Patent: Oct. 2, 2001

(54) LOCKING MAGNETIC FASTENER

(76) Inventor: Irving Bauer, 1624 Webster Ave., Bronx, NY (US) 10457

( * ) Notice: Subject to any disclaimer, the term of this patent is extended or adjusted under 35 U.S.C. 154(b) by 0 days.

(21) Appl. No.: 09/663,478

(22) Filed: Sep. 15, 2000

(51) Int. Cl.[7] ..... A44B 21/00
(52) U.S. Cl. ..... 24/303; 292/251.5
(58) Field of Search ..... 24/303; 292/251.5; 335/302–306, 205–207

(56) References Cited

U.S. PATENT DOCUMENTS

| | | | | |
|---|---|---|---|---|
| 3,658,370 | | 4/1972 | Wang | 292/201 |
| 5,076,623 | * | 12/1991 | Richards . | |
| 5,311,647 | | 5/1994 | Levy | 24/303 |
| 5,317,789 | | 6/1994 | Levy | 24/303 |
| 5,377,392 | | 1/1995 | Morita | 24/303 |
| 5,515,581 | | 5/1996 | Kaufmann | 24/303 |
| 5,572,772 | | 11/1996 | Morita | 24/303 |
| 5,868,445 | | 2/1999 | Kaufman et al. | 292/251.5 |
| 5,937,487 | | 8/1999 | Bauer | 24/303 |
| 5,953,795 | | 9/1999 | Bauer | 24/303 |
| 6,009,601 | | 1/2000 | Kaufman | 24/303 |
| 6,131,247 | | 10/2000 | Morita | 13/202 |
| 6,182,336 | | 2/2001 | Bauer | 24/303 |

* cited by examiner

*Primary Examiner*—James R. Brittain
(74) *Attorney, Agent, or Firm*—Abelman, Frayne & Schwab

(57) ABSTRACT

A locking magnetic fastener includes manually separable male and female assemblies, the female assembly having an interior chamber accessible through an aperture and containing a magnet, and the male assembly having a projecting member containing ferromagnetic material that is inserted through the aperture into the chamber to be held by the magnet. To assist in holding the assemblies together, the female assembly includes a slide lock member over the aperture that can be slid to one side to admit the projecting member, but which returns to hold the projecting member in place until released by a manual lock release.

86 Claims, 31 Drawing Sheets

FIG. 12
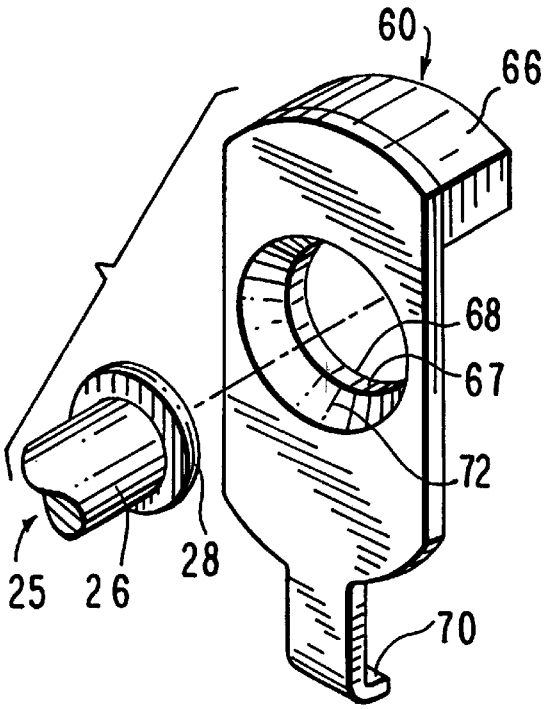
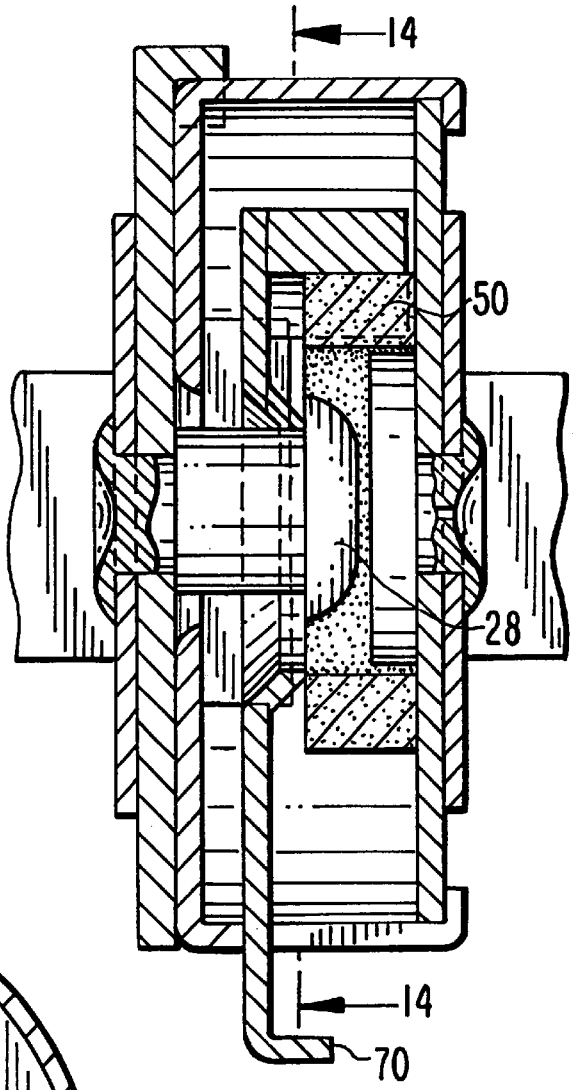
FIG. 13
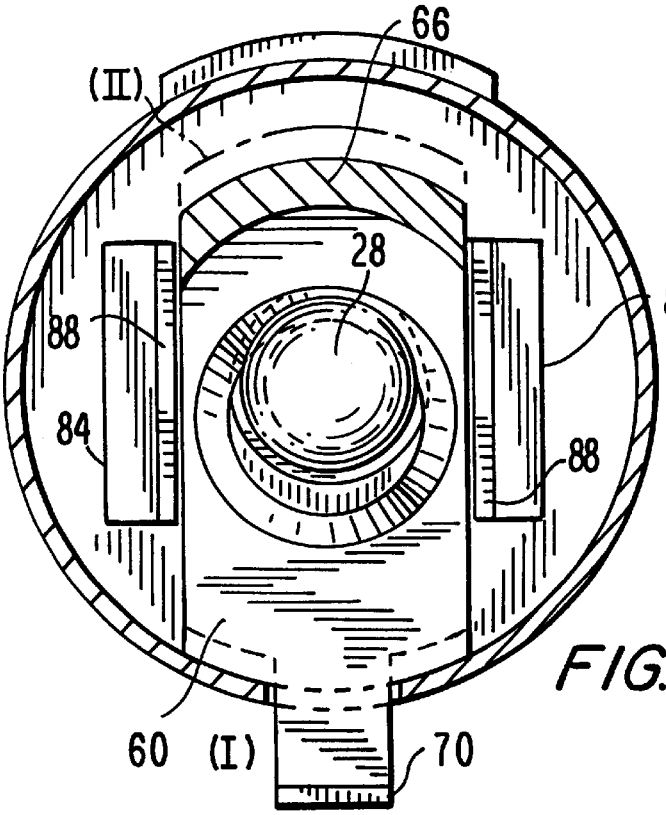
FIG. 14

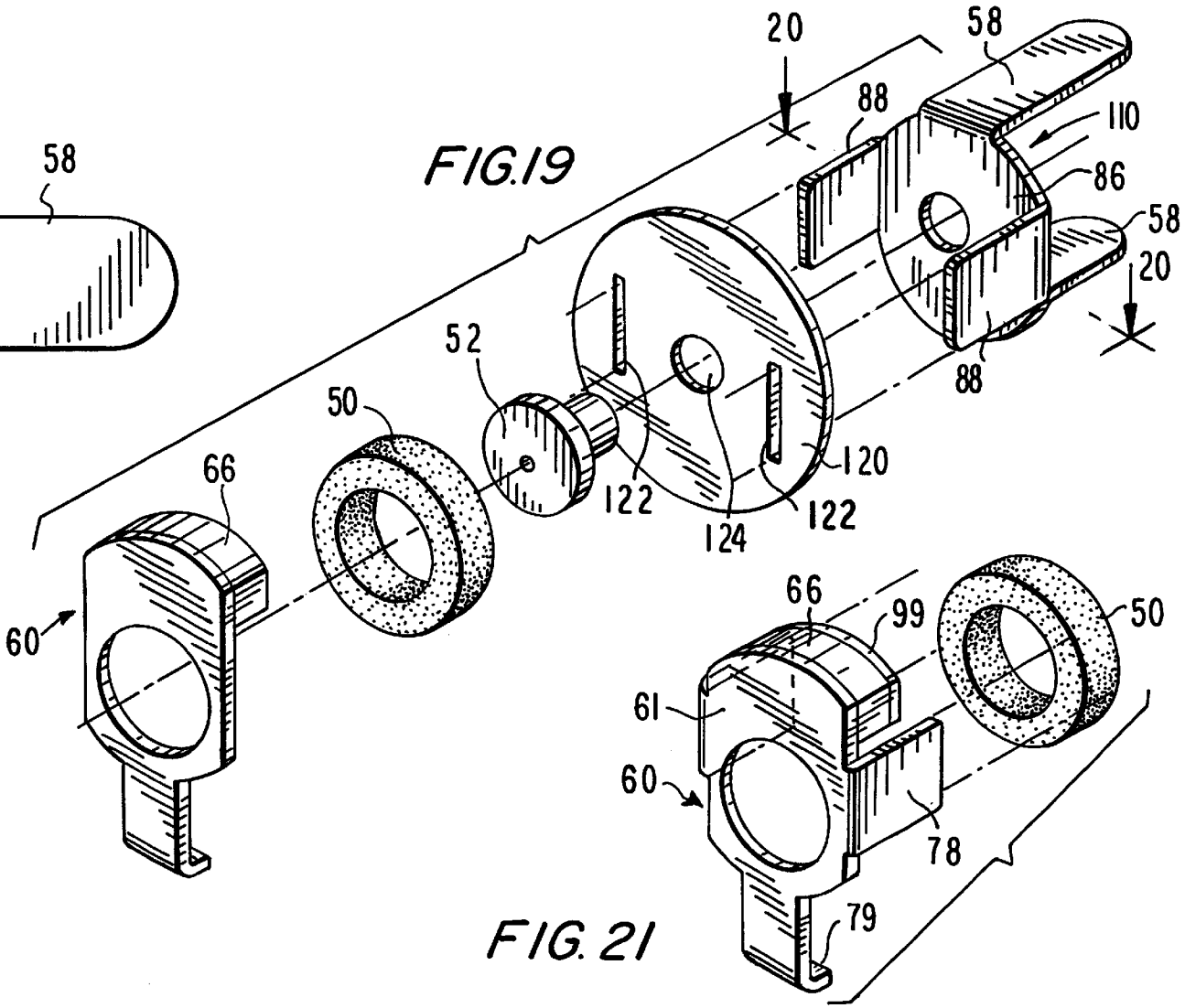
FIG.19
FIG.21
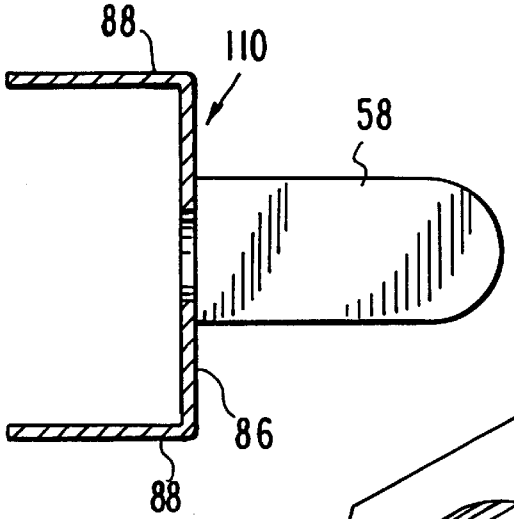
FIG.20

42
560
569
566
564
25
30
565
66
562
570
(II)

569
561
32
26
565
566

55
42
56
566
30
56
25
562
(II)
55

560
569
566
564
565
66
562
570
42

LOCKING MAGNETIC FASTENER

FIELD OF THE INVENTION

This invention relates to a magnetically actuated locking system for securely locking together the male and female elements of a fastener until released by manual movement of a release. The mechanism has particular utility for handbags and cases, and can be used for mechanically securing two opposing surfaces that can be brought into aligned superposed position while allowing access to the sliding lock release mechanism.

BACKGROUND OF THE INVENTION

The use of magnetic fasteners is well known for various end uses and in recent years has become very popular in items such as women's handbags. However, the most popular magnetic fasteners include providing a firm engagement between the elements on the opposed surfaces which are intended to be closed and do not provide a locking mechanism. Thus, U.S. Pat. No. 5,953,795, as an example, describes a non-locking magnetic fastener in which the female assembly includes a torroidal magnetic member in which is received a ferromagnetic male member.

In recognition of the need to have a positive locking mechanism, prior workers have suggested a number of approaches, but to date, none have been widely accepted.

The present fastener is a significant improvement on the locking magnetic fasteners described in the prior art in which the locking mechanism relies upon magnetic attraction between a projecting male member and a receiving female member. Numerous variations of the prior art devices operating on this old principle have been described in the patent literature. For example, U.S. Pat. No. 5,572,772 discloses a magnetic fastener consisting of a shaped male member that includes a magnet. When the male member is inserted into the female assembly, it attracts a ferromagnetic engagement member that slides into a position that engages a portion of the male member and retains it in a locked position. The male member is released by manually displacing the engagement member from the locked position where it was held by the magnetic attractive force of the magnet. Another construction of a magnetic assembly which uses a slide lock engagement is disclosed in U.S. Pat. No. 5,868,445, in which the male assembly includes a protruding member or housing with a permanent magnet positioned inside, with an opening in the housing through which the magnet is exposed. The female assembly includes one or more ferromagnetic plates that slide into contact with the male member under the force of the magnetic attraction. In U.S. Pat. No. 5,937,487 a locking magnetic fastener having a first and second locking position is disclosed, in which the projecting male is member includes a magnet that attracts sliding members in the female assembly into contact under a recessed portion of the male member.

It is also known in the art of locking fasteners to provide assemblies and constructions in which the internal members are urged into locking engagement by a biasing force, such as a spring or other biasing member. However, such mechanisms generally require the assembly of a number of small parts that must be properly oriented, and therefore are more time-consuming and expensive to manufacture, can be less reliable and are subject to failure than a simpler construction.

As noted, non-locking magnetic fasteners are well known and generally provide a single torroidal magnet within the female with no magnet in or on the ferromagnetic male member. Various constructions of the female assembly have been suggested in which the female assembly presents a central opening in a housing that contains the magnet. A natural consequence of this arrangement is that dirt and debris can be attracted to and/or accumulate in this annular space. Thus, workers have suggested placing the magnet on or in the male member, but this also has disadvantages.

One particular disadvantage that has been found when a male assembly having a projecting permanent magnet element is employed (for example, to a ladies handbag) is that the magnetic field emanating from the part having the magnet can erase all or part of the encoded information on the magnetic strip of credit and debit cards, identification badges, and the like. This occurs when the user of the bag having a closure flap opens the fastener, reaches inside the bag with the flap still loosely overlapping the side of the handbag and withdraws the credit card, passing it in close proximity to or touching the projecting magnet containing assembly. Likewise, if the user opens the fastener with the same hand that is holding a credit card (or any other card with a magnetic strip containing digital information) when the card is being returned to the interior of the bag the magnetic strip is potentially in position to be brought into contact with, or in close proximity to the projecting male element. As a consequence, all or part of the digital data can be erased, rendering the card unusable. Another disadvantage of having permanent magnetic characteristics on the projecting male member is the potential for debris to be attracted to the male member, thereby altering its contour and thus interfering with the operation of the locking mechanism in the female assembly, which often requires the locking mechanism to function by engaging a part within the female assembly with a portion of the periphery of the sidewall of the male member.

It is therefore an object of the invention to provide an improved locking magnetic fastener in which the magnetic material is shielded and preferably resides in the female member.

It is also an object of the present invention to provide an improved locking magnetic fastener which can be constructed with only one permanent magnet in its construction, and that remains securely locked without the need for springs or other biasing members, and which can be manually unlocked with a single motion that can be accomplished with one hand.

Another object of the invention is to provide a locking magnetic fastener in which the opening in the female member is entirely or partially closed when the male member is removed to minimize the possible accumulation of debris in the interior of the female member.

It is a further object of the invention to provide a novel locking magnetic fastener that is constructed from a minimum number of parts that are themselves easily and economically fabricated with conventional tooling, and that can be quickly and simply assembled without the need for complex equipment.

Although the present invention has suitability for use in handbags and like items, it is yet another object of the invention to provide a two-part locking magnetic fastener which can be used as well for other purposes such as for maintaining drawers, doors and other closures in a secure locked relation upon engagement and which can be easily and reliably unlocked by a slide or pivot action which can, if desired, be directly or remotely activated.

SUMMARY OF THE INVENTION

The above objects and other advantages are provided by the novel construction and method of the improved locking magnetic fastener of the present invention, in which the permanent magnet serves the dual function of attracting and drawing the male and female assemblies into an engaged position under control of the locking member.

In a particularly preferred embodiment of the invention, the permanent magnet produces magnetic attractions that are associated with, or emanate from, first and second regions or surfaces of the permanent magnet, and the male member and the Slide lock member are under the influence of different aspects of the attractive forces of the magnetic.

In accordance with the present invention, a single permanent magnet, or multiple magnets, preferably of torroidal shape with a central opening, is contained in a housing as part of the female member. The female housing is provided with an exterior aperture which can be circular into which a portion of the male member extends. The female member has mounted therein a preferably non-ferromagnetic slide lock member which in a first position engages slide lock receiving means on the projecting male member to releasably maintain the male and female members in a secure, locked, mating relation. The non-ferromagnetic slide lock member preferably includes a ferrous contact member that, in a preferred embodiment, is in contact with or in juxtaposition to the permanent magnet in the engaged position. The slide lock member also has an aperture that in one preferred embodiment is partially aligned with the exterior aperture in the housing for the female member that receives the projecting male member when the two assemblies are moved into engagement. Thus, when the aperture in the slide lock is partially aligned, a portion of the exterior aperture of the housing is covered by the slide lock body. Upon insertion of the male member into the female member, a coming effect is created and the depending contact member moves with the slide lock member away from the permanent magnet against the attractive magnetic force to a second position that is still within the range of the attracting magnetic force between the magnet and contact member. As the male member is further inserted into the aperture of the female member, the slide lock member engages locking means formed in the male member thereby permitting the slide lock member to return to the first position with the contact member in contact with, or proximate to, the permanent magnet. A lock release is provided to move the slide lock member to the second position in order to release and remove the male assembly from the female assembly. In an alternative embodiment, the slide lock body completely covers the exterior aperture and must be displaced manually to at least an intermediate position to permit the cam surface to engage the cam follower surface to thereby move the slide lock member.

As is well-known from the prior art, the use of a torroidal permanent magnet provides the desirable concentration of the magnetic field to attract the ferromagnetic portion of the male member into the interior chamber of the female member. Without wishing to be bound by any theory of operation, it has been observed that when the ferromagnetic contact member on the slide lock member is in contact with the permanent magnet, the axial holding power is reduced. When the surface of the male member which creates the coming effect engages the companion cam follower surface of the slide lock member, the slide lock member moves away from the first position and breaks the contact between the ferromagnetic contact member and permanent magnet. As a result, there is an apparent increase in the magnetic holding power of the male member and the attractive magnetic force drawing the male and female assemblies into mating relation. As the slide lock member is caused to move towards the second position, the female member continues to exert an attractive force that is essentially opposite to the mechanical force being applied by the cam surface of the male member. When the locking means is reached at the end of the cam surface, the slide lock member is drawn back to the first position by the attractive magnetic force between the ferromagnetic contact member and the permanent magnet.

Thus, the apparatus and method of the invention comprehends a locking magnetic fastener in which a permanent magnet is positioned within and as part of the female assembly serves the dual function of (1) attracting and retaining the ferromagnetic male assembly in the female assembly, and (2) providing a biasing force for maintaining the locking member in the locked position. In a preferred embodiment of the invention, the magnet is a single permanent magnet which is torroidal and the magnetic field of the magnet alone and/or with associated elements provide the principal attractive force tending to draw and retain the projecting member of the male assembly into the central aperture of the female assembly. At the same time, a magnetic attraction exists between a ferromagnetic contact that forms a portion of slide lock member, and the slide lock member moves between first and second positions while at all times being subject to the attractive force within the female assembly, whereby it is attracted to a surface of the permanent magnet assembly.

It is to be understood that as used in describing the invention in this specification and the claims that follow, the term "permanent magnet" is also intended to include magnet materials of all types and in all forms that are adaptable for use in providing the necessary magnetic forces to attract (1) the ferromagnetic material that forms a part of the male member, and (2) the ferromagnetic material that forms a portion of, or is attached to, the movable slide lock member and secures it in the locked position. Examples of other types of magnetic materials comprehended by the invention include compressed, sintered and machined forms; magnets produced from natural ores and those in which the magnetic force is induced; and the class of electromagnetic devices, such as solenoids. Electromagnetic devices can be activated by AC or DC, or be battery-powered, or solar powered, depending upon the nature of the installation of the locking magnetic fastener. As well, in the context of its operability as an attractive device, the "permanent magnetic" includes the assembly within which it is mounted.

It should also be understood that there are other prior art magnetic fasteners which include magnets placed in both the male and female assembly to enhance their mutual attraction. The inclusion of a magnet in the male assembly is contemplated as being within the scope of the present invention, so long as the other aspects and features of the method and apparatus of the present invention are also present.

The configuration and placement of the permanent magnet or magnets can vary, so long as the resultant magnetic force is sufficient to attract both the male member and cause the slide lock member to reliably move from an open or unlocked position to a closed or locked position.

The type of material employed in the female assembly can also have a significant effect on the configuration of both the male and female assemblies and their construction. For example, the magnetic material neodymium is known to exert an attractive force on ferromagnetic materials that is much greater than that exhibited by the torroidal magnets commonly employed in magnetic fasteners sold for use on handbags and the like. Thus, the relative size of a torroidal magnet made from neodymium can be much smaller than that of a conventional magnet and still provide the same, or even a greater attractive force. The ability to reduce the size and/or modify the configuration of the magnet can permit the size of the female housing to be reduced, along with the contact and ferromagnetic element of the male member. For example, the permanent magnet can be provided with a relatively low or flat profile in a round or rectilinear configuration and without a central opening, i.e., non-torrodial, with the male member in touching contact to maximize the holding force when the male and female assemblies are completely engaged. Other changes and modifications to the structure and configuration of the elements forming the male and female assemblies and method of operation of the invention will be apparent to one of ordinary skill in the art.

It is also to be understood that as used herein the term "ferromagnetic", as applied to an element or member, includes elements and members that are constructed or fabricated in whole or in part from a material that is subject to the attraction of a magnetic force, sufficient to perform the function described. It will also be understood that whatever the nature of the ferromagnetic material and the strength of the magnetic force, the attraction must be sufficient to draw the slide lock member into its first or locked position against the inertial force and the frictional forces imposed by the particular configuration of the female assembly of which it is a part.

In the construction and assembly of the locking magnetic fastener of the invention, references to a slide lock member will be understood to comprise either (1) a single element that (i) either moves in a linear path or (ii) is pivot-mounted and moves in an angular path; or (2) multiple elements that move in either (i) linear paths, or (ii) angular paths.

The male and female assemblies can assume various external configurations, including those dictated by aesthetic considerations, particularly where the invention is to be used with fashion items such as handbags, carrying cases and the like. For example, the aperture in the female member can be offset from the center of the housing to accommodate the design of the handbag, and/or to allow for the assembly and operation of the locking mechanism.

BRIEF DESCRIPTION OF THE DRAWINGS

The above objects and other advantages of the present invention will be apparent upon consideration of the following detailed description and drawings in which:

FIG. 12 is a top perspective view of another preferred embodiment of the slide lock member shown in relation to a portion of the male assembly;

FIG. 13 is a side view of another embodiment of the invention shown in mated, locked relation which incorporates the slide lock member of FIG. 12;

FIG. 14 is a cross-sectional view of the embodiment of FIG. 13 taken along section line 14—14;

FIG. 15 is a partial front perspective view showing another embodiment of the invention attached to the front wall and closing flap of a handbag, briefcase, pouch, or the like;

FIG. 19 is a top perspective exploded view of another preferred embodiment showing a portion of the female assembly;

FIG. 20 is a cross-sectional view of the first element on the right-hand end of FIG. 19 take along section line 20—20;

FIG. 21 is a top perspective view of another embodiment of a slide lock member of the invention shown in relation to a magnetic element;

DETAILED DESCRIPTION OF THE INVENTION

Figure 2:
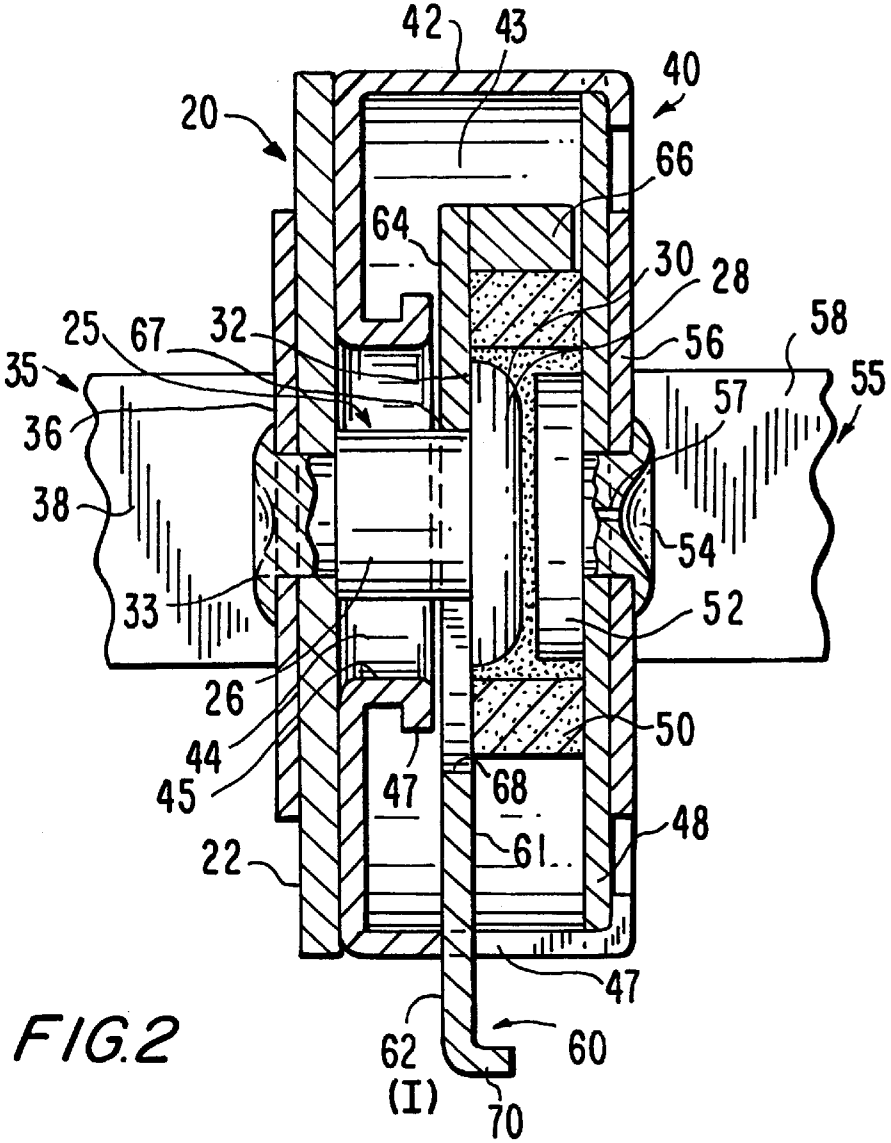
FIG. 2 is a cross-sectional view of the embodiment of the FIG. 1 taken along line 2—2.
Figure 3:
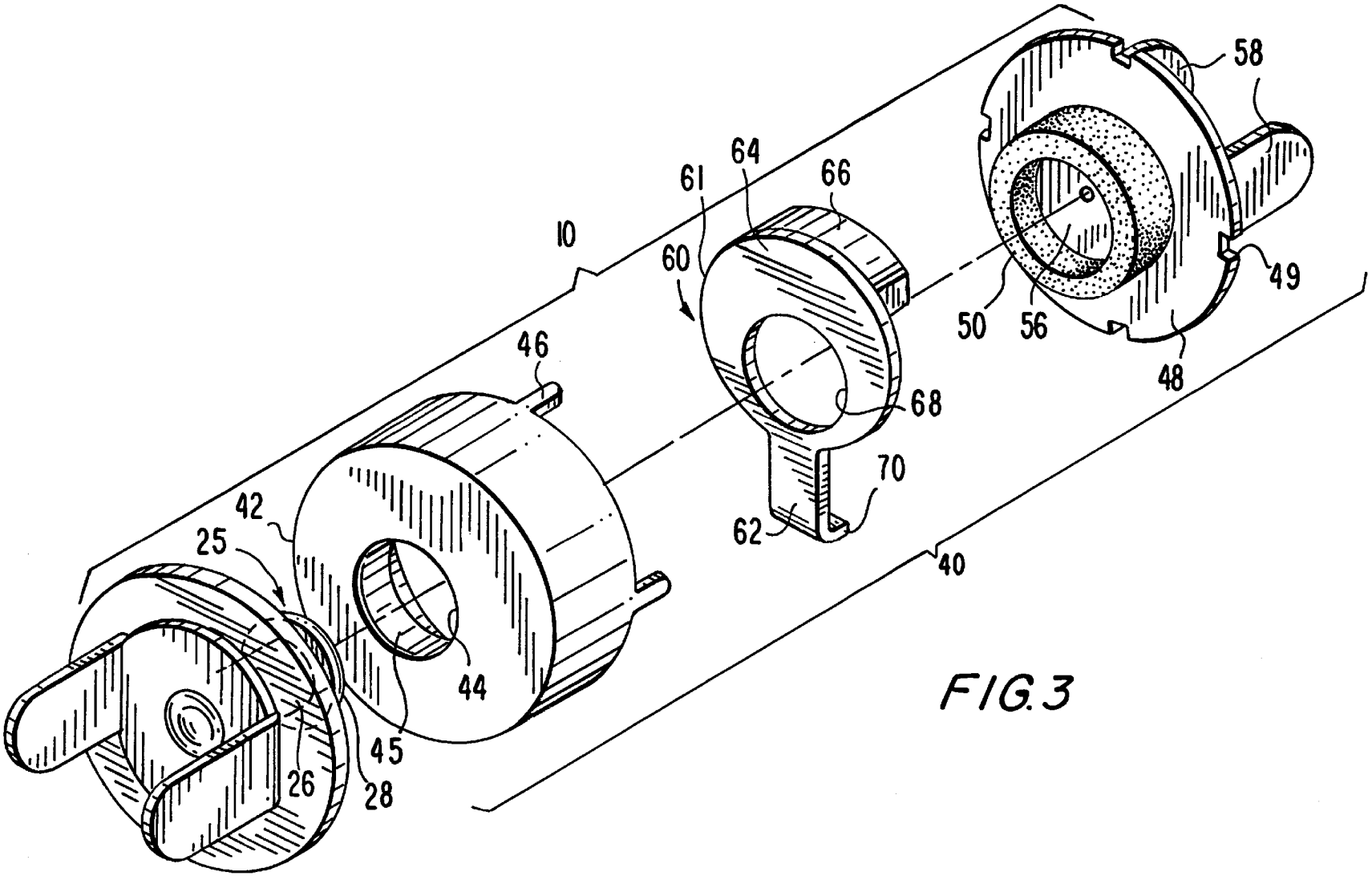
FIG. 3 is a top perspective exploded view of the embodiment of FIG. 1.

Referring to FIGS. 1–4, there is shown a first preferred embodiment of the locking magnetic fastener 10 of the invention with male assembly 20 matingly joined to female assembly 40. Male assembly 20 is comprised of a base member 22 on which are mounted projecting male member 25 and male attachment means 35. The male projecting member 25 includes shank 26, forward end 28 that incorporates cam surface 30 terminating in lock means 32, which, as shown in FIG. 2, is an offset shoulder formed between shank 26 and the projecting surface of the larger forward end member 28. In this preferred embodiment, and as best shown in FIG. 3, the forward end 28 and shank 26 of projecting male member 25 are circular. As will be understood by one of ordinary skill in this art, these elements can be provided with other cross sections, including, without limitation, square, rectangular, hexagonal and oval. Such configurations are often dictated by aesthetics, the appearance and configuration of the article to which the fastener is to be applied, and other fashion factors, as well as source identification considerations. Other cross-sections are described and illustrated below; however, in the interest of convenience in illustrating and describing the invention, further embodiments will, for the most part, employ a circular configuration.

Figure 1:
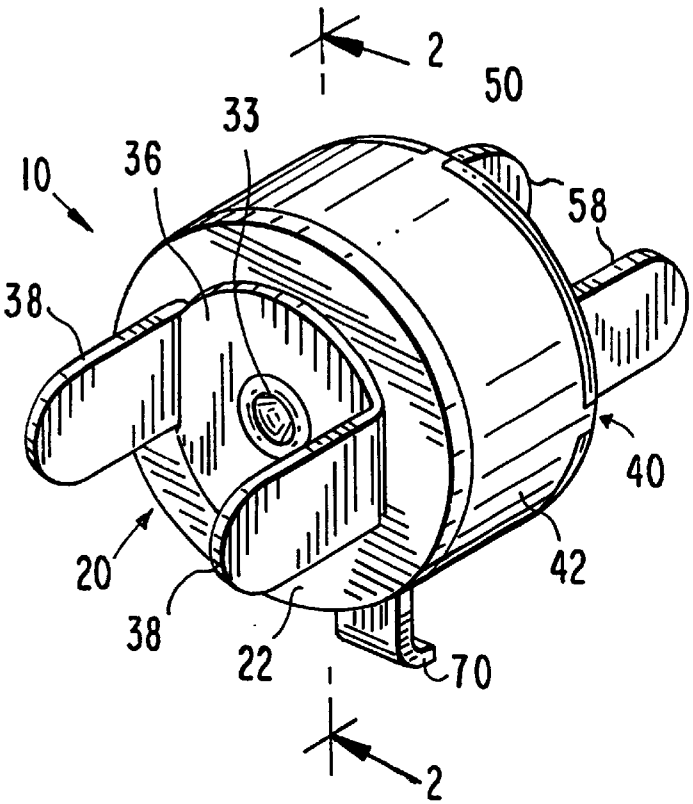
FIG. 1 is a top perspective view of one embodiment of the locking magnetic fastener showing the male and female assemblies in mated, locked relation.

Male member 25 further comprises male mounting means 33, which as best shown in FIGS. 1 and 2, can include a hollow, or semi-solid, or solid deformable rivet-like terminus that initially extends from shank 26 as an annular element. Attachment plate 36 is provided with a pair of arms 38 that are normal to base member 22 for the purpose of securing the male assembly 20 to a handbag or the like, although other attachment means are contemplated. Attachment plate 36 is provided with a central aperture through which is passed mounting means 33, which is thereafter deformed to secure the elements together.

With continuing reference to FIGS. 1–4, female assembly 40 is comprised of housing 42 having central exterior aperture 44 surrounded by annular collar 45 extending toward the interior of the chamber formed by the housing. As best shown in FIG. 2, collar 45 is provided with an outwardly extending flange 47 of an exterior diameter greater than the aperture 68 in the slide lock member 60 to insure that these elements do not engage. The side walls of housing 42 include a plurality of projecting deformable tabs 46. With reference to FIG. 3, slide lock member 60 is comprised of body 61 which, in this embodiment, is provided with an offset aperture 68 and has distal end 62 and proximal end 64. The distal end 62 of slide lock member 60 is provided with lock release means 70, which, in this embodiment, is in the form of a right-angle bend. Release 70 can be configured with such other surface or shape that can be utilized for conveniently and comfortably receiving the manually applied pressure of a fingertip or thumb to move the slide lock member. The offset aperture 68 is partially aligned with central aperture 44 in housing 42 in a first position (I), and sufficiently aligned in a second position (II) to receive the forward end 28 of projecting member 25.

Figure 4:
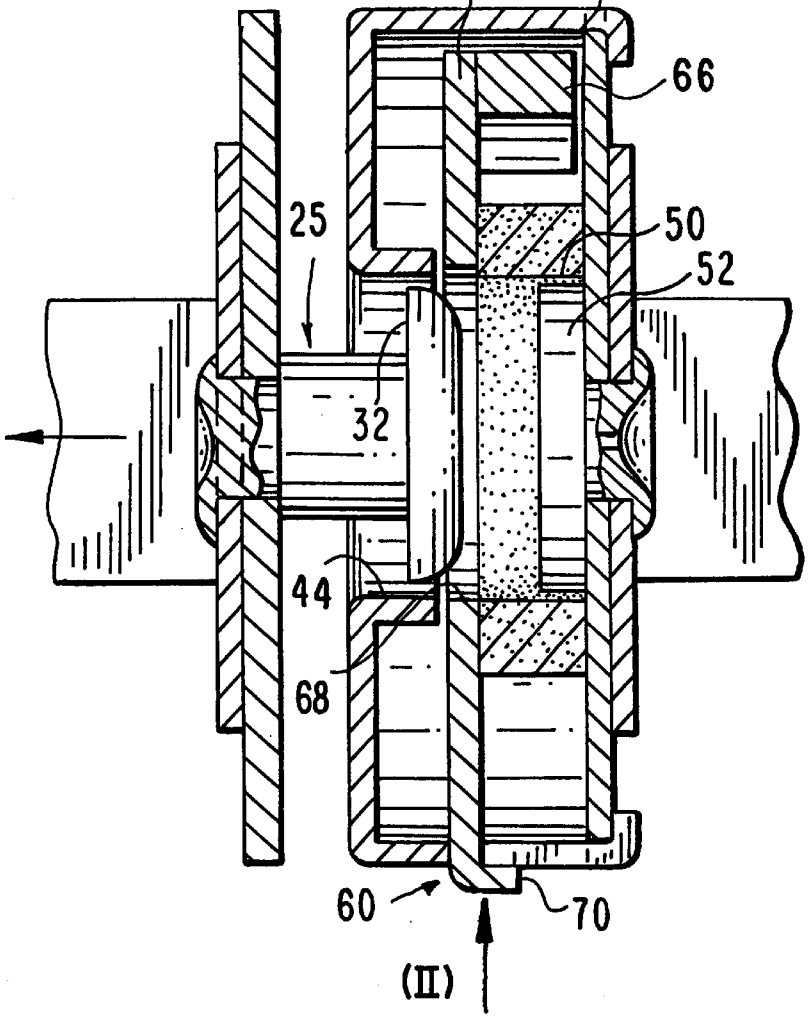
FIG. 4 is a cross-sectional view of the embodiment of FIG. 2 in the unlocked position showing the male assembly partially withdrawn from the mated position.

With continuing reference to FIGS. 2–4 in the Preferred embodiment shown, a ferromagnetic contact member 66 is secured in depending relationship from the proximal end 64 of preferably non-ferromagnetic slide body 61. As best shown in FIG. 3, ferromagnetic contact 66 is arcuate, and its external periphery corresponds to that of the slide body to which it is secured, e.g., as by adhesive bonding, mechanical or other conventional fasteners used to join metal elements.

With reference to FIG. 4, locking member 60 is shown in a second position (II) which is achieved by applying manual pressure to lock release means 70, as by pressing with a finger or thumb. In this second position (II), ferromagnetic contact 66 is displaced from its first position (I) on or proximate to the exterior surface or periphery of permanent magnet 50. Lock means 32 is moved out of contact with slide body 61 at the periphery of offset aperture 68, and into alignment with the exterior aperture of housing 42, thereby allowing the previously restrained forward head of projecting male member 25 to be withdrawn from the interior of the housing.

In the method of operation of the invention, the male and female assemblies are typically attached to the opposing faces of a handbag, briefcase, or other carrying case, and the user applies the necessary force by a finger or thumb on lock release means 70, which in turn causes the slide lock member 60 to move from its engaged position with the male member's lock means. At the same time, the user exerts a force generally in a direction normal to the slide lock movements, i.e., in the direction needed to disengage the male leading end 28 from the female to quickly and easily separate the two assemblies. As soon as the lock means clears the housing, the manual pressure is removed from release 70 and the attractive force between the slide contact 66 and magnet 50 causes the slide lock member to return to the first position (I). The female assembly is thus ready to again receive the male assembly without the need for coil, leaf or other types of spring or biasing members, all of the force being required to move the slide lock member being provided by the magnetic attraction. When the fastener is again to be mated and locked, the male assembly is moved into position adjacent the female assembly, and the attraction provided by the magnetic assembly in the central region of the housing 42 exerts a force on the ferromagnetic material of the forward end 28, which has the effect cf drawing the projecting male member 25 into the interior chamber. As the forward end 28 enters the exterior aperture 44, its cam surface 30 engages follower surface 67 at the periphery of the offset sliding lock aperture 68, thereby causing the slide lock member 60 to move from its first position (I) towards its second position (II). Once the cam surface 30 has passed through aperture 68, it reaches lock means 32 which allows slide lock member 60 to return to its first position (I) by virtue of the attractive force between contact 66 and the periphery of magnet 50.

As is well known in the art, the housing 42 of the female and various other elements of the male and female assemblies are of either ferro- or non-ferromagnetic material so as to protect the parts, assist in the operation of the device and modify magnetic attraction. Thus, In this first preferred embodiment, it will be understood from FIGS. 2–4 that the body 61 of lock member 60 is in contact with the adjacent surface of magnet 50, and the body is therefore a substantially non-ferromagnetic material, and that the coefficient of friction between these two elements is to be minimized to insure smooth sliding movement to facilitate the return of contact 66 to its position on or proximate to magnet 50. Slide body 61 can be fabricated from a smooth, rigid, low friction engineering plastic, or, if fabricated from metal, provided with a smooth, polished surface, or coated with a low friction material such as PTFE (TEFLON® from the Dupont Company). The choice of ferro- and non-ferromagnetic materials can also be dictated by aesthetic considerations, but the above factors will apply.

Figure 5:
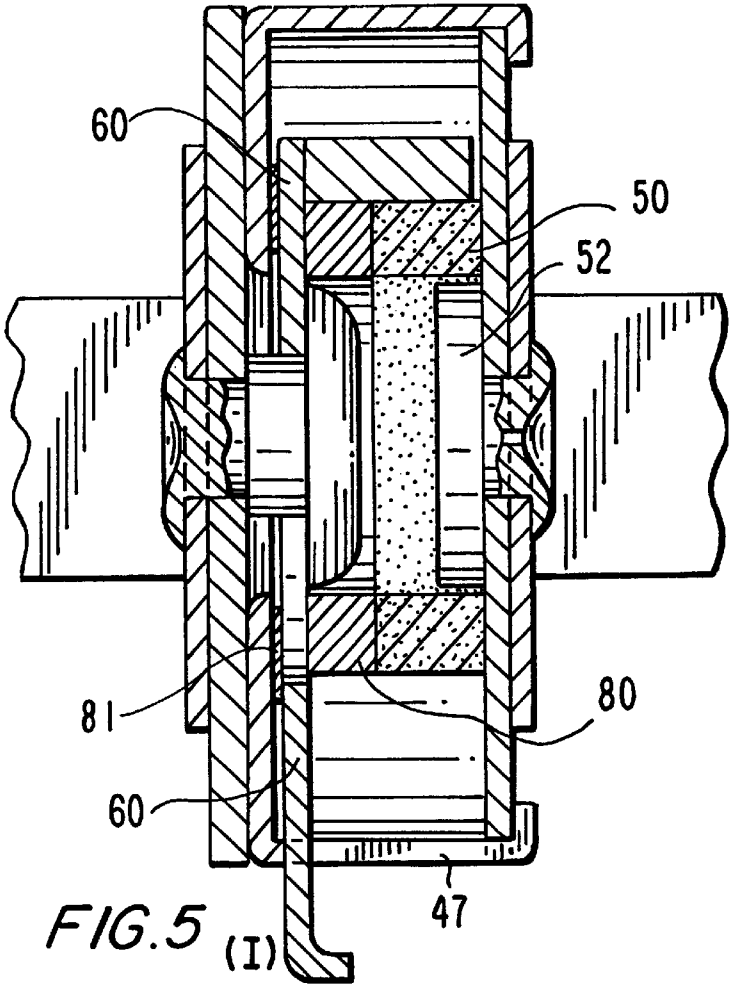
FIG. 5 is a cross-sectional view of a second preferred embodiment of the invention in mated, locked relation.

It will also be understood that ferromagnetic contact 66 can be formed from a separate element as described above and attached to the proximal end 64 of slide body 61, or can be formed as an integral element of lock member 60, as by appropriately bending and shaping the proximal end normal to the body and providing it with a ferromagnetic plating, or securing a ferromagnetic element to the formed depending surface. Alternatively, the entire slide lock member can be fabricated from a ferromagnetic material and, as shown in FIG. 5, maintained in spaced relation from the magnet 50 by non-ferrous slide plate 80. Slide plate 80 can be fixedly mounted in the interior chamber in contact with magnet 50, or mounted for movement with slide lock member 60. In either event, the surface of slide plate 80, which is subjected to relative movement, should exhibit a low coefficient of friction for the reasons stated above.

It will also be understood by one of ordinary skill in the art hat the cap 52 of the female fastener assembly can be eliminated and other known mounting means employed. In order to provide enhanced attraction and holding power between the assemblies, the female base member 48 can be made of ferromagnetic material and the projecting male member 25 configured to contact the base member when the assemblies are engaged.

It will also be understood, that methods and constructions known to the magnetic fastener prior art to enhance the attraction between the male and female assemblies and the holding force of the joined assemblies can be adapted for use with the locking magnetic fastener of the invention.

With further reference to FIG. 5, there is shown spacer ring 81 positioned between housing 42 and slide lock member 60 having an aperture corresponding the exterior aperture 44. Spacer 81 can be of ferromagnetic or non-ferromagnetic material. It can be utilized to stabilize or guide the movement of the slide lock member. In the embodiment illustrated by FIG. 5, the contact 66 is a separate element affixed to the proximate end of the slide body 61. Alternatively, the ferromagnetic slide lock member can be machined or otherwise formed or shaped from a single piece of stock, thus providing a unitary constructions.

It will be understood from the embodiment illustrated in FIG. 5 that the slide plate 80 is provided with a central aperture corresponding to the forward end 28 of the projecting male member 25 to insure an interference-free passage and the engagement of the locking means. male member 25 to insure an interference-free passage and the engagement of the locking means.

Figure 5A:
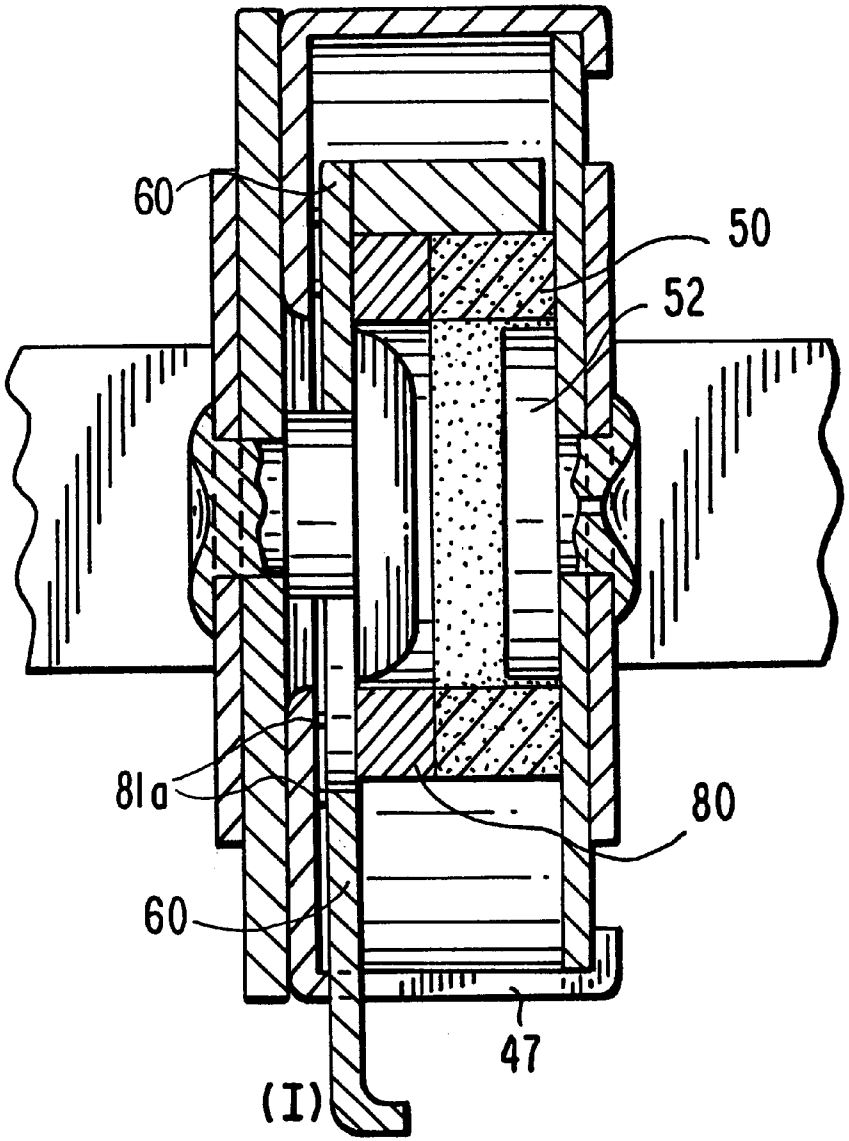
FIG. 5*a* is a cross-sectional view of a modification of the second preferred embodiment of the invention shown in FIG. 5.

It will be understood from the method of operation illustrated in FIG. 5, that alternative constructions in which the surface of the slide lock body 61 opposite the interior top wall of housing 42 can be provided with one or more projecting portions to facilitate sliding contact between these two members. For example, the surface of the slide body 61 can be provided with corrugations, ribs and/or spaced apart raised areas of other configurations shown in black box form 81 a in FIG. 5a to contact the interior surface of housing 42 to stabilize the slide lock member while it is stationary or during movement, and at the same time, to minimize the frictional forces between these two parts.

The interior chamber formed by housing 42 and base 48 can be of any convenient size and, as noted above, of a simple utilitarian configuration to protect and define the range of movement of the slide lock member; or the configuration can be ornamental or so shaped as to provide an indicia which permits recognition of the device from a source. It will be understood that the interior chamber must be sufficient to accommodate the movement of slide lock member 60 between its first position (I) and its second position (II). The range of movement can be determined by interfering contact between the proximal end of lock member 60 with the interior of housing 44, or other structure provided specifically for this purpose (not shown); and/or by contact with lock release means 70 with the exterior of housing 42 in the vicinity of side wall opening 47.

Figures 6, 7, 8:
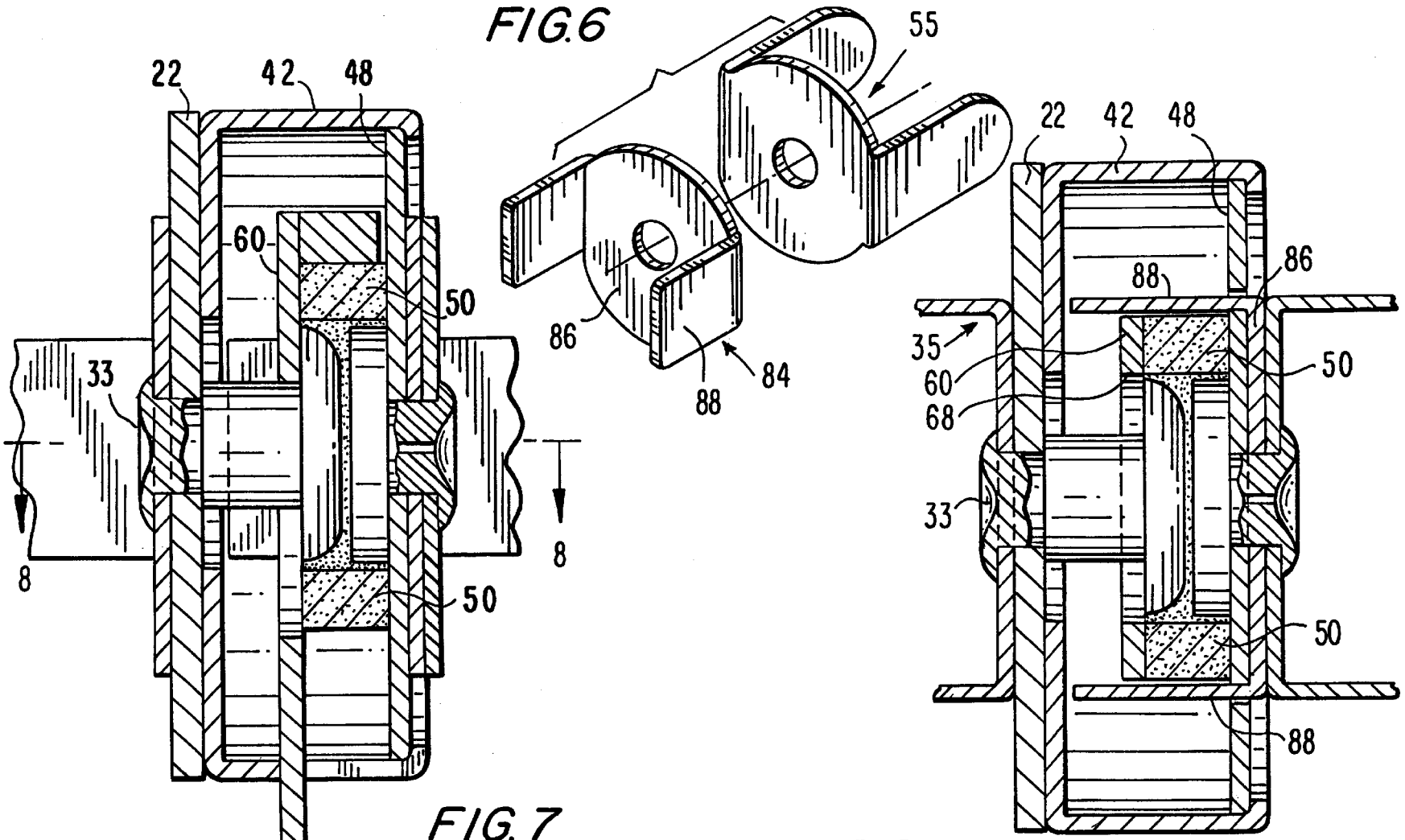
FIG. 6 is a top perspective view showing the relationship of two elements employed in a further embodiment of the invention.
FIG. 7 is a cross-sectional view of a further embodiment of the invention which incorporates the elements of FIG. 6.
FIG. 8 is a cross-sectional view of the embodiment of FIG. 7 taken along line 8—8.

If desired, additional structure can be provided to control and direct the movement of slide lock member 60. For example, as illustrated in FIG. 6, a guide 84 comprising base 86 and flanking arms 88 can be secured to the female base 48 as is, for example, shown in FIGS. 7 and 8, to insure linear movement between the first and second positions.

Figure 9:
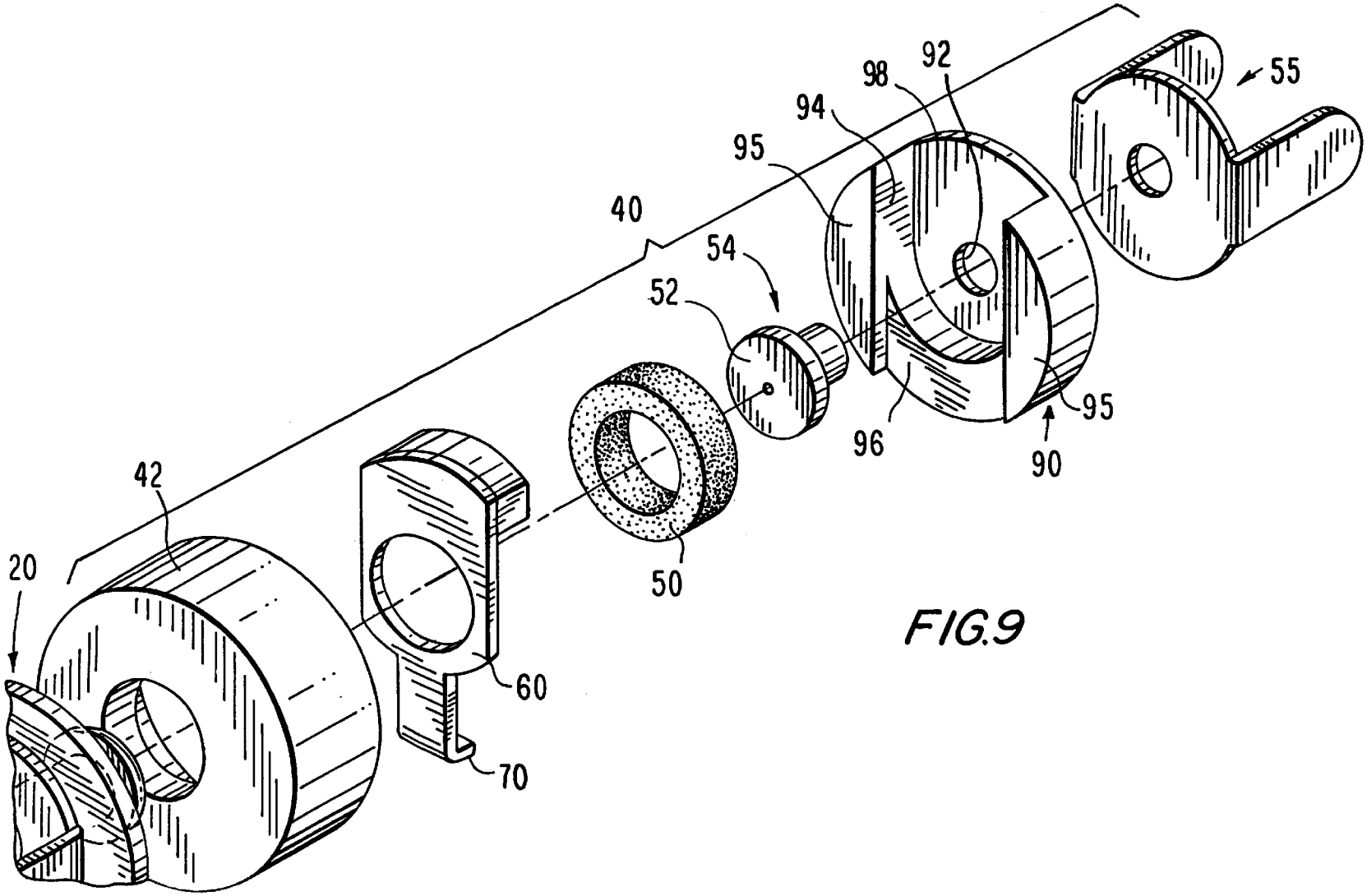
FIG. 9 is a top perspective exploded view of the female assembly of another embodiment of the invention shown in relation to a segment of the male member.
Figure 11:
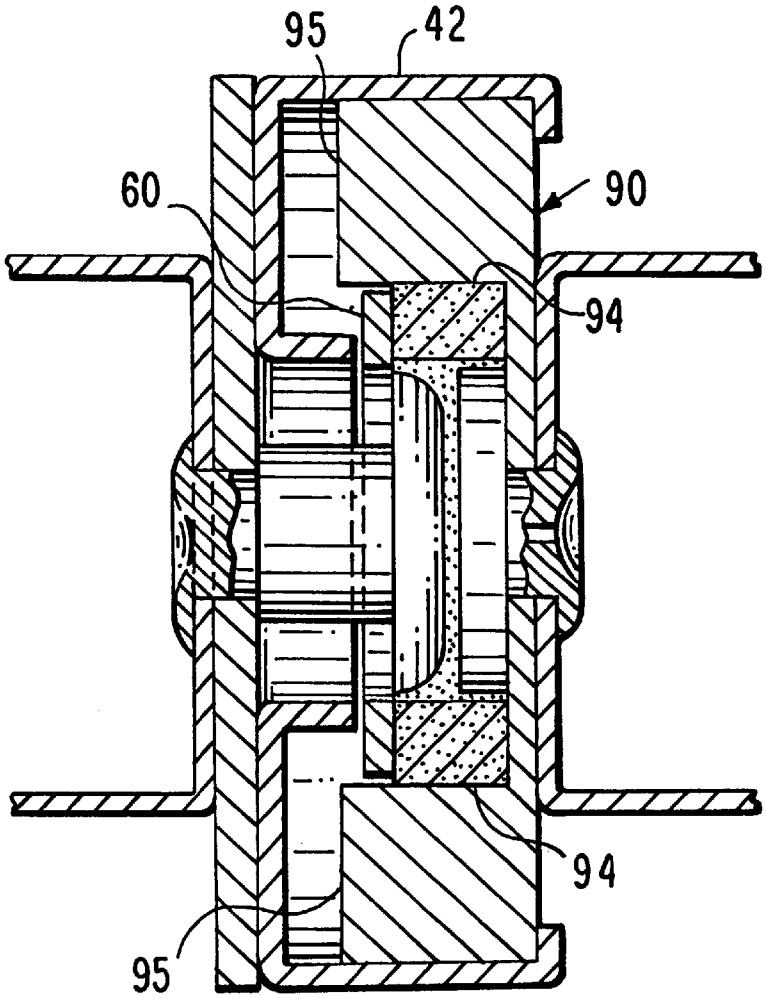
FIG. 11 is a cross-sectional view of the embodiment of FIG. 10 taken along line 11—11.
Figure 10:
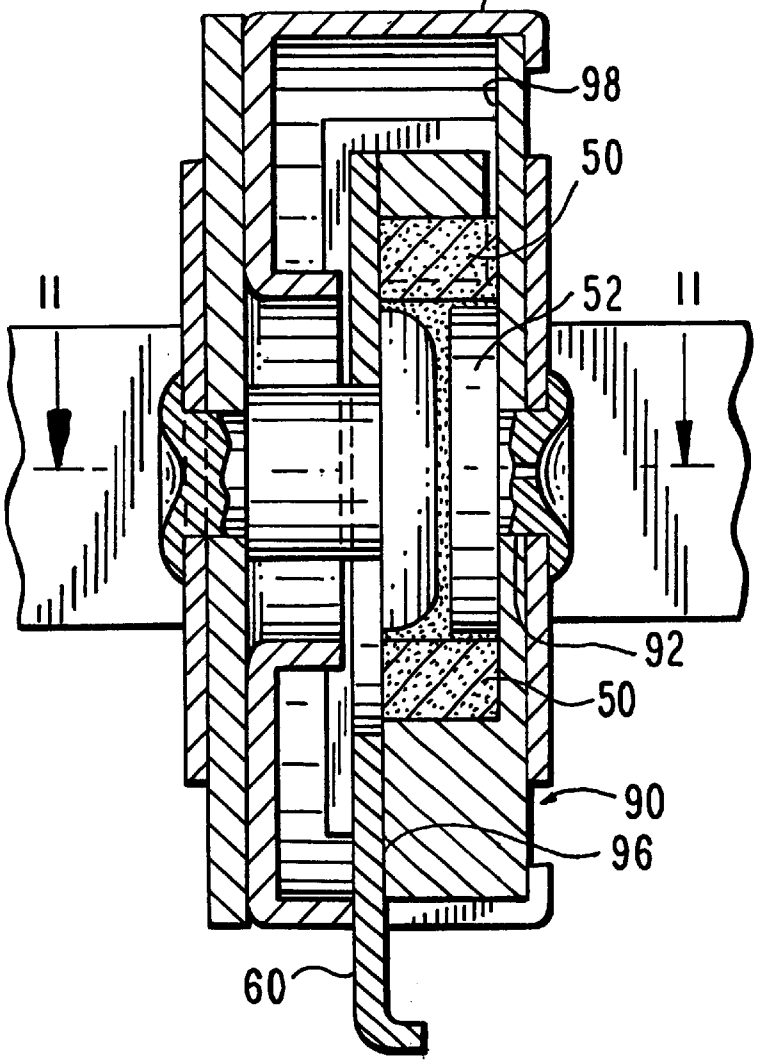
FIG. 10 is a cross-sectional view of the embodiment shown in FIG. 9.

In an alternative preferred embodiment shown in FIG. 9, a contoured retaining guide 90 is provided by molding and/or machining a non-ferrous material. Guide 9 is preferably provided with a base 98 having mounting aperture 98 and surrounded by retaining wall 94 that provides an area for receiving magnet 50, which in this embodiment is torroidal but could be of any other desired functional configuration. Upper surface 95 is provided with guide channel 96 adapted to receive the slide lock member 60 in sliding relation. As will be apparent to one of ordinary skill in the art, retaining guide 90 can be provided in a variety of alternative configurations, including those in which the retaining wall 94 completely surrounds magnet 50 (not shown), and provides a pail of guide channels 96. With further reference to FIG. 9, attachment means, which can include ferromagnetic annular member 52, is employed to secure guide 90 to female assembly attachment means 55. FIGS. 9 and 10 further illustrate the final assembly of this embodiment.

With reference to FIGS. 12–14, there is illustrated a preferred embodiment of the slide lock member 60 in which the cam follower surface 67 that defines slide aperture 68 is bounded by beveled throat 73. The purpose of this beveled region is to facilitate the entry of the projecting male member into aperture 68 and its eventual locked, mated relation with female assembly 40. As shown in the corresponding views of FIGS. 13 and 14, the method of operation and engagement of the locking means with the slide plate is analogous to that described above in connection with FIGS. 1–4. The beveled area of the slide lock member of this embodiment can be conveniently and efficiently formed by appropriately configured metal stamping dies. As shown in FIG. 14, a guide 84 having upstanding arms 88 is provided to limit the directional movement of locking member 60 from its first position (I) to its second position (II), shown in phantom.

From the above description of FIGS. 12–14, it will also be understood that housing 42 can also be formed with a beveled area surrounding the exterior aperture 44 to further guide and facilitate the movement of the male member into the female assembly.

Figure 17:
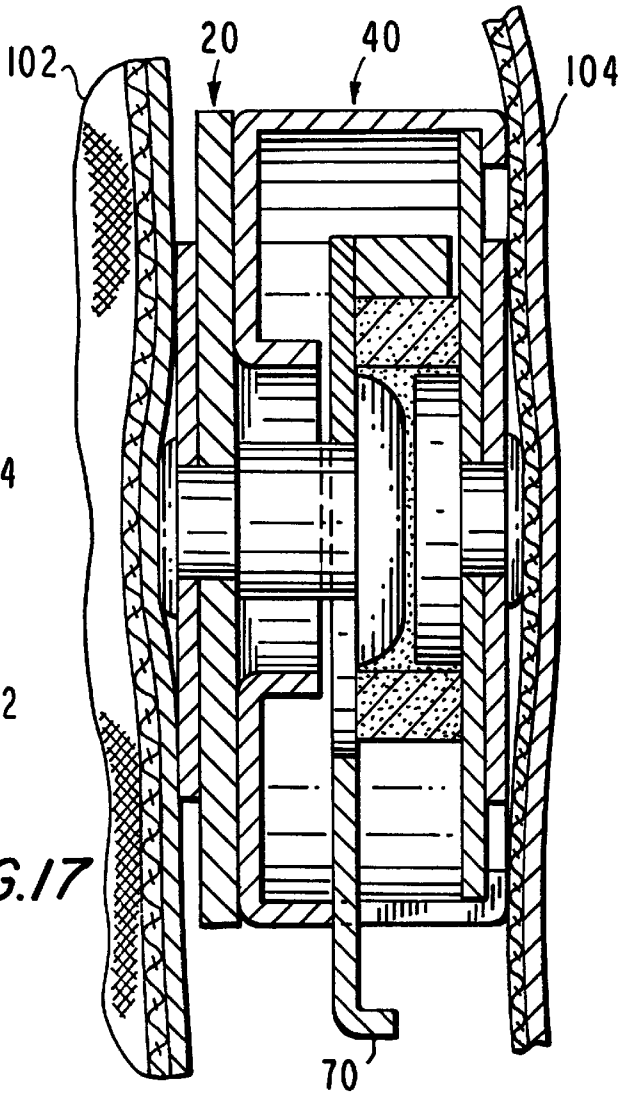
FIG. 17 is a partial cross-sectional view of the fastener of FIG. 16 taken along section lines 17—17.
Figure 16:
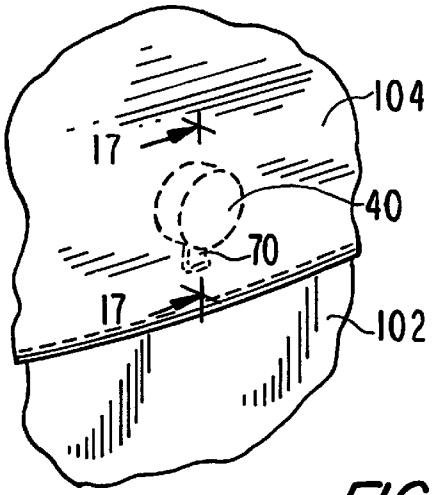
FIG. 16 is a partial perspective view of the embodiment shown in FIG. 15, where the fastener is shown in phantom in mated, locked relation.
Figure 15:
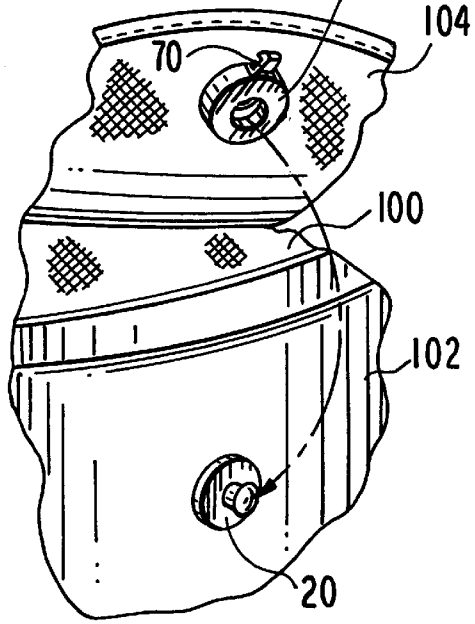

One preferred arrangement for mounting the locking magnetic fastener invention is shown with reference to a handbag, briefcase, or the like in FIGS. 15–17. The female member 40 is attached to the interior of closure flap 104 so that the lock release 70 is proximate the free edge of the flap. As indicated in FIG. 15, the lock release 70 is displaced inwardly, and when the flap is closed, as shown in FIG. 16, the locking mechanism is not visible to a casual observer of the exterior of the bag. Referring to FIG. 15, male assembly is mounted on an opposing wall 102 of the bag 100 in an appropriate position to mate with female member 40. The relationship between the elements of the bag and the slide lock member is shown in the cross-sectional view of FIG. 17, it being understood that the male attachment means 35 and female attachment means 55 are employed to secure the respective assemblies to the leather or textile material in accordance with well known practices in this art.

With reference to FIG. 17, in order to open the bag, a finger is placed between the flap and front wall, and the lock release 70 is pressed towards the cover while lifting up on the adjacent edge of flap 104 to withdraw the projecting male member from the interior chamber.

Figure 18:
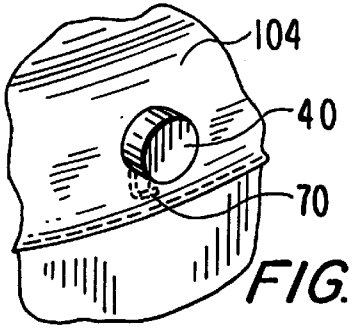
FIG. 18 is partial front perspective view similar to FIG. 16, where the female assembly, shown partly in section, extends to the exterior of the bag.

In the alternate embodiment shown in FIG. 18. a portion of the female assembly is mounted on, or projects through, flap 104, and the lock release 70 remains under the flap and is activated as described above. In the embodiment illustrated in FIG. 18, it will be understood that the exterior element is a decorative feature whose placement and configuration is determined by aesthetic or source identifying considerations, in as much as the functional elements of the female assembly are located on the interior of the flap. As will also be appreciated by one of ordinary skill in this art, the relative positions of the male and female members, as shown in FIGS. 15–17, can be readily reversed. The female assembly, including the lock release 70, can also be mounted on the exterior of flap 104 by changing the location and configuration of attachment means 55 (not shown) and providing flap 104 with an appropriately aligned aperture.

A further alternative embodiment for the assembly of the invention is shown in FIGS. 19 and 20. A combination guide and female attachment means 20 is formed from an integral base 86 having a pair of deformable attachment arms 58 extending outwardly and a pair of guide arms 88 offset and extending into the interior chamber. An intermediate plate 120 fabricated from an insulating material is provided with a pair of slots for receiving arms 88 and a central aperture 124 for receiving mounting means 52. In this preferred embodiment, intermediate plate 120 prevents the magnet from making contact with the base member and causing it to exhibit magnetic properties. In this embodiment, the housing 42 (not shown) is knurled over and around the periphery of intermediate plate 120 in order to seal the female assembly.

As will be understood by one of ordinary skill in the art, the configuration and method of joining the housing and base elements can be varied.

In yet another embodiment as shown in FIG. 21, the guide body 61 is provided with a pair of depending arms 78 which displaces slide lock member 60 from coming in to contact with magnet 50 when these two elements are assembled into the female assembly 40.

Figure 22:
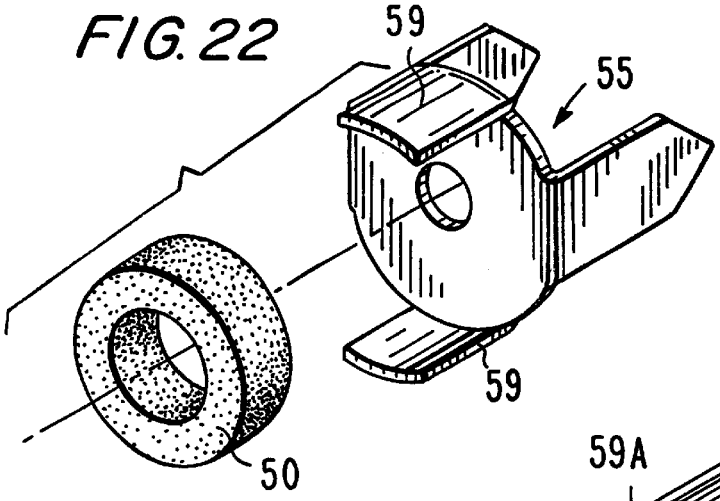
FIG. 22 is a top perspective view of another embodiment of the invention showing the relationship of two elements of the female assembly.
Figure 23:
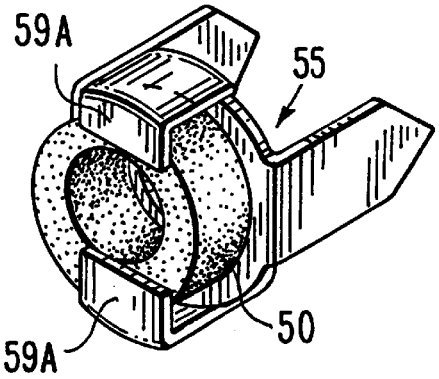
FIG. 23 shows the elements of FIG. 22 at a further stage of assembly.

In a further modified configuration illustrated in FIG. 22, the female attachment means 55 is provided with at least two retaining arms 59 which, as shown, are contoured to the periphery of magnet 50. In this embodiment, retaining arms 59 can serve to support body 61 of slide lock member 60 in a position that is displaced from the surface of magnet 50, and is preferably fabricated from a non-ferrous material, as by metal stamping methods well known in the art. Alternatively, as shown in FIG. 23, the terminal ends 59A of retaining arms 59 can be folded over above magnet 50 to provide a broader surface upon which slide lock member 60 can move.

Figure 24:
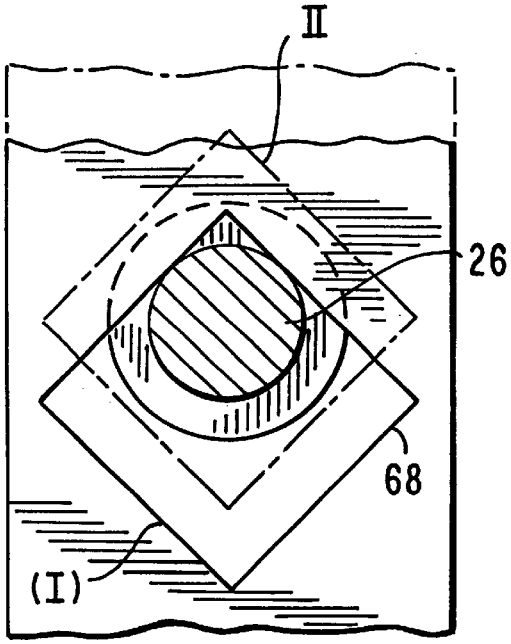
FIG. 24 is a top plan view schematically illustrating another embodiment of the locking member of the invention in a locked position, and in the phantom, open position.
Figure 25:
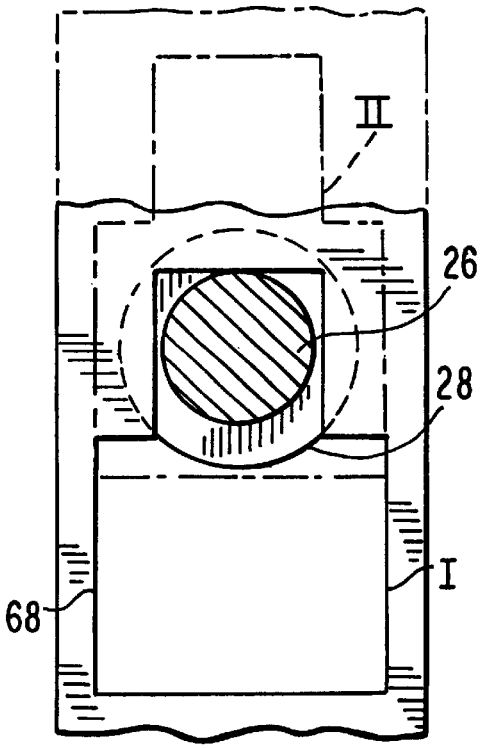
FIG. 25 is a view similar to FIG. 24 showing another preferred embodiment of a slide lock having a different configuration.

As has been explained previously, the particular configuration of the projecting male member 25 and the slide lock aperture 68 can be varied. For example, as shown in FIGS. 24 and 25 respectively, apertures 68 can be provided in a rectilinear configuration or a T-shaped configuration. As is shown, in each of these embodiments, when the aperture is moved from first position (I) to second position (II), the locking means of forward end 28 is no longer engaged and can be removed from the aperture. As will also be understood from the above description and the prior art, the configuration of the projecting male member, and particularly its forward end 28, can also be varied to correspond to the exterior aperture in housing 42 as well as that of the aperture 68 in slide lock 60.

Figure 27:
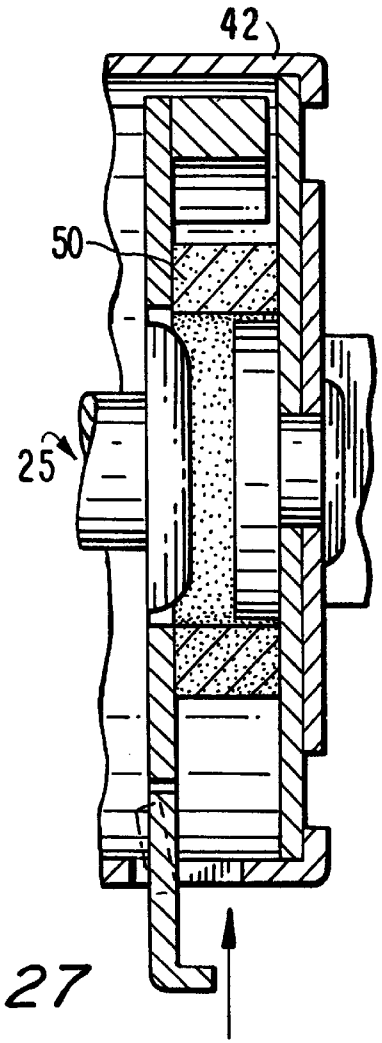
FIG. 27 shows the embodiment of FIG. 26 with the slide lock in the open position.

To further enhance the security of the locking magnetic fastener, in a preferred embodiment, a safety release is incorporated into the slide lock member. The function and purpose of the safety release is to inhibit the disengagement of the locking means as a result of an inadvertent movement of the projecting release 70. This result can be achieved by a number of mechanical means, including detents, slots, interfering offsets, and the like. By way of example, and with reference to FIGS. 26 and 27, there is shown a portion of mated male assembly 10 and female assembly 40 of construction similar to that described above in connection with FIGS. 1–4. Slide lock member 60, shown in the locked first position (I), is provided with a projecting safety release that makes interference contact with the exterior of housing 42 proximate the side wall opening 47. The interfering contact between safety release 72 and housing 42 prevents the displacement of embodiment 60 from its locked position (I) by a force applied in the same plane as the lock member. In order to move slide lock 60, a force generally normal to the plane of the locked member must be applied to the proximal end that extends from the housing. In this embodiment, it will be understood that the tolerances in the assembly and/or the resilience of the material from which lock member 60 is fabricated will be determinative of the amount of force that must be applied to disengage safety release 72. As shown in FIG. 27, after the generally normal force has been applied, the slide lock member 60 can then be urged towards the housing.

Figure 26:
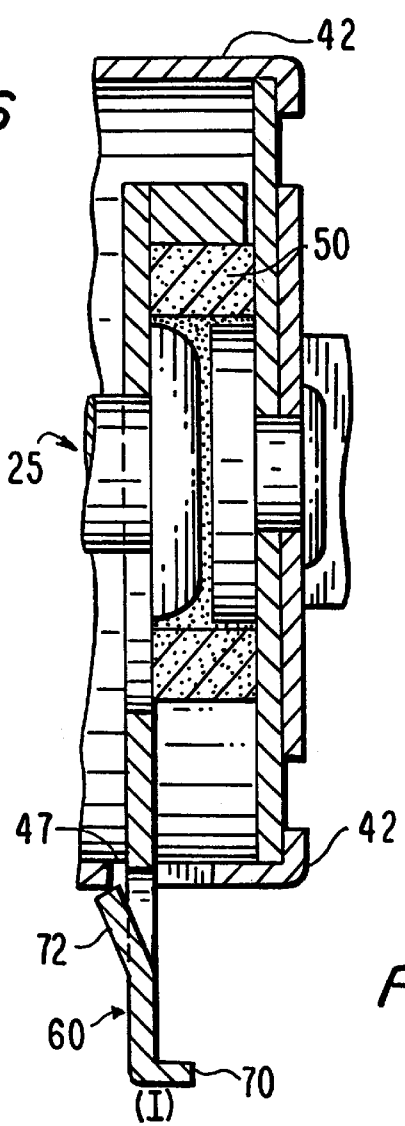
FIG. 26 is a partial cross-sectional view of another embodiment of the invention shown in mated, locked relation, the slide lock being provided with a safety release.

From the above description of the safety release illustrated on FIGS. 26 and 27, it will be understood that a similar feature can be included to retain the slide lock member in the open position. For example, a retainer member (not shown) can be provided in the body 61 that engages the interior surface of the housing adjacent the opening 47. The retainer is moved into engagement by applying a manual force that is normal to the direction of movement required to release the lock means. Thus, utilizing the retainer member to prevent the slide lock member from returning to the first position permits the male assembly to be moved into and out of the female assembly by applying a manual force to overcome the magnetic force that holds the two assemblies in place.

Figure 28:
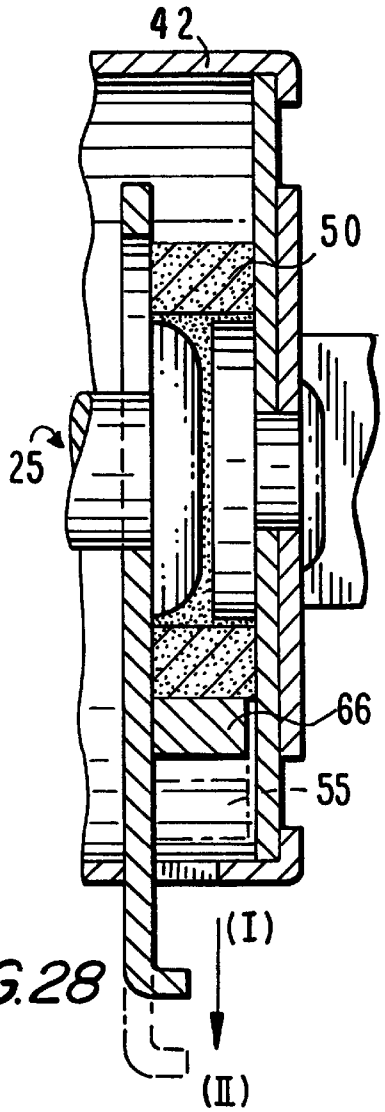
FIG. 28 is a partial cross-sectional view of yet another preferred embodiment of the invention, shown partly in phantom, to indicate its m)de of operation.

In a further embodiment of the invention, the movement of the lock member 60 from its locked first position (I) to its unlocked second position (II) can be accomplished by a pulling movement rather than the pushing movement described in connection with the previously described constructions and methods. An example of such an apparatus is shown in FIG. 28 where the ferromagnetic contact 66 is attached to lock body 61 between the slide lock aperture 68 and the distal end 62. With further reference to FIG. 28, it will be seen that the force applied to unlock the fastener of this embodiment is applied in a direction opposite to that of the embodiments previously described. However, the same considerations apply to the size and placement of element 66 in this configuration, i.e., that the attractive force between contact 66 and magnet 50 must be sufficient to cause the lock member to return from the withdrawn position (I) to the retracted locked second position (II).

In another embodiment, the safety release can be formed by providing a slot in the proximal end of the slide lock member 60 at a position that corresponds to the adjacent housing wall 52 and providing a biasing force to cause the slot to engage the side wall when lock member 60 is in the first position (I). The safety release is disengaged by applying a force laterally to the edge of the lock member 60 until the slot is free of the housing side wall.

It will be understood that the slide lock member 60, as well as other elements forming the improved locking magnetic fastener are shown to be of symmetrical configuration for convenience of assembly of the device during manufacture to avoid the need for special alignment. However, there is no requirement that the parts be symmetrical, and design considerations, including aesthetics, can be accommodated with asymmetrical elements. Some exemplary alternative design configurations are illustrated in certain of the embodiments which follow. Furthermore, as will be apparent to one of ordinary skill in the art, additional modifications can be incorporated without departing from the spirit or scope of the invention as defined by the claims.

Figure 29:
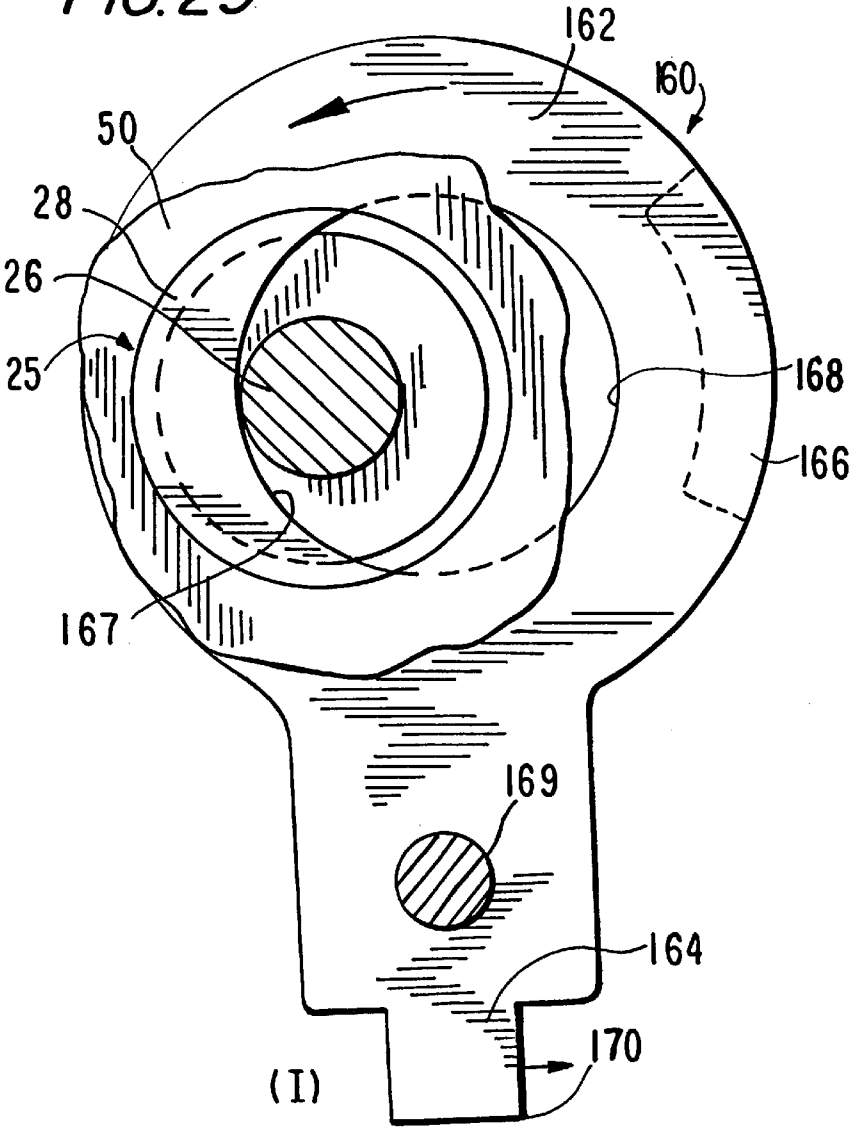
FIG. 29 is a top plan view of a portion of the lock member in relation to a portion of the male assembly shown in partial section, to schematically illustrate the mating relation of a pivotally mounted locking member.

With reference to FIG. 29, there is shown one embodiment of a pivotally mounted slide lock member 160 in engaged locked relation with the male member 25. Slide lock member body 162 is conveniently produced by die stamping or machining from the materials described above. It is formed with aperture 168 defined in part by cam follower surface 167 that contacts forward end 28 of male member 25, thereby causing arcuate deflection to position (II) around pivot mounting pin 169 that is secured to the female housing. The slide lock member body 162 is returned to its original position (I) upon engagement of the locking means by the magnetic attraction of a ferromagnetic contact 166 secured to body 162 and the permanent magnet 50 (not shown). The proximal end 164 extends from the housing and is provided with release 170 which can be moved to rotate the aperture 168 into alignment to permit the male member to be withdrawn from the female assembly.

Figure 30:
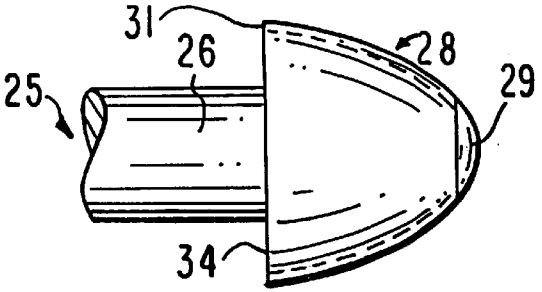
FIG. 30 is a side elevation view of a projecting male member partially formed of ferromagnetic material.

In a further preferred embodiment, as illustrated in FIG. 30, the amount of ferromagnetic material in the projecting male member can be reduced. As illustrated, the proximal end 25A of projecting male member 25 is formed with a non-ferromagnetic material. Depending upon whether the overall configuration of the forward end 28 is a relatively flat ellipsoid or a more elongate paraboloid, the non-ferromagnetic material can comprise a greater or lesser proportion of the forward end 28. The non-ferromagnetic member can be die cast from a zinc and lead alloy, machined from brass, copper, or formed of other metal, and can also alternatively be of molded plastic. It can be joined to the distal ferromagnetic portion of forward end 28, or to shank 26 by adhesive, by threaded engagement, or by integral casting. Since the purpose of providing a non-ferromagnetic material at the proximal end of male assembly 25 is to minimize attraction that may form in the housing 42, the amount of ferromagnetic material retained in the male assembly 25 is to be sufficient to provide the desired attractive force that will cause the male assembly to be drawn into mating relation with the female assembly. The determination of the relationship between the size and configuration of the non-ferromagnetic proximal end member and that of the ferromagnetic material in the projecting male member 25 is within the skill of the art.

With reference to FIG. 30, there is shown a portion of the projecting male member 25, including shaft 26 joined to leading end 28. The leading end 28 is fabricated in whole or in part of a ferromagnetic material, i.e., a material that will be attracted into an appropriate aligned position and drawn by magnetic attraction to the interior of the chamber 43 formed by housing 42. These desired results can be achieved by providing a ferromagnetic material in combination with a non-ferromagnetic material, e.g., in a configuration where the tip section 29 is of a non-ferromagnetic material, and optionally extends as a sheath or housing 31 over a core 34 of ferromagnetic material. Tip section 29 can be of a low friction and/or resilient polymeric material that will not mar or scratch the exterior surface of the housing 42 and slide lock member body 61 that is exposed in exterior aperture 44. The use of a low friction material for tip section 29 and, optionally sheath 31, will advantageously facilitate the movement of the corresponding cam surface 30 during its contact with cam follower surface 67 prior to engagement of the lock means 32. The use of contrasting materials, colors and finishes can be employed to provide striking aesthetic effects and to make the male member of FIG. 30 more attractive, or to distinguish the product of one source from another.

It will also be understood by those familiar with the art that contact between the ferromagnetic material of forward end 28 and the ferromagnetic cap on female mounting means 52 affects of the magnetic attraction between the male and female assemblies. The ferromagnetic cap 52 preferably does not contact magnet 50, because that will reduce the attractive and holding force between the male and female assemblies. Alternatively, the cap of female mounting means 52 can be formed of a non-ferromagnetic material.

It is also to be understood with reference to the illustrative drawings that the ferromagnetic contact 66 is shown in spaced-apart relation to the base 48, which is preferably a ferromagnetic material. In the construction and operation of the devices of the invention, these elements can be in touching sliding contact if base 48 is a non-ferromagnetic material. In those constructions where a surface of contact 66 is in touching relation with the surface of base 48, a low coefficient of friction between these elements is desired, and can be achieved as by polishing one or both surfaces or providing an intermediate member, i.e., a slide pad 99 of low friction material, such as PTFE, as shown in FIG. 21. In this embodiment, a non-conducting slide pad 99 can serve as an insulator where base 48 is of ferromagnetic material.

In the interests of clarity, the illustrative figures show a space between the tip of male assembly 25 and the structure of the female assembly. However, as will be apparent to one of ordinary skill in the magnetic fastener art, if the tip portion of projecting male member 25 is a ferromagnetic material, the overall attraction of the male assembly to female assembly can be enhanced by providing touching contact with the ferrous cap 52. Various other features and constructions that are generally known and employed in the magnetic fastener art, such as an axial orifice 57 in the mounting means 52 as shown in FIG. 2, can be incorporated into the locking magnetic fastener of the invention.

One or both ends of the slide lock member 60 can be supported and stabilized by to providing an appropriately-sized, close-fitting opening between female assembly housings in which a lower outer cup is engaged in a snap-fit, or is otherwise secured to a close-fitting, upper inner cup. By aligning the openings in the inner and outer cups, the extending distal end 62 is supported and its movements stabilized by the adjacent sidewalls of the cups in a first preferred embodiment. In a second alternative embodiment, the opposite or proximal end of the slide lock member body 61 is extended to project from a similar supporting opening (not shown) formed in the opposite sidewalls of the assembled cups.

Figure 32:
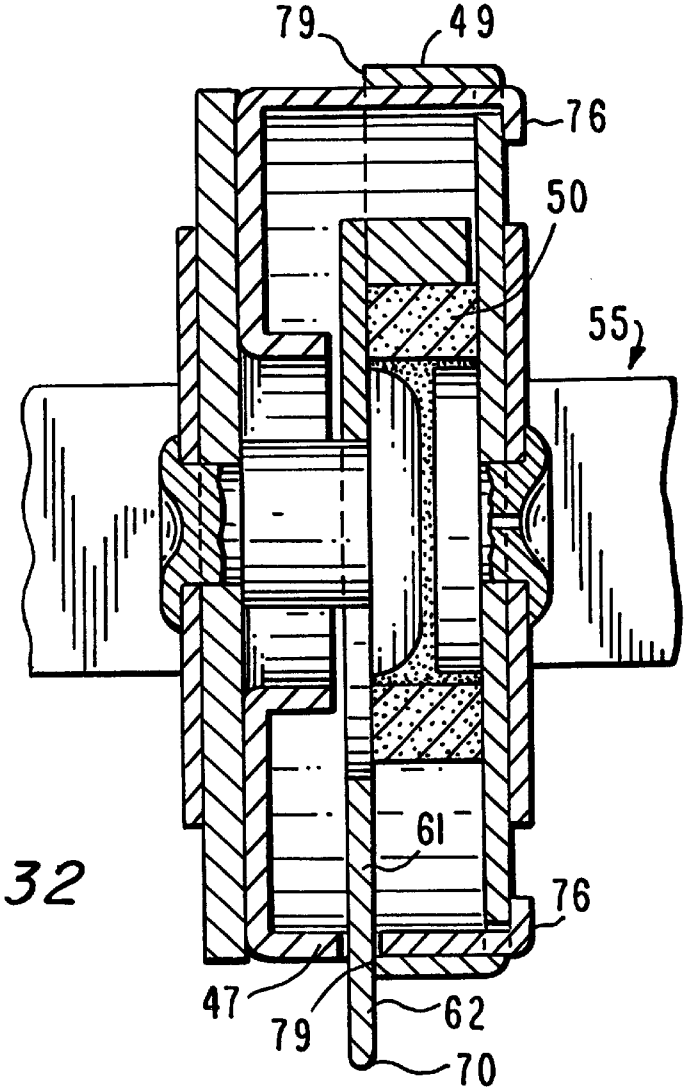
FIG. 32 is a cross-sectional view of the embodiment of FIG. 31 taken along line 32—32.
Figure 31:
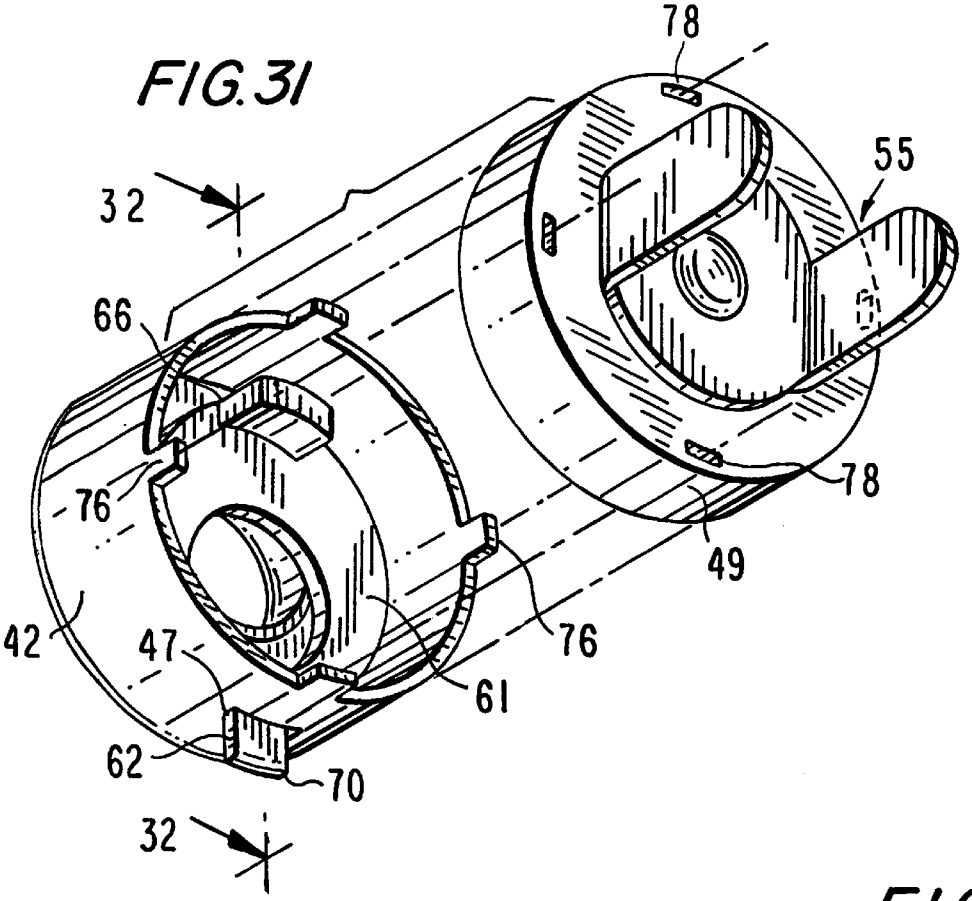
FIG. 31 is a bottom perspective exploded view of another embodiment of the invention in which the housing comprises mating cups.

As shown in FIG. 31, the housing 42 can take the form of an inner cup that is provided with a plurality of projecting tabs 76 and a sidewall opening 47 that is dimensioned to closely define the path of the projecting distal end 62 of slide lock member 60. A close-fitting outer cup 49 is provided with a corresponding number of slots 78 for receiving tabs 76, which as best shown in FIG. 32, are then folded over to secure the two cups together. As also shown in FIG. 32, the rim 79 of outer cup 49 is positioned to support the distal end 62 of body 61 in sliding relation, and in combination with sidewall opening 47, define and limit the movement of slide lock member 60 between the closed or locked position (I) and open position (II).

As will be understood from the above description and the figures that form a part of this disclosure, the configuration and design, if any, of the housing 42 can be varied without departing from the spirit and scope of the invention. As will be apparent to one of ordinary skill in the art, the circular or cylindrical configuration of the housing illustrated in the accompanying drawings reflects a shape that is easily and inexpensively manufactured and that can efficiently accommodate the torroidal magnet of the preferred embodiment. However, a housing can be provided in an oval, rectilinear or other desired external configuration based upon (i) considerations of design harmony with the product or other environment in which the locking magnetic fastener is to be used; (ii) a desire to affix or reproduce a trademark or other decorative element on the housing; or (iii) the use of magnetic materials in other than a torroidal shape, e.g., one or more bar magnets.

As will also be apparent to one of ordinary skill in the art, the slide lock member can be oriented with respect to the housing in any of a variety of ways. For example, the projecting portion of the distal end can appear to be aligned with a diameter of a circular or cylindrical housing, or it can cut across the circle as a chord, and can move or rotate about a pivot point. Likewise, with a housing that appears in plan as a square, rectilinear, trapezoidal or other such shape, the slide lock member can project at a right angle to bisect the shape or be displaced from a midline; or it can project at an angle that appears to be acute or oblique angle to a principal axis; or extend diagonally from a comer of the housing and move in a linear or rotational path with respect to the magnet. Additionally, the exterior surface of the housing can be provided with rounded or beveled corners; be corrugated or otherwise textured for strength or decorative effect; and be engraved, tooled and otherwise superficially modified in accordance with the desires i)f fashion designers and current trends.

As will also be apparent from the description provided herein and the illustrations of the drawings, the size and configuration of the external aperture 44 in the housing and the slide lock 68 can be varied. For example, the aperture 44 can be larger, smaller or approximately the same size as that of the slide lock aperture.

Figure 34:
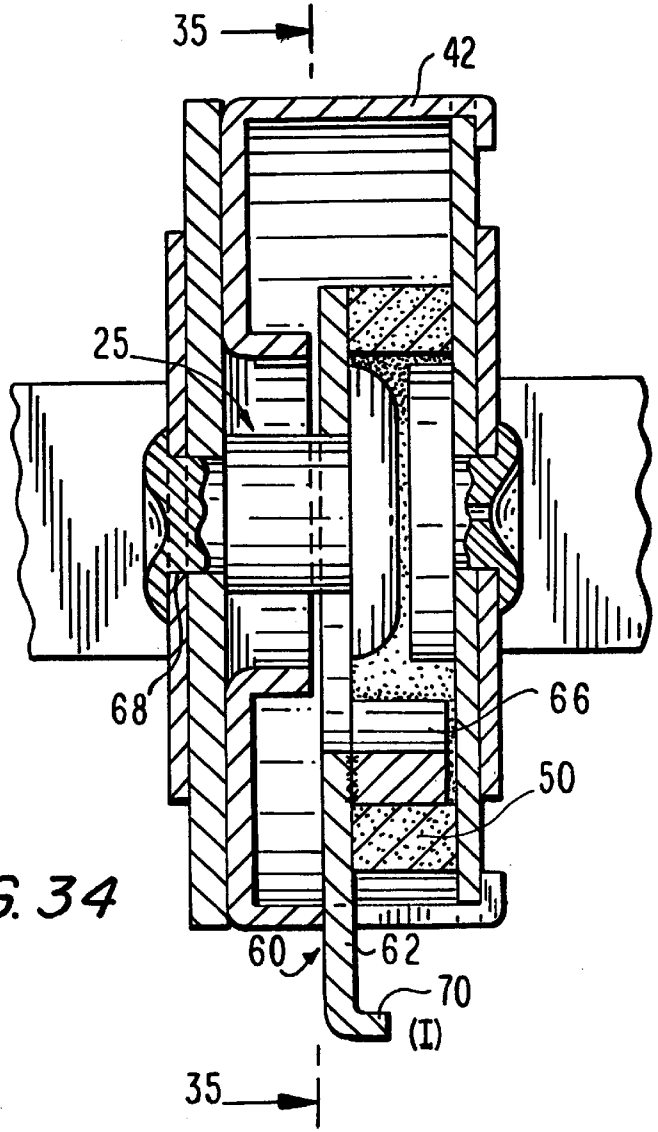
FIG. 34 is a cross-sectional view of the embodiment of FIG. 33 with the male member locked in position.
Figure 33:
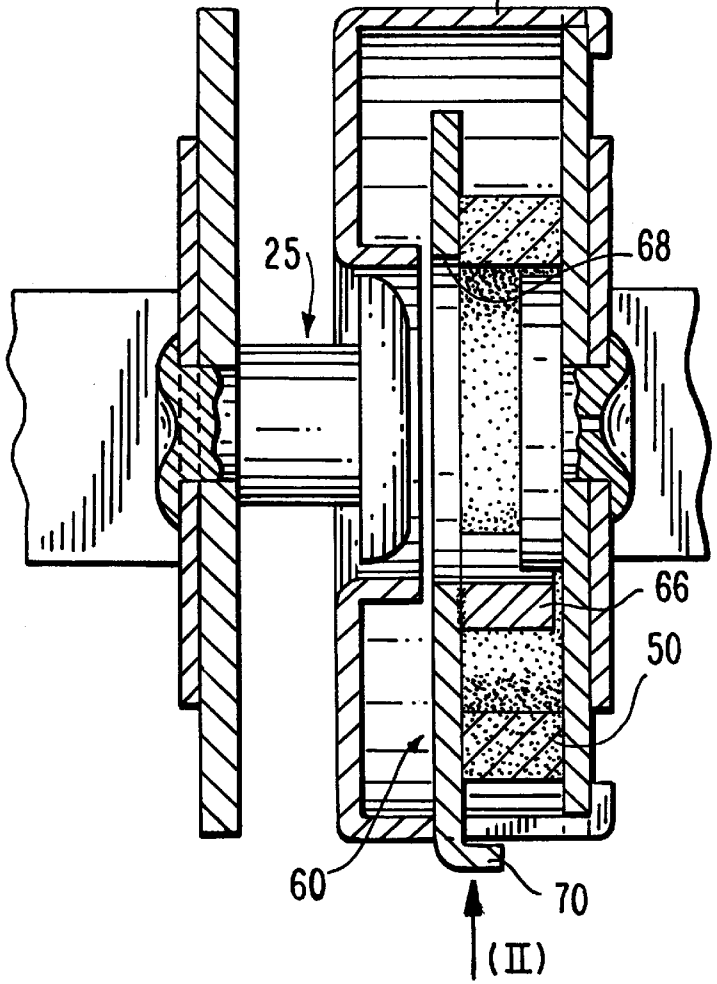
FIG. 33 is a cross-sectional view of another embodiment of the invention with the slide lock member in the open position with the male member partially removed.

With reference to FIGS. 33 and 34, there is illustrated a further preferred embodiment to of the invention in which the ferromagnetic contact 66 depends from the slide lock member 60 at a position that is on the interior of the torroidal magnet 50. When in the closed or locked position (I) shown in FIG. 34, ferromagnetic contact 66 is attracted to the interior surface of magnet 50. When the release 70 is advanced to the unlocked position (II), the projecting male member 25 is released and can be separated from the female assembly; upon the removal of manual pressure on lock release 70, the attractive force between contact 66 and the adjacent surface of magnet 50 is sufficient to cause the slide lock member 60 to return to the closed position (I).

Figure 36:
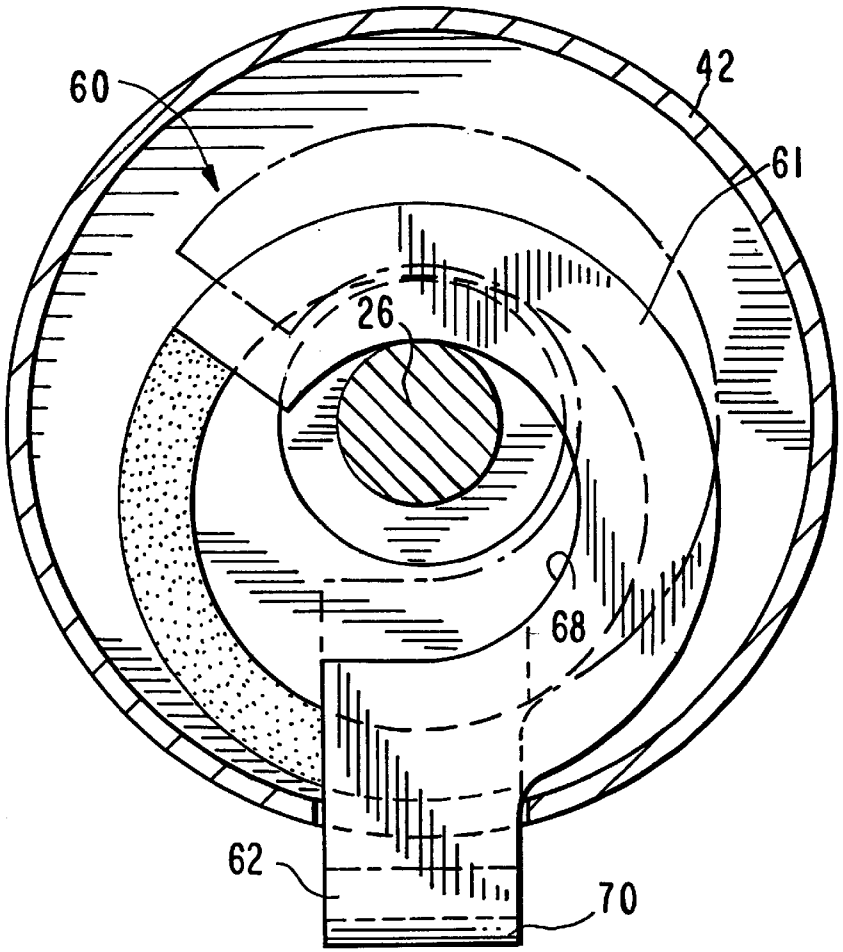
FIG. 36 is a top plan view similar to that of FIG. 35 schematically illustrating one embodiment of an asymmetrical slide lock member.
Figure 35:
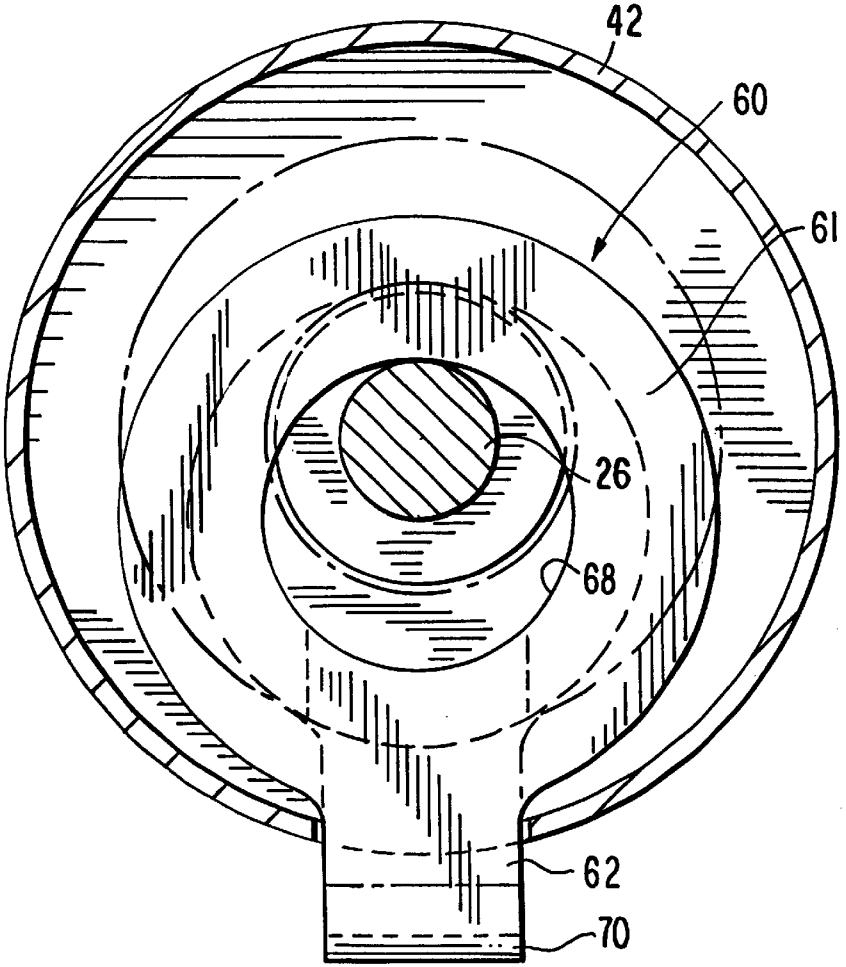
FIG. 35 is a top plan view of the embodiment of FIG. 34 taken along section line 35—35.

As will be understood from the above description and the embodiments illustrated in the figures described, the configuration of the body 61 of the slide lock member 60 can assume any of a variety of configurations, which variations may be determined by convenience of manufacture, a desire to reduce the materials consumed, the configuration of the exterior housing (which may include aesthetic considerations), and the like. In the embodiments previously described, the lock means 32 of the projecting male member is engaged and secured by only a portion of the slide look member body 61 that is overlapped by the projecting shoulder of the forward end 28. Thus, portions of the slide lock member body which are not aligned with exterior aperture 44 in housing 42 can be eliminated. However, in making such modifications, it must be kept in mind that the rigidity, integrity, tensile strength and sliding mobility of the mechanism must not be impaired. In this regard, reference is made to FIG. 35 in which the body 61 of slide lock member 60 is generally circular with a rectilinear distal end 62. In the embodiment illustrated, it will be understood that the diameter of the shank 26 will have an effect on the area of the overlapping engagement or contact between the two elements. As illustrated, there is an overlap of almost 50% around the periphery of the slide lock aperture 68. In the alternative embodiment illustrated in FIG. 36, about 30% of the material forming the circular body 61 has been removed, thereby providing a material savings in the construction of the invention. Since the housing 42 conceals all but a small section of the body 61 when the male and female members are separated, the difference in configuration of the body 61 will not be apparent to the user. It is also to be understood that other variations in configuration can be adopted. For example, the curvilinear configuration of slide lock member 60 shown in FIG. 36 can readily to adapted to a rectilinear for m without adversely affecting the method of operation and effective functioning of the locking magnetic fastener of the invention.

Figure 37:
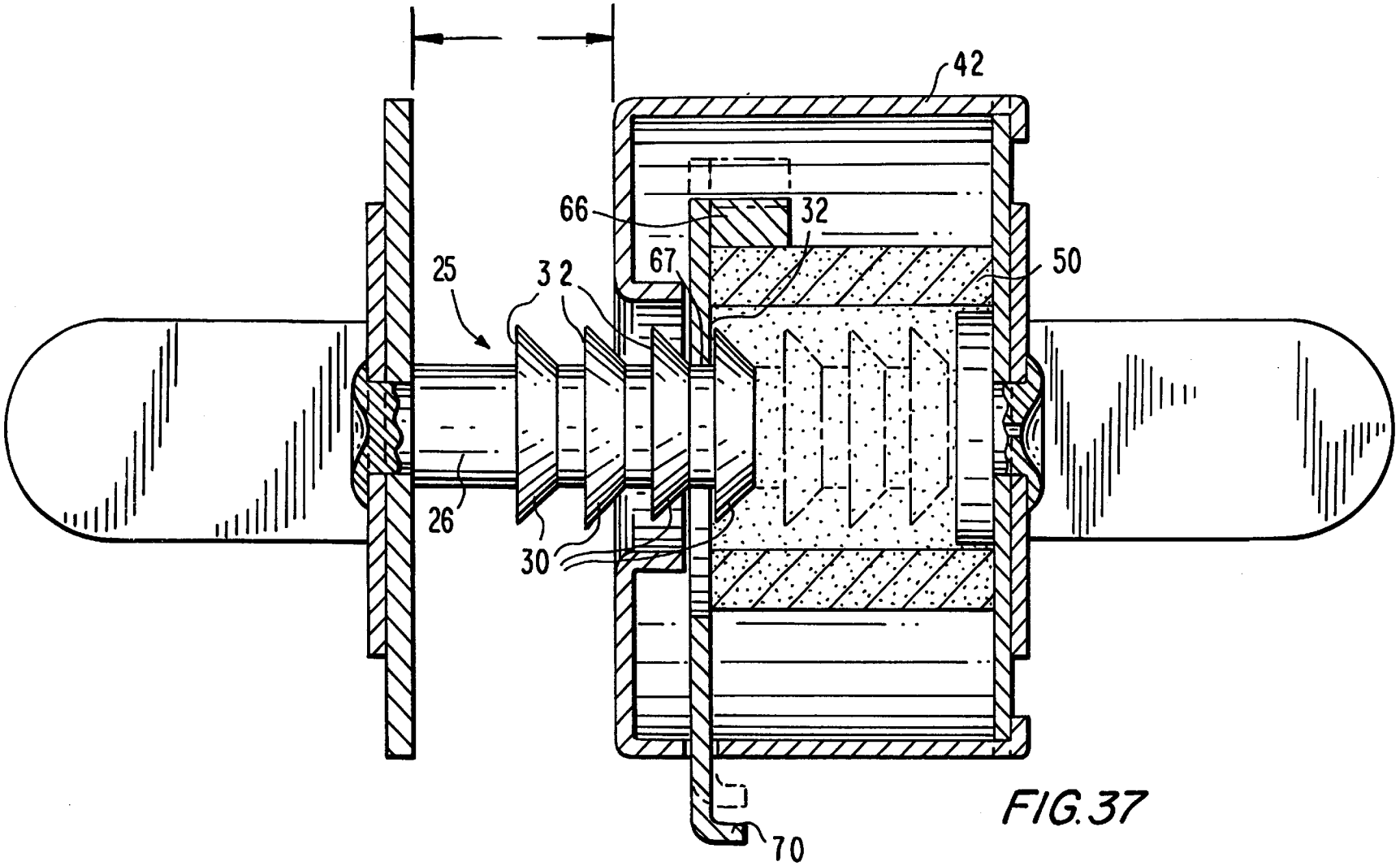
FIG. 37 is a cross-sectional view of a locking magnetic fastener schematically illustrating another embodiment of the invention in which the projecting male member is provided with multiple cam surfaces and intermediate lock means.

In a further preferred embodiment of the invention, a plurality of locking positions are provided to permit the male assembly to be securely engaged within the female assembly, while at the same time providing a device that will allow an object, such a handbag or carrying case to be filled to a greater capacity. One such aspect of this preferred alternative embodiment of the invention is schematically illustrated in FIG. 37, where the shank 26 of projecting male member 25 is provided with a plurality of cam surfaces 30 and intermediate lock means 32. When attached to a ladies handbag having an overlapping closure flap, the stand-off distance provided by the partial insertion of the male member as illustrated in FIG. 37 will provide for additional carrying capacity in the body or pocket of the handbag. By applying additional force to the exterior of the flap on which the male assembly is mounted, the cam follower surface 67 will ride up over the consecutive cam surfaces 32 until, as shown in phantom, the projecting male member is fully inserted in the final position.

In the embodiments of the locking magnetic fastener described above, the slide lock member was formed as a single or unitary element that moved in a generally linear path or, when pivotally mounted, in an arcuate path; in either case, the slide lock member being returned to its closed or locked position (I) under the force of attraction between the magnetic material and a ferromagnetic contact which was attached to or formed as a part of the slide lock member. In the further preferred embodiments of the invention that are described below, the slide lock member is comprised of two elements which cooperate in movement and function to engage and lock the male assembly in a secured position with respect to the female assembly. As will be described in more detail with reference to specific embodiments as illustrated by the figures, each of the elements of the slide lock member are provided with a ferromagnetic contact which, in the closed or locked position (I), are in contact with or proximate to the magnet or magnets contained in the interior chamber of the female assembly. When these elements are moved away from the closed or locked position (I), either by the cam action of the projecting male member or by manual force applied to release the lock, the effective magnet attraction force is sufficient to return the elements to position (I). In the preferred embodiments which follow, the slide lock member is comprised of two elements arranged in opposing relation and pivotally mounted, either at their respective proximal or distal ends. Manual force to displace the elements from position (I) is provided, for example, by simultaneously pressing the projecting release for each between a thumb and forefinger, the elements returning to their previous position by magnetic attraction when the manual force is removed. In this regard, it should be noted that the slide lock member elements are retained in a first, fixed position (I) and returned from a second, displaced position (II) in response to the attraction of a permanent magnet fixed in position in the interior chamber of the female assembly.

Figure 39:
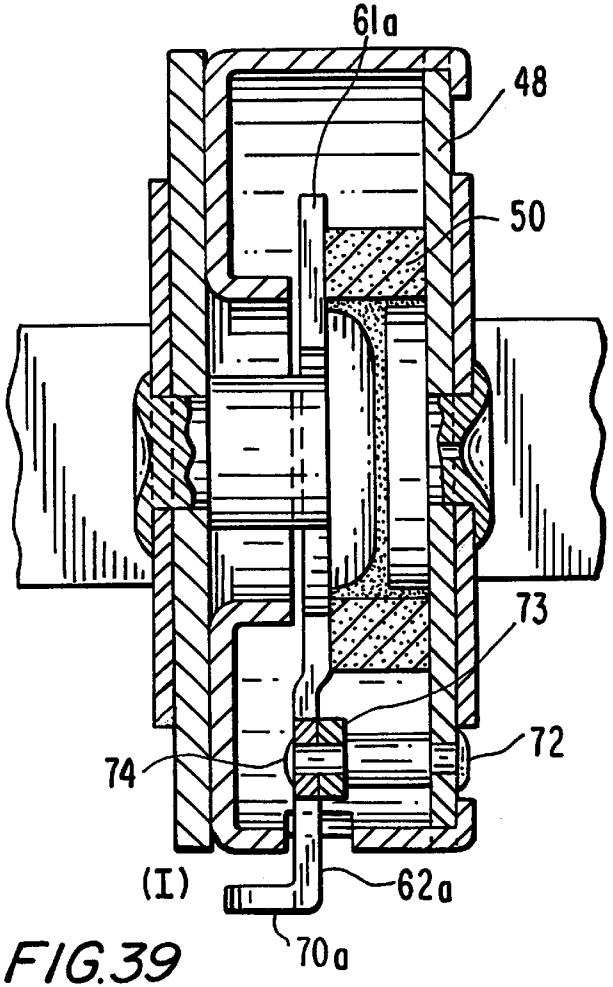
FIG. 39 is a cross-sectional view of the embodiment of FIG. 38 taken along section line 39—39.
Figure 38:
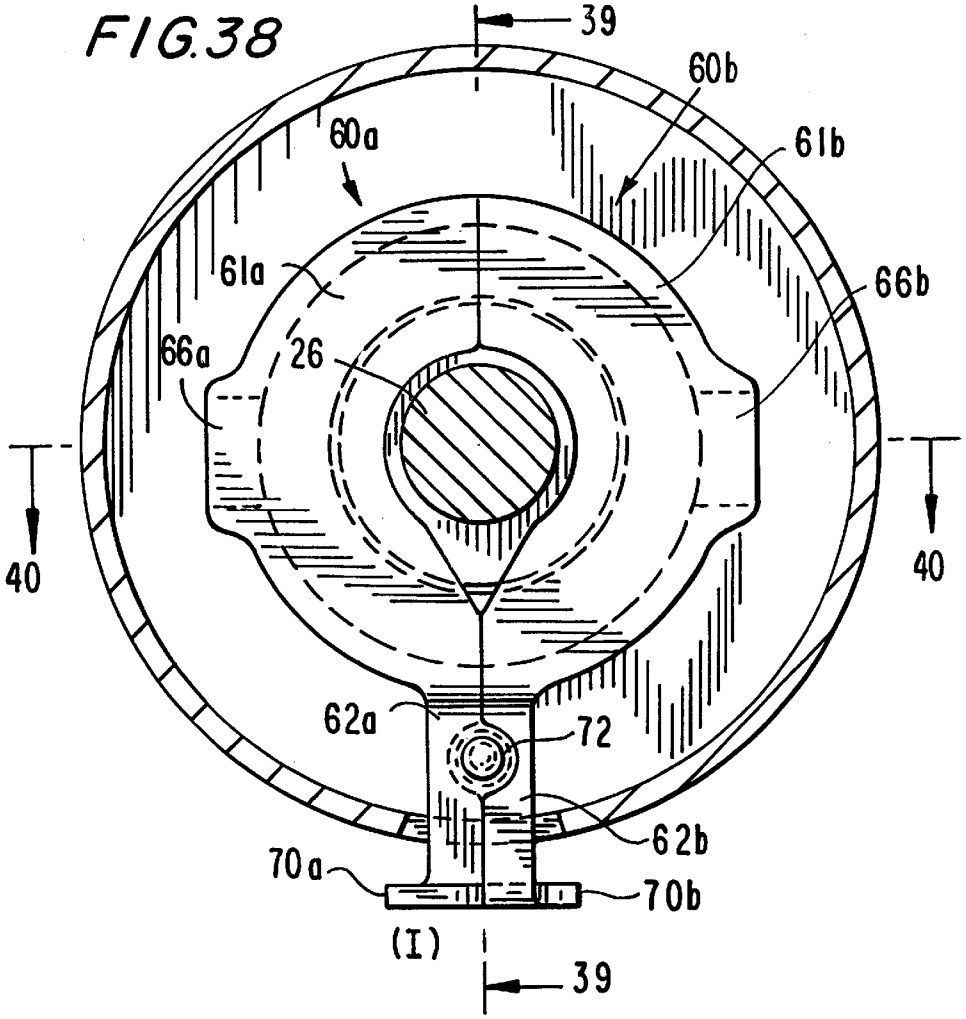
FIG. 38 is a top plan view, partly in section, schematically illustrating another embodiment of the invention in which a pair of slide lock members are pivotally mounted for movement adjacent their distal ends.
Figure 41:
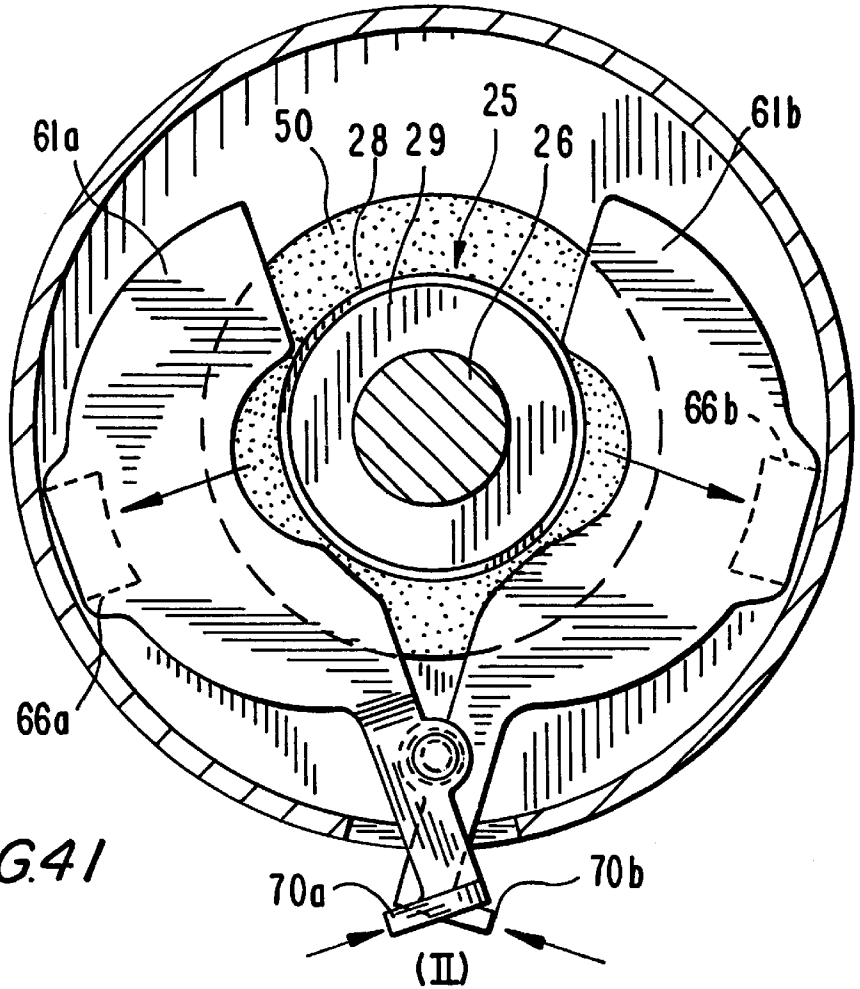
FIG. 41 is a top plan sectional view of the embodiment of FIG. 38 with the slide lock members in the open position.
Figure 40:
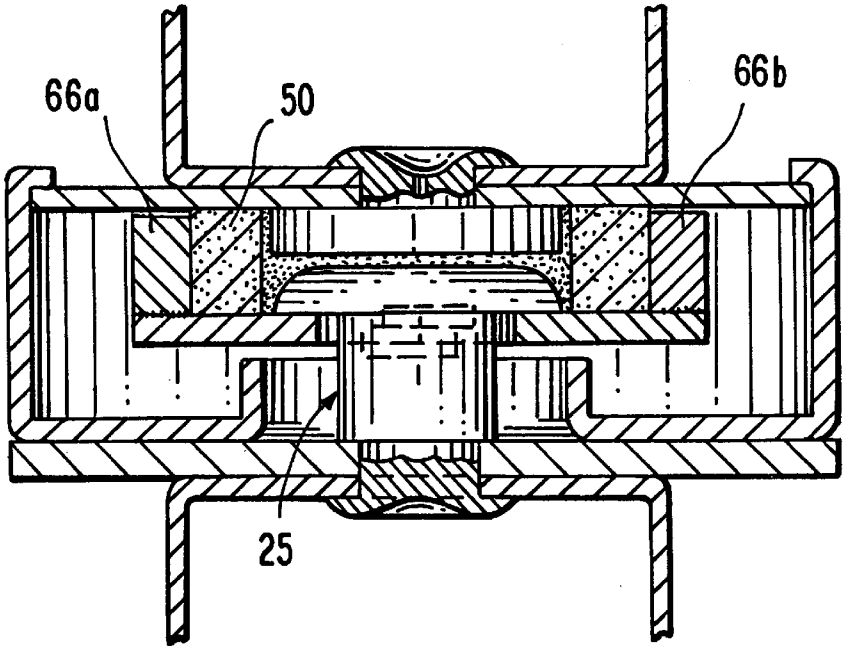
FIG. 40 is a cross-section view of the embodiment of FIG. 38 taken along section line 40—40.
Figure 43:
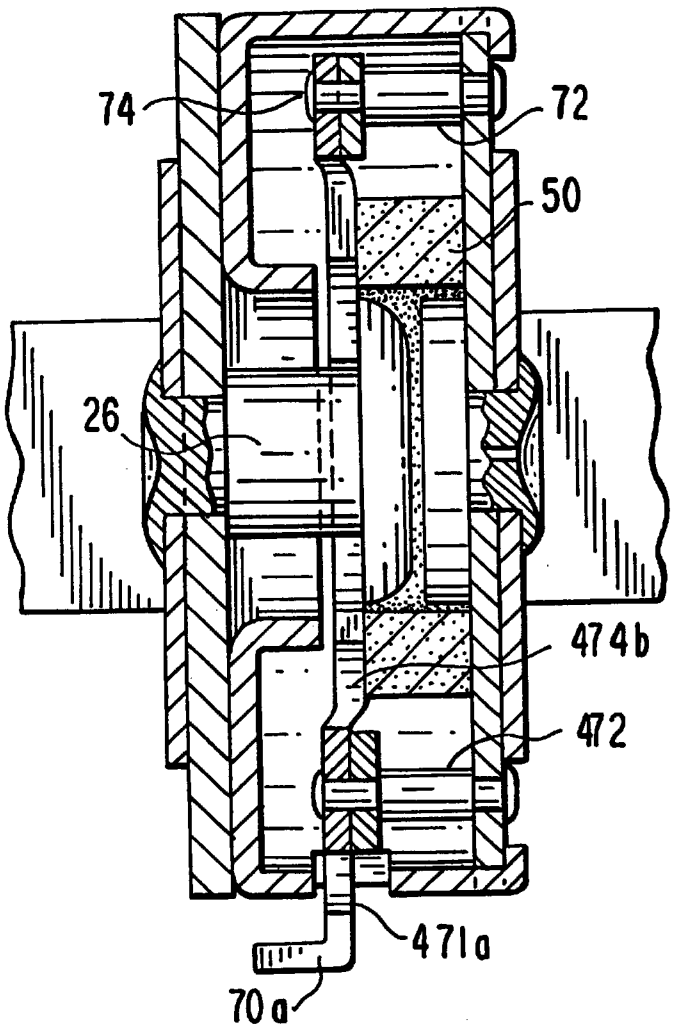
FIG. 43 is a cross-sectional view of the embodiment of FIG. 42 taken along section line 43—43.

One such example of this further preferred embodiment is illustrated in FIG. 38 in which a pair of slide lock members 60*a* and 60*b* are pivotally mounted at their respective distal ends on pivot pin 72 that is secured to base 48 by any appropriate means, including welding, a threaded fastener, riveting, or the like, such methods being well known to those of ordinary skill in the art. As shown in FIG. 39, pivot pin 72 is secured to base 48, as by deforming the head of the projecting end. The accurately moving elements 62*a* and 62*b* are supported in position by pivot pin shoulder 73 and deformable head 74. The assembly can be further stabilized by inclusion of mounting washers (not shown) positioned above and below the moving elements 60*a* and 60*b*, which washers can have a low friction surface to facilitate their easy movement. This embodiment is further illustrated in the cross-sectional view of FIG. 40 which shows the ferromagnetic contacts 66*a* and 66*b* adjacent opposing sides of torroidal magnet 50 in position (I). As will be understood from the explanation and descriptions which have been previously provided, when the releases 70*a* and 70*b* are pressed together as schematically illustrated in FIG. 41, the opposing elements of the body 61*a* and 61*b* are moved outwardly to allow the projecting male member 25 to be removed while the slide lock member is in position (II). Upon removal of the compressive force from the release elements 70*a* and 70*b*, the force of magnetic attraction between magnet 50 and ferromagnetic contacts 66*a* and 66*b* returns the opposing elements to the closed position (I).

Figure 42:
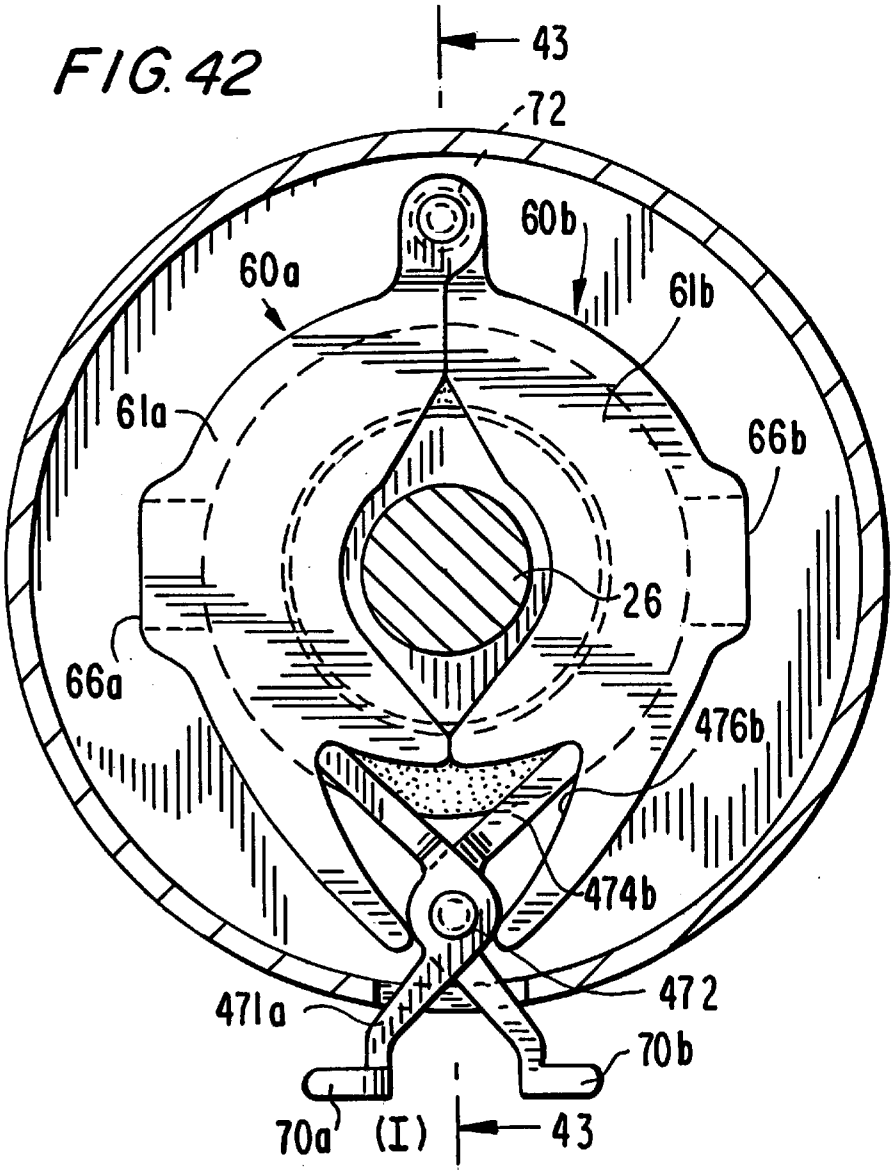
FIG. 42 is a top plan view, partly in section illustrating another embodiment of the invention in which a pair of slide lock members are pivotally mounted at their proximal ends.
Figure 45:
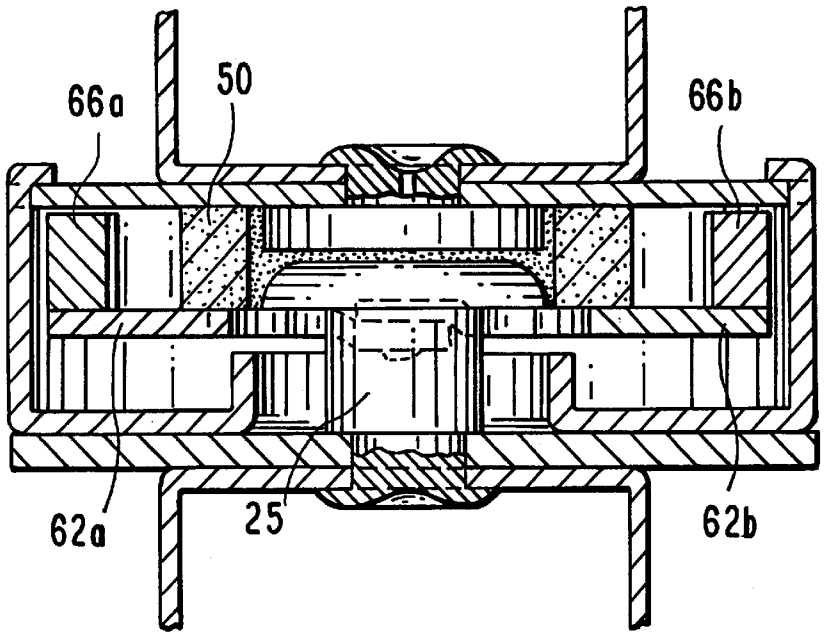
FIG. 45 is a cross-sectional view of the embodiment of FIG. 44 taken along section lines 45—45.
Figure 44:
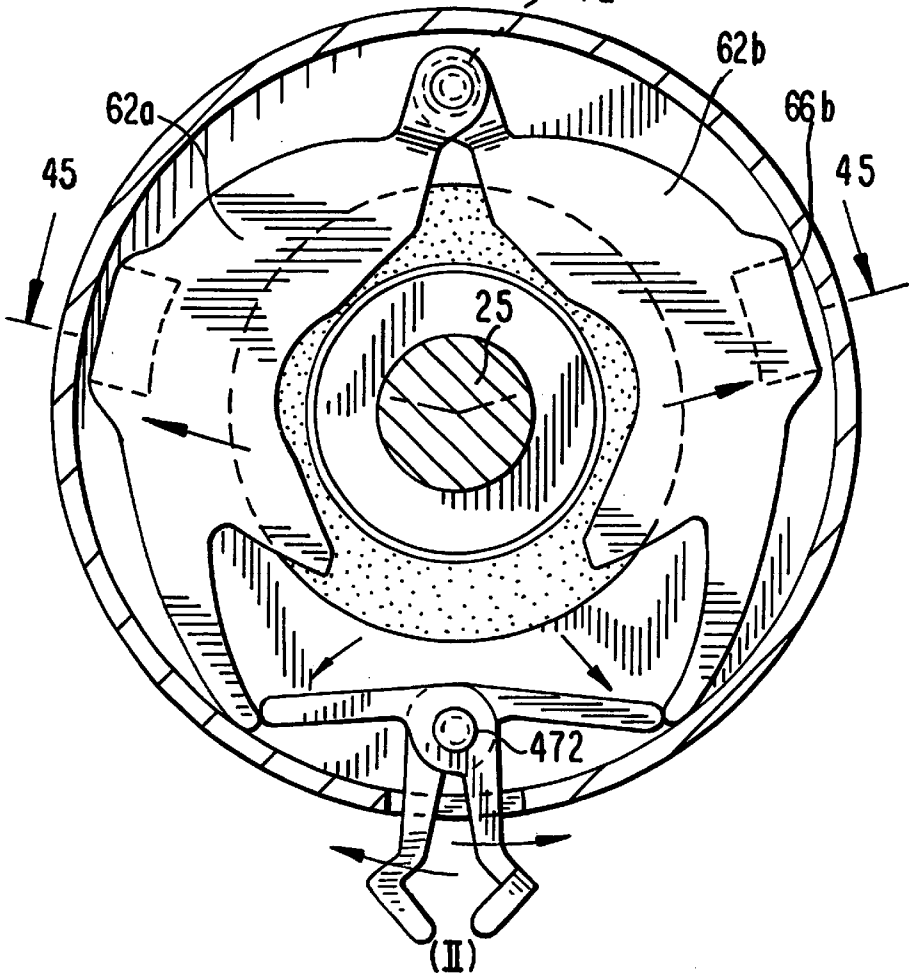
FIG. 44 is a top plan view of the embodiment of FIG. 43 with the slide lock members in the open position.

A further embodiment of this aspect of the invention is illustrated in FIGS. 42–45, in which opposing slide lock members 62*a* and 62*b* are pivoted at their proximal ends about pivot pin 72. In this embodiment, as best shown in FIGS. 42 and 44, the release mechanism is formed from independent release cam arms 474*a* and 474*b* which are mounted on release pivot pin 472 for pivotal movement in response to opposing forces applied to releases 70*a* and 70*b*. As best shown in FIG. 44, when the force is applied to move the releases towards each other, the opposing ends of the release arms 471*a* and 471*b* rotate against the surface of is the release cam followers 476*a* and 476*b* to move the opposing body members 61*a* and 61*b* into open position (II) as shown in FIG. 44. As best seen in cross-sectional view FIG. 45, the corresponding ferromagnetic contacts 66*a* and 66*b* are moved away from magnet 50, but still within the range of the magnetic attraction force, so that upon removal of the force from releases 70, the contacts are moved with their corresponding slide lock members 60*a* and 60*b* to the closed position (I). As will be apparent to one of ordinary skill in this art, the particular mechanism for pivoting and opening the opposing slide lock members can be varied without departing from the general teachings of the invention. If desired, more than two opposing slide lock members can be incorporated into the locking magnetic fastener of the invention. For example, two pairs of opposing slide lock members oriented at right angles to each other can be arranged to provide an aperture that is engaged by the leading end of the projecting male member to move all four of the elements by the same effective cam action described in connection with the earlier embodiments, e.g., of FIGS. 1–30.

Figure 38A:
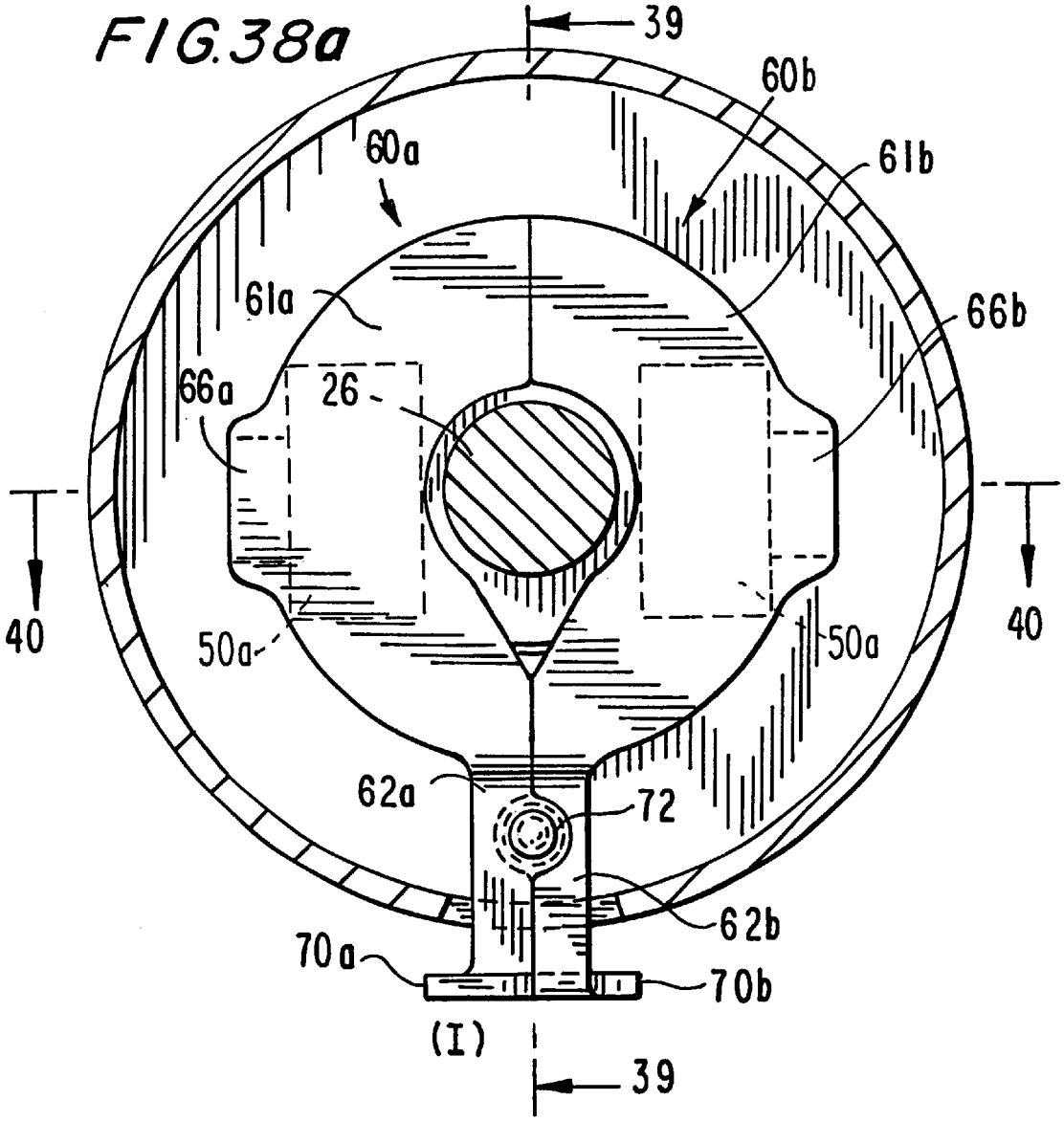
FIG. 38*a* is a cross-sectional view of a modification of the invention shown in FIG. 38.

It will be understood from the illustrative examples depicted in FIGS. 36 and 38–45 that the aperture 68 in the slide lock body 61 need not be symmetrical or even completely surround the male member in the engaged position. similarly, it will also be understood from the present description and examples that the size and configuration of the slide lock aperture need not conform to that of the external aperture 44 in housing 42, or to any particular configuration of tea permanent magnet, or magnets, 50. Thus, aperture 68 can be larger than the central opening if a torrodial magnet is employed, its size, configuration and position being determined by its operative relationship with the projecting made member 25. This applies equally to assemblies in which a flat plate permanent magnet is employed, or one or more bar magnets are positioned in the female assembly to attract and hold the male assembly in the engaged position by as shown in FIG. 38*a* which shows two bar magnets 50*a* in black box configuration.

Figure 46:
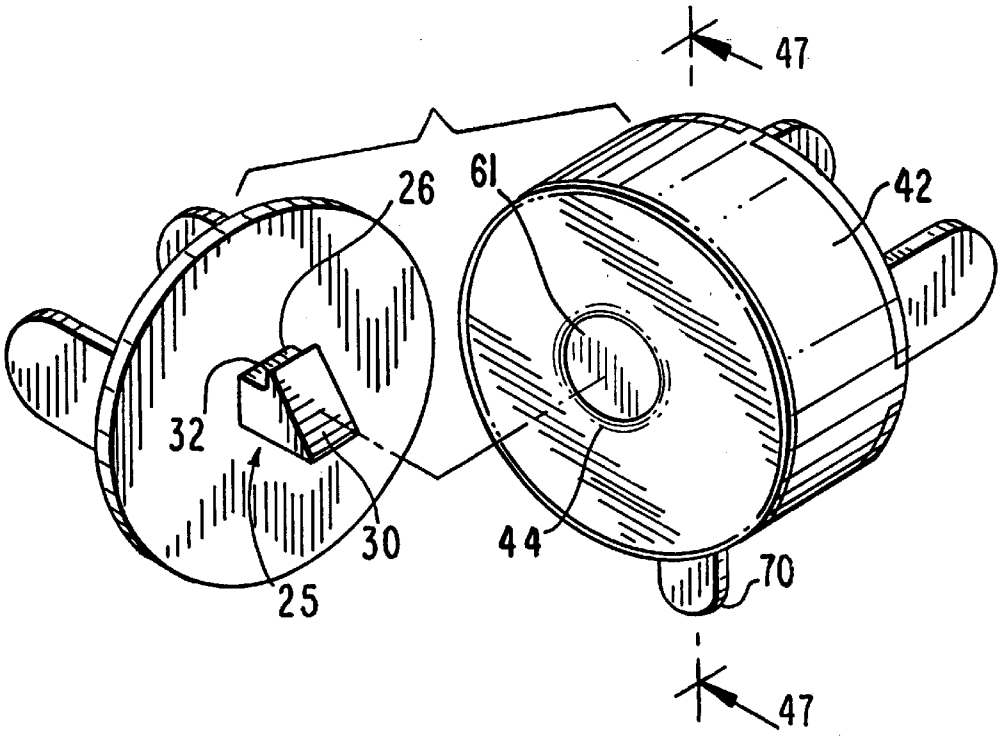
FIG. 46 is a top perspective view of another embodiment of the invention illustrating the mating relation of the male and female assemblies.

A further enhancement to the operation of the locking magnetic fastener of the invention is illustrated in FIG. 46, where there is shown a spacer in the form of an annular spacer member 490 surrounding the exterior aperture 44 of housing 42 and secured in position on the interior wall of the housing and above the surface of the body 61 of the slide lock member. This annular spacer 490 can be fabricated from a ferromagnetic or non-ferromagnetic material and can function to limit the movement of slide lock member 60 in the direction of the housing 42. If produced from a ferromagnetic material, spacer 490 will also serve to enhance the magnetic attraction and guide the projecting male member into alignment for insertion and retention in the female assembly. The spacer can be secured in position by adhesives, mechanical fasteners, or other means known to those familiar with the art.

Figure 47:
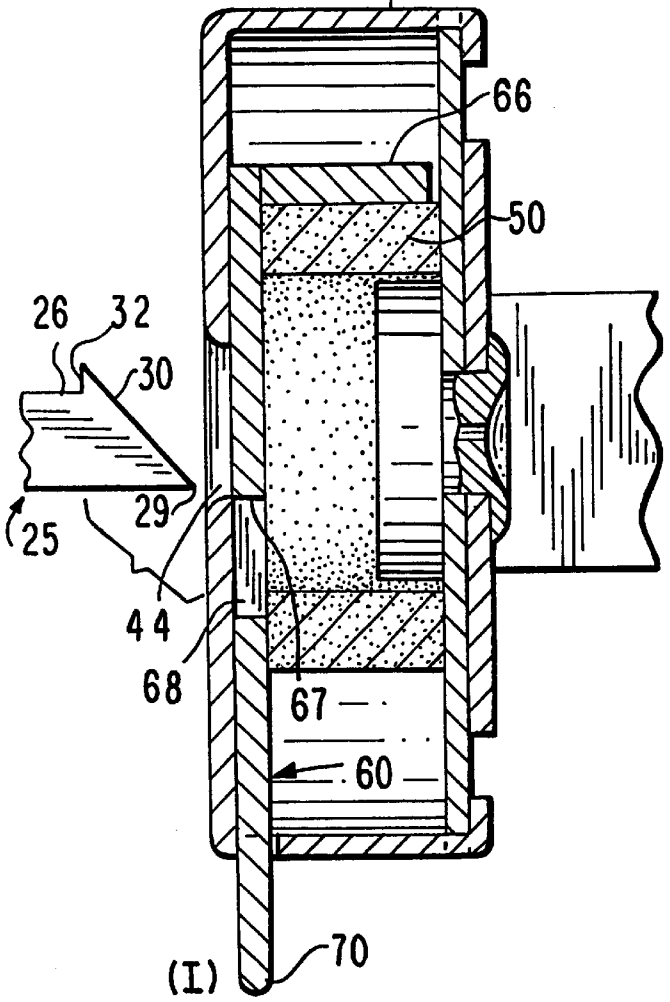
FIG. 47 is a cross-sectional view of the embodiment of FIG. 46 taken along section line 47—47.
Figure 48:
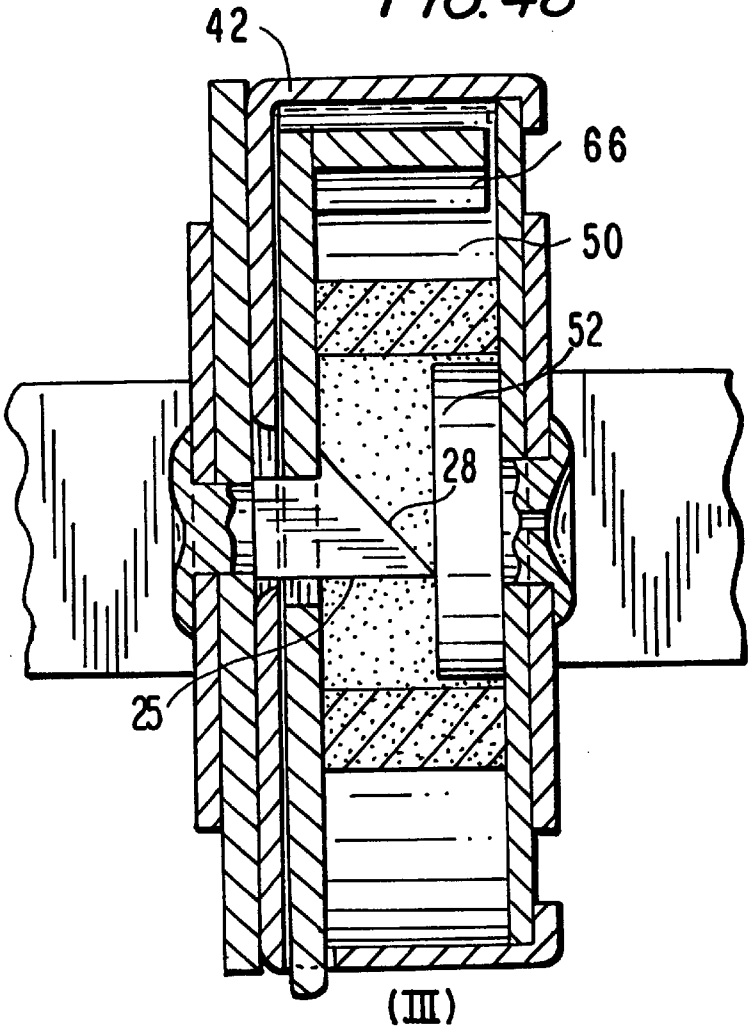
FIG. 48 is a cross-sectional view similar to that of FIG. 47 with the male member in a fully inserted and locked position.
Figure 49:
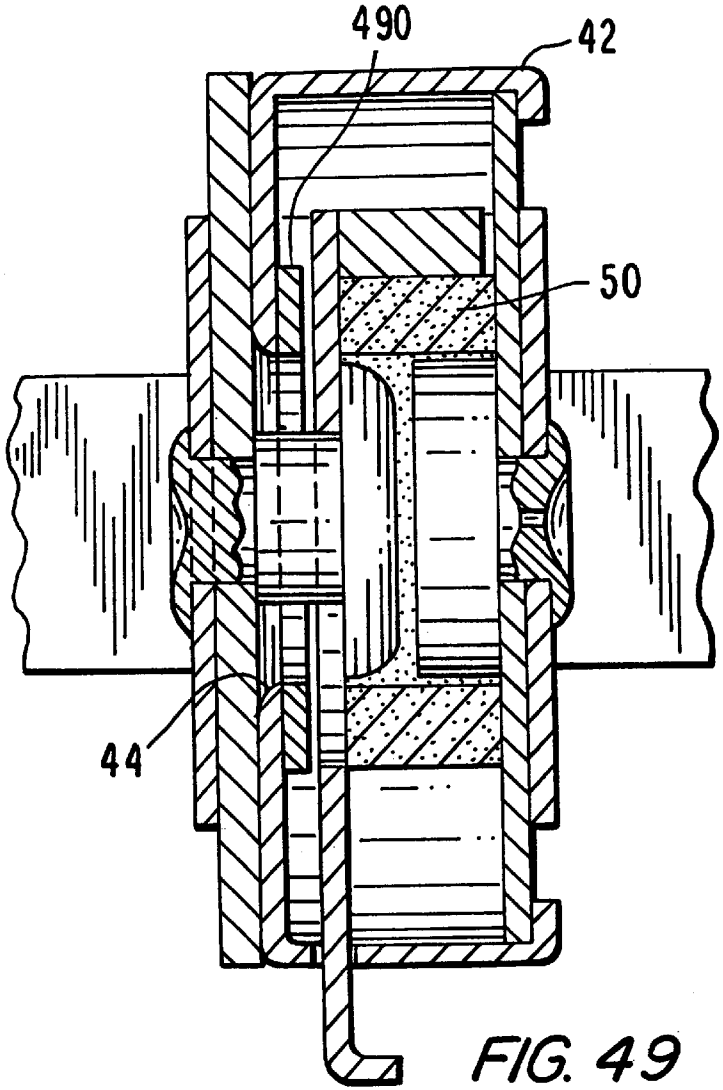
FIG. 49 is a cross-sectional view of another embodiment of the invention in which a flat annular member is positioned between the slide lock member and the adjacent housing.

In order to provide a locking magnetic fastener in which the female assembly is completely sealed against the incursion of dirt and debris when the male assembly has been removed, exterior aperture 44 in housing 42 is completely covered by a portion of the distal end 64 of slide body 61. In this regard, reference is made to FIGS. 46–49 in which the projecting male member is provided with a rectilinear leading end 28, which is adapted to pass through the exterior aperture 44 of housing 42. It will be understood from FIG. 46 that the specific configuration of the projecting male member and the receiving exterior aperture in the female assembly can be modified, e.g., by configuring the aperture to match or conform closely to the corresponding maximum cross-section of the leading end 28 of the projecting male member. Thus, the aperture 44 of FIG. 46 can be of a rectilinear configuration. As is shown in FIGS. 47–49, the rim around aperture 44 is rounded or beveled to facilitate the entry of the male member 25. Additionally, the housing 42 can be shaped to form a concave or beveled surface around aperture 42 to further guide the male member into entry position.

As shown in the cross-sectional view of FIG. 4E, the cam surface 30 of the male member cannot engage the cam follower surface 67 when the slide lock member is in the completely closed position. To initiate such contact, it is necessary to manually apply force to release 70 thereby moving slide lock aperture 68 partially into alignment with exterior aperture 44, while at the same time advancing tip portion 29 of the projecting male member towards aperture 68. Thereafter, the method of operation of this embodiment is the same as in the previously described embodiments. As shown in FIG. 49, the slide lock body engages the lock means of the projecting male member in an intermediate locked position (III). It will also be noted that the ferromagnetic contact 66 is partially displaced from magnet 50, but still within the effective range of the magnetic attractive force to maintain the slide lock member in engagement against the shank 26 of the projecting male member.

Figure 51:
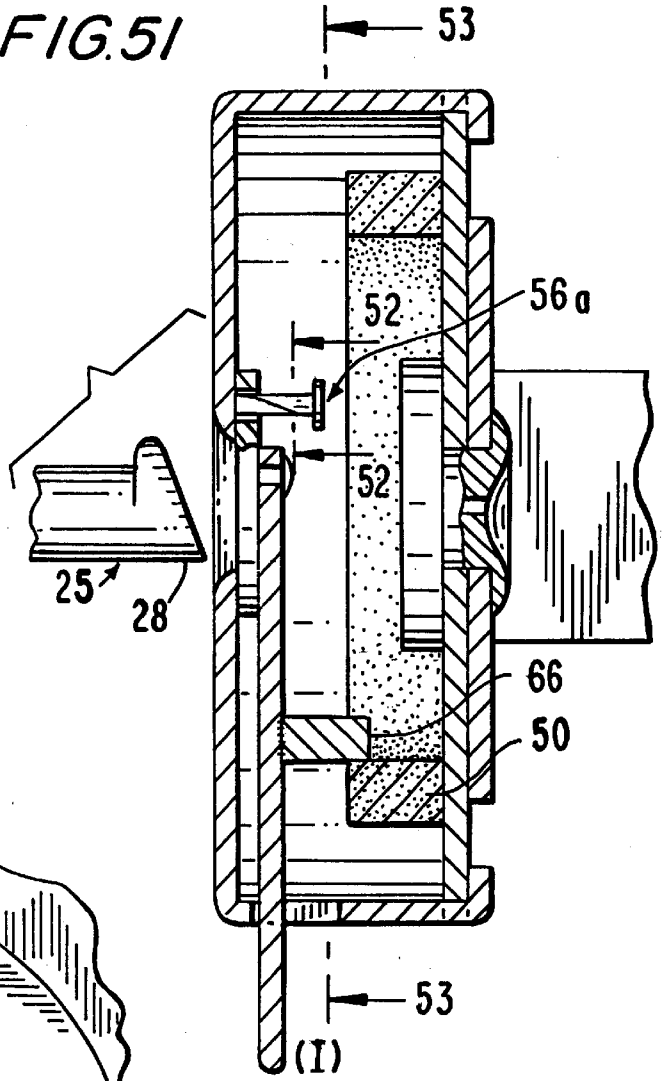
FIG. 51 is a cross-sectional view of the embodiment of FIG. 50 taken along section line 51—51.
Figure 50:
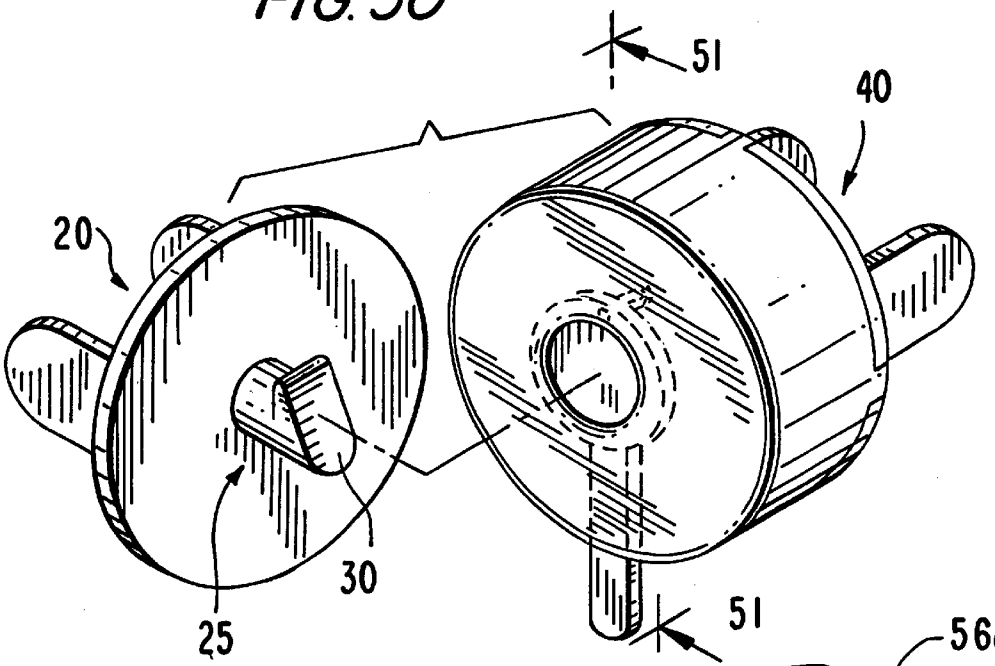
FIG. 50 is a top perspective view of another embodiment of the invention illustrating the mating relation of the male and female assemblies.
Figure 52:
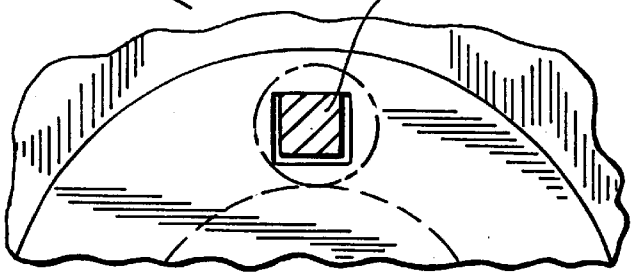
FIG. 52 is an enlarged cut-away view partially in section of a detail of a spiral pivot post of FIGS. 50 and 51.
Figures 53, 54, 55, 56:
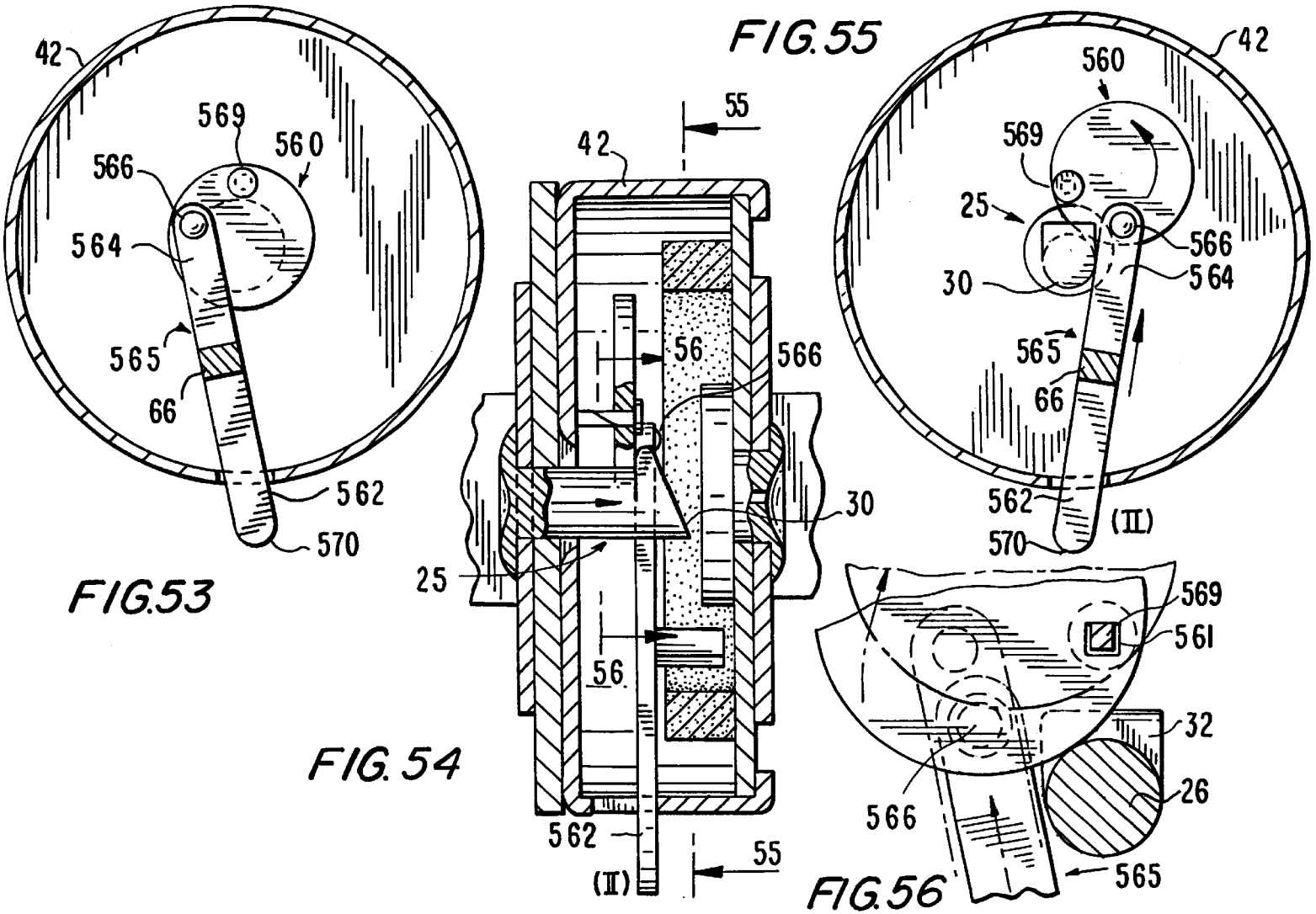
FIG. 53 is a cross-sectional view of the embodiment of FIG. 51 taken along section line 53—53.
FIG. 54 is a cross-sectional view similar to that of FIG. 53 with the male member in a fully inserted and locked position.
FIG. 55 is a cross-sectional view of the embodiment of the FIG. 54 taken along section line 55—55.
FIG. 56 is a cross-sectional view of the embodiment of FIG. 54 taken along section line 56—56.
Figure 58:
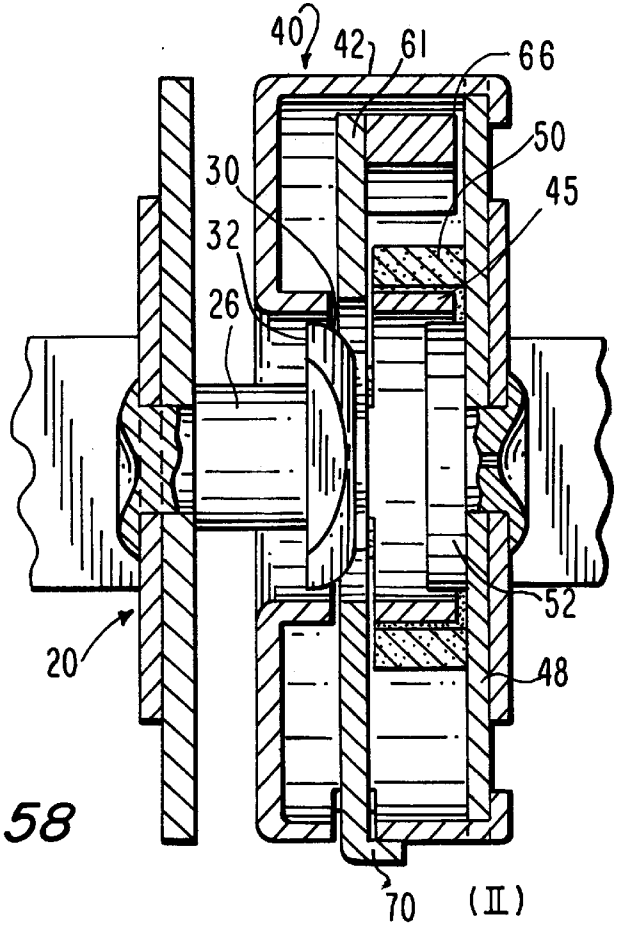
FIG. 58 is a cross-sectional view of the embodiment of FIG. 57 showing the male assembly partially withdrawn.

A further embodiment of the invention, in which the exterior aperture in the housing of the female assembly is completely closed when the male member is removed, is illustrated in FIGS. 50–56. Although this embodiment is similar in its exterior appearance to the male and female assemblies described above in connection with FIGS. 47–49, this embodiment has the advantage of requiring no manual intervention to initiate movement of the slide lock member in order to permit the leading end 28 of the projecting male member to enter the interior chamber. With reference to FIGS. 51–53, it will be seen that the slide lock member 560 is formed without an aperture corresponding to the exterior aperture of the housing 42 and is mounted for rotational movement on pivot pin 569, which is shown in the cross-sectional view of FIG. 52 as being of generally square cross-section, but with a spiral or twist running along its length. A corresponding guide aperture 561 is provided in slide lock member 560 which fits closely, but in sliding relation, i)n the shaft of pivot pin 569. With reference to FIG. 51, when the leading end 28 of the projecting male member 25 is brought into contact with the exposed exterior surface of slide lock member 560, the force applied at right angles is in part converted to a rotational movement as a result of the movement along the twisted shaft of pivot pin 569. In other words, the entry of the male member has the effect of deflecting the slide lock member out of its closed position (I); once the tip portion 29 of the male member has passed the edge of the slite lock member, the cam action commences, and the slide lock member continues to ride up the cam surface 30 until it reaches the lock means 32, at which time it falls in position to secure the male member. During this movement, the lever 565, which is pivotally mounted by means of fastener 566 adjacent the periphery of the slide lock member, is caused to move and the ferromagnetic contact 66 is drawn away from the interior surface of lorroidal magnet 50 but remains in the field of magnetic attraction. As shown in the detail of FIG. 56, the periphery of the slide lock member is released from engagement with the lock means 32 by a manual force applied to the release 570 which, with a portion of the distal end 562 of lever 565, projects from the housing 42, thereby allowing the male member to be withdrawn. When the manual force is released, the attraction between contact 66 and magnet 50 causes the lever to be returned to the closed position (I), which necessarily brings the slide lock member 560 back into position via a spiral movement to completely close the exterior aperture, and in a position that is in close proximity to, or touching, the interior surface of housing 42. In an alternative mode of operation, the slide lock member 560 can be partially displaced to permit engagement of the cam and cam follower surfaces in a manner similar to that described in connection with the method of operation of the embodiment of FIGS. 46–48. Thus, the structure of this embodiment can be operated with or without manual intervention to initiate the entry of the male member into the female assembly by displacement of a cover plate in the form of the slide lock member that secures the interior chamber against the entry of dirt and debris.

The slide lock fastener of the invention can also be utilized in female assemblies where the aperture collar 45 extends from the exterior surface of housing 42 into the central annulus formed by torroidal magnetic 50. As will be illustrated by the examples of the embodiments which follow, the aperture collar 45 is modified to provide a channel for the passage of the cam follower surface as it moves through the region defined by the exterior aperture 44 and the depending aperture collar.

Figure 57:
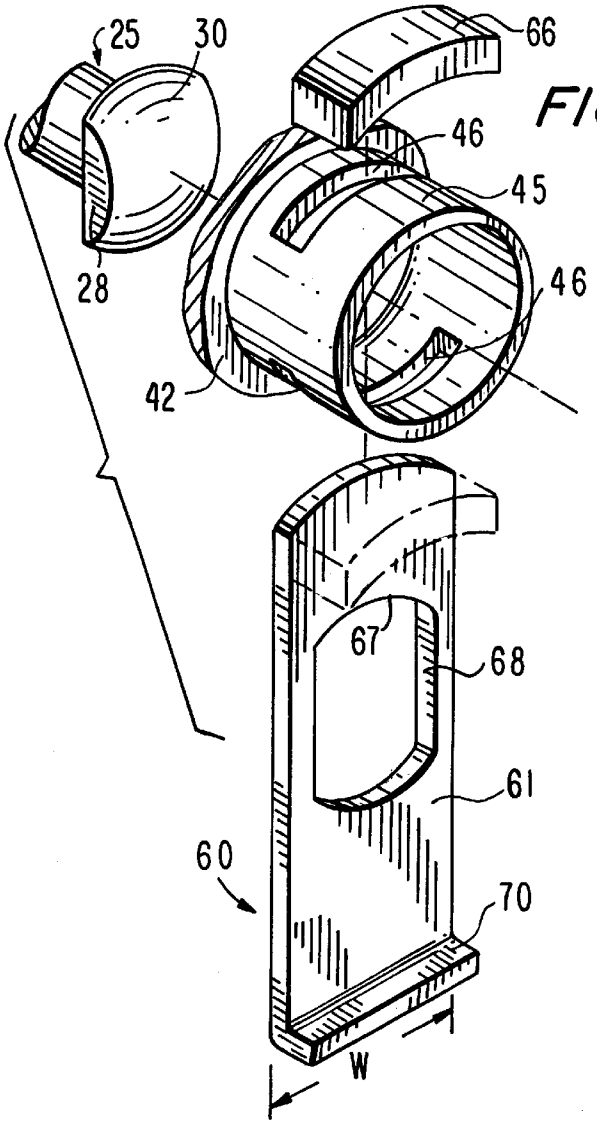
FIG. 57 is an exploded top perspective view of another embodiment of the invention illustrating elements from the male and female assemblies.
Figure 60:
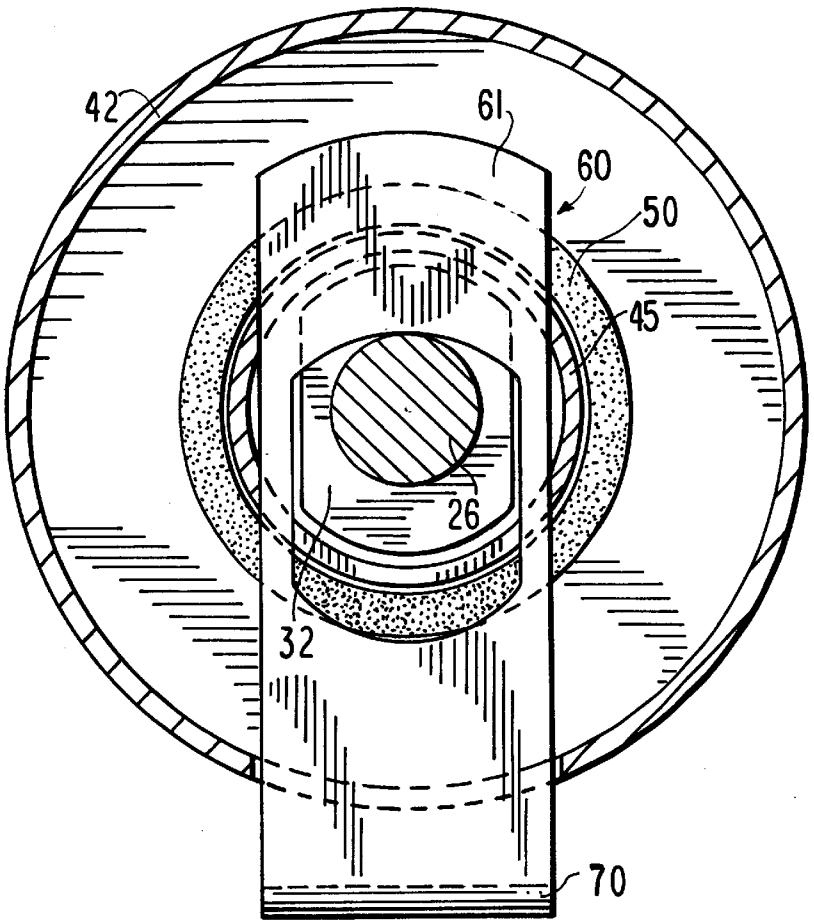
FIG. 60 is a cross-sectional view of FIG. 59 taken along section line 60—60.
Figure 59:
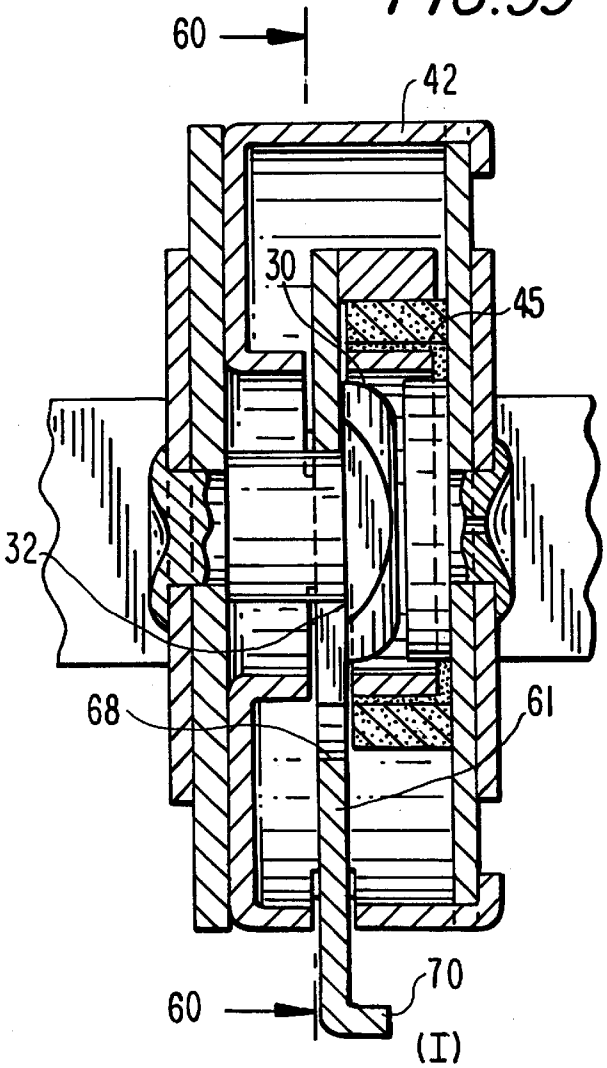
FIG. 59 is a view similar to FIG. 58 showing the assemblies in the locked position.

One such example is illustrated by FIGS. 57–60 where it will be seen that aperture collar 45 depends from housing 42 and extends in spaced-apart relation adjacent the interior angular surface of magnet 50. In a preferred embodiment, the open end of collar 45 is also spaced apart from base 48 and female mounting cap 52. With reference to FIG. 57, it will be seen that body 61 of slide lock member 60 has a width "W" that is less than the interior diameter of collar 45. In order to permit the passage of body 61, the collar 45 is provided with a pair of opposing channels 46 that are formed as chords at opposing positions in the cylindrical side wall of the collar. In a preferred embodiment, the dimensions of the channels 46, relative to the cross-sectional dimensions of slide body 61, are such that the slide member can move without binding and is restrained to minimize movement in other directions. Thus, in this embodiment, the opposing channels 46 also function as a guide for the slide lock member. In one method of construction and assembly, the ferromagnetic contact 66 is secured in position after the slide body has been passed through the channels in collar 45. As will also be understood from FIG. 57, the configuration of the leading end 28 of the projecting male member 25 has been modified to pass through the slide lock aperture 68 as cam surface 30 contacts and advances against cam follower surface 67 to move the slide body away from its starting position (I) and eventually into the engaged locked position (II) as shown in FIGS. 59 and 60. As will be understood from FIG. 58, the lock is disengaged by a manual pressure applied to release 70 while simultaneously withdrawing the male assembly 20 from the proximity of female assembly 40.

Figure 61:
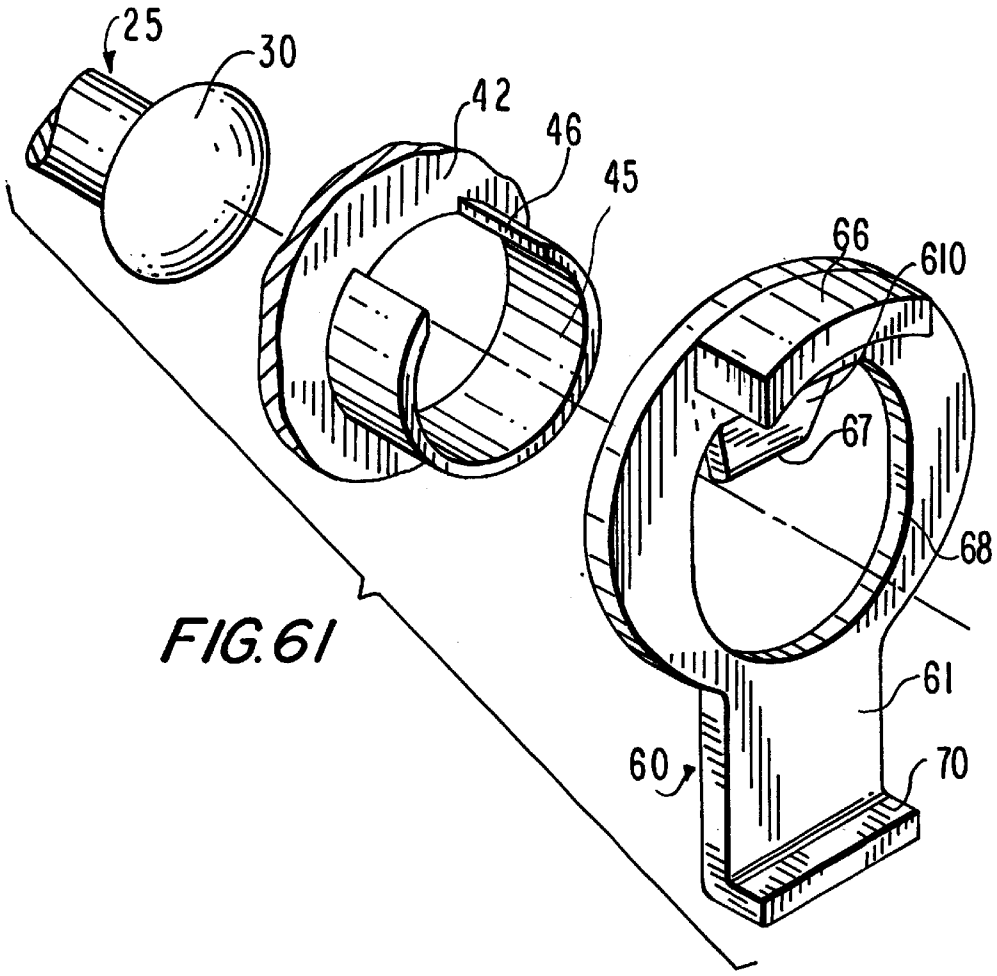
FIG. 61 is an exploded top perspective view of another embodiment of the invention showing the relationship of elements of the male and female assemblies.
Figure 64:
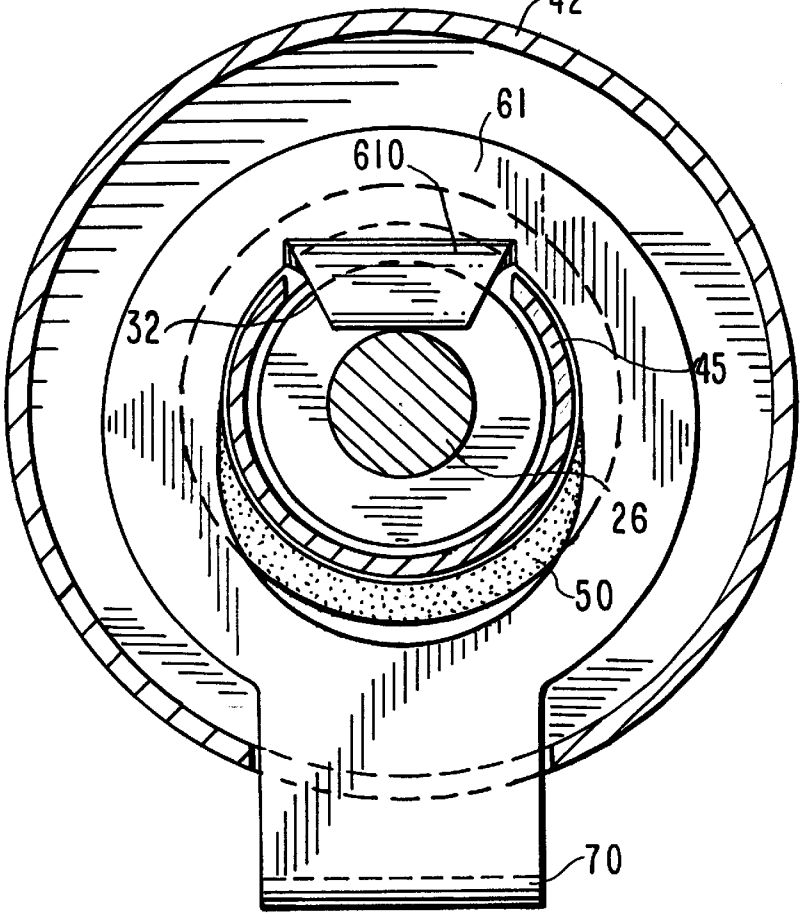
FIG. 64 is a cross-sectional view of the embodiment of FIG. 63 taken along section line 64—64.

One example of another alternative preferred embodiment of the invention for use with an aperture collar that extends into the annulus formed by torroidal magnet 50 is illustrated in FIGS. 61–64. In this embodiment, the body 61 is provided with a slide lock aperture 68 that is large enough to receive at least a portion of housing collar 45, i.e., the slide lock surrounds the collar. As best shown in FIG. 61, collar 45 is formed with a channel 46 by eliminating an arcuate segment of the collar to receive at least a projecting cam tab 610 that extends from the periphery of slide body aperture 68. The size of the channel 46, formed by the removal of a section of the sidewall of collar 45, is determined by the size and configuration of cam tab 610. In a preferred embodiment, the tab 610 extends across the width of aperture 44 in housing 42.

Figure 62:
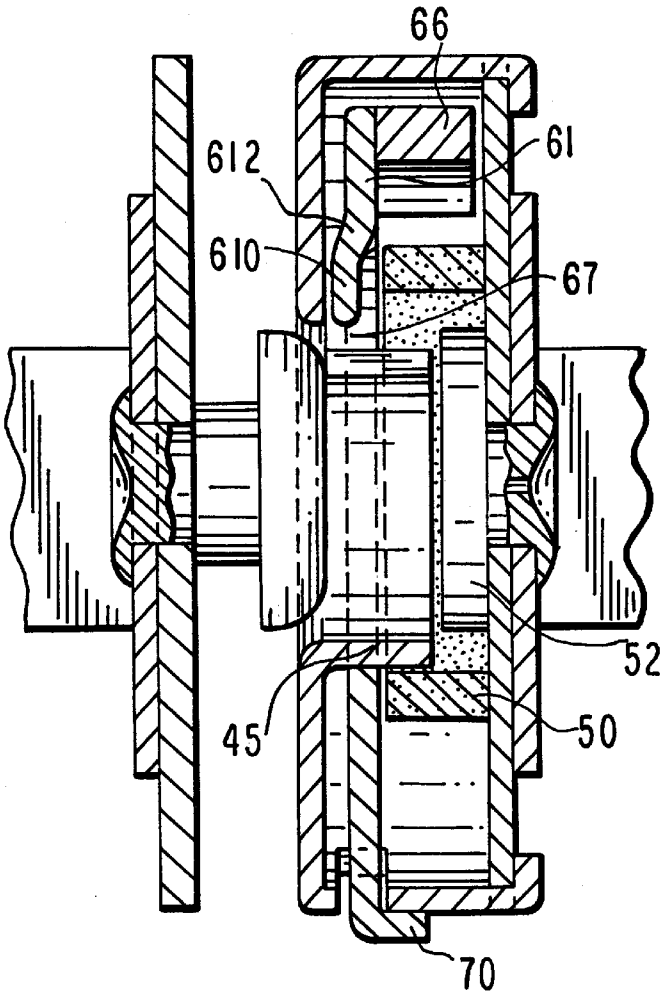
FIG. 62 is a cross-sectional view of the embodiment of FIG. 61 showing the male assembly withdrawn from the female assembly.
Figure 63:
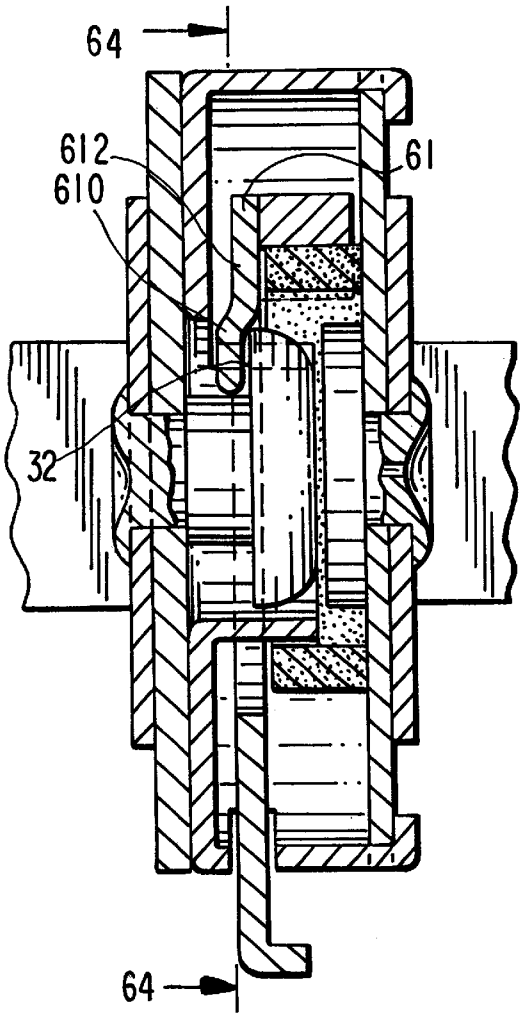
FIG. 63 is a cross-sectional view of the embodiment of FIG. 61 showing the assemblies in the locked position.

With reference to FIGS. 62 and 63 it will be seen that the cam tab 610 is provided with an offset section 612 that displaces the cam follower surface at the end of tab 610 from the plane of slide body 61. This offset has the effect of reducing the depth of penetration of male member 25 required for the engagement of lock means 32 with tab 610. This, in turn, allows the depth or thickness of the female assembly to be reduced. It will be understood that this configuration can be modified so that tab 610 is co-planar with slide body 61, or offset in the opposite direction to thereby increase the depth of penetration of the leading end of the male into the female assembly. Such changes are well within the skill of the art of workers in the field of magnetic fasteners and can be based upon the size, materials of construction and the configuration of the permanent magnets employed, as well as the materials of construction the elements comprising of both the male and female assemblies.

As will be understood from FIG. 62, the male and female assemblies are unlocked, as in other of the embodiments described above, by applying a manual pressure to release 70 to move cam tab 610 from engagement with lock means 32 and thereafter separating the male and female assemblies.

It will be appreciated from the above exemplary embodiments that other modifications to produce a locking magnetic fastener in accordance with the invention can be made to incorporate structural features and methods of operation that are described elsewhere in this specification, and that are known from the literature arid devices of the prior art.

Exemplary of such modifications include extending the length of the collar 45 of the embodiment of FIGS. 1–4 (either with or without the collar flange 47), in the direction of the magnet 50 so that the collar can be provided with channels 46 to receive the slide lock member. In this alternative embodiment (not shown), the collar does not extend into the magnet's annulus, and the slide lock member is held in slidable relation by the collar between the magnet and the housing 42.

The slide lock fastener of the invention can also be utilized in female assemblies where the aperture collar 45 extends from the exterior surface of housing 42 into the central annulus formed by torroidal magnetic 50. As will be illustrated by the examples of the embodiments which follow, the aperture collar 45 is modified to provide a channel for the passage of the cam follower surface as it moves through the region defined by the exterior aperture 44 and the depending aperture collar.

One such example is illustrated by FIGS. 57–60 where it will be seen that aperture collar 45 depends from housing 42 and extends in spaced-apart relation adjacent the interior angular surface of magnet 50. In an illustrative embodiment, the open end of collar 45 is also spaced apart from base 48 and female mounting cap 52. With reference to FIG. 57, it will be seen that body 61 of slide lock member 60 has a width "W" that is less than the interior diameter of collar 45. To permit the passage of body 61, the collar 45 is provided with a pair of opposing channels 46 that are formed as chords at opposing positions in the cylindrical side wall of the collar. In a preferred embodiment, the dimensions of the channels 46 relative to the cross-sectional dimensions of slide body 61 are such that the slide member can move without binding and is restrained to minimize movement in other directions. Thus, in this embodiment, the opposing channels 46 also function as a guide for the slide lock member. In one method of construction and assembly, the ferromagnetic contact 66 is secured in position after the slide body has been passed through the channels in collar 45. As will also be understood from FIG. 57, the configuration of the leading end 28 of the projecting male member 25 has been modified to pass through the slide lock aperture 68 as cam surface 30 contacts and advances against cam follower surface 67 to move the slide body away from its starting position (I) and eventually into the engaged locked position (II) as shown in FIGS. 59 and 60. As will be understood from FIG. 58, the lock is disengaged by a manual pressure applied to release 70 while simultaneously withdrawing the male assembly 20 from the proximity of female assembly 40.

One example of another embodiment of the invention, for use with an aperture collar that extends into the annulus formed by torroidal magnet 50, is illustrated in FIGS. 61–64. In this embodiment, the body 61 is provided with a slide lock aperture 68 that is large enough to receive at least a portion of housing collar 45, i.e., the slide lock surrounds the collar. As best shown in FIG. 61, collar 45 is formed with a channel 46 by eliminating an arcuate segment of the collar to receive a projecting cam tab 610 that extends from the periphery of slide body aperture 68. With reference to FIGS. 62 and 63 it will be seen that in a preferred embodiment, the cam tab 610 is provided with a offset Section 612 that displaces the cam follower surface at the end of tab 610 from the plane of slide body 61. This offset has the effect of reducing the depth of penetration of male member 25 required for the engagement of lock means 32 with tab 610. This, in turn, allows the depth or thickness of the female assembly to be reduced. It will be understood that while preferred, this configuration can be modified so that tab 610 is co-planar with slide body 61, or offset in the opposite direction to thereby increase the depth of penetration of the leading end of the male into the female assembly. Such changes are well within the skill of the art of workers in the field of magnetic fasteners and can be based upon the size, materials of construction and the configuration of the permanent magnets employed, as well as the materials of construction the elements comprising of both the male and female assemblies.

As will be understood from FIG. 62, the male and female assemblies are unlocked, as in other of the embodiments described above, by applying a manual pressure to release 70 to move cam tab 610 from engagement with lock means 32 and thereafter separating the male and female assemblies.

It will be appreciated from the above exemplary embodiments that other modifications can be made to incorporate structural features and methods of operation that are described elsewhere in this specification and that are known from the literature and devices of the prior art to produce a locking magnetic fastener in accordance with the invention. For example, the male asssembly can be modified by constructing the projecting male member 25 entirely from non-ferromagnetic materials so that there is no magnetic attraction and holding force exerted by the magnet 50. Although deemed to be a less preferred embodiment, such a construction is comprehended within the scope of the invention.

Figure 65:
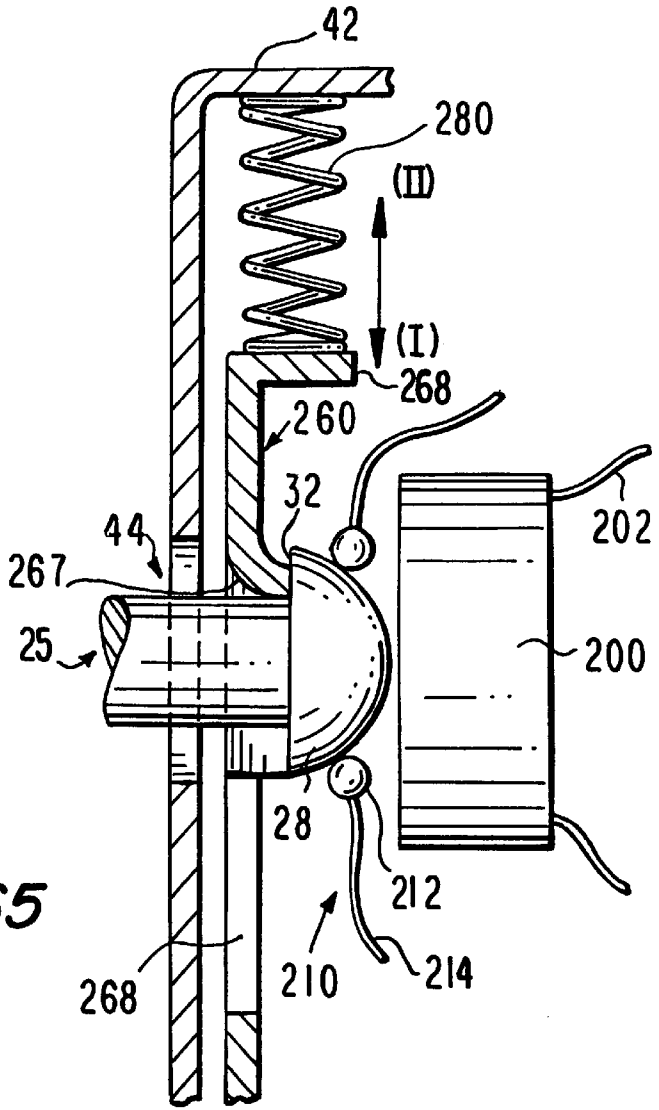
FIG. 65 is a side view, shown partly in section, of a further embodiment of the invention where the magnetic force is provided by an electromagnet.

As will be apparent from the following description of a further embodiment, the invention comprehends the use of electromagnetic devices to create the magnetic flux or field for practicing this invention. An exemplary construction embodying an electromagnetic device is shematically illustrated in FIG. 65 where common elements are identified by the numbers employed above. In the embodiment of FIG. 65, an annular electromagnetic device 200 is energized by a current transmitted through conductor leads 202 to thereby create a magnetic attraction similar to that employed in previous embodiments. A contact switch 210 comprising contact elements 212 and electrical leads 214 is positioned proximate the coil 200 and positioned to make contact with the forward end 28 of projecting male assembly 25 after engagement of the locking means. Slide lock member 260 is provide with a cam follower surface 267 that is formed with a projecting lip in this embodiment. At the distal end of slide lock member 260, a shoulder 268 is formed to receive and retain one end of biasing member 280, which in this embodiment is shown as a coil spring in compression. The opposite end of biasing member 280 is retained by the interior side wall of the housing 42.

In the method of operation of the locking magnetic fastener of this embodiment, electrical energy is supplied to the electromagnetic coil 200 when the male and female members are disengaged. As the projecting male member is passed through the exterior aperture in housing 42, it engages the cam follower surface 267, causing slide lock member 260 to move from its first position (I) to a second position (II) against the biasing force provided by spring 280. When the cam follower surface reaches lock means 32, the slide lock member 260 is able to return to its first position (I), thereby securing the male and female assemblies in mated, locked relation. However, the magnetic attractive force is sufficient to draw the projecting male assembly 25 closer to coil 200 after locking engagement has occurred and until forward end 28 males contact with switch elements 212, thereby turning off the flow of electrical current to electromagnetic coil 200. This mode of operation and assembly provides an energy-efficient device by deactivating the coil when the lock is securely engaged. The male and female assemblies are released by manually applying a force to the proximal end of slide lock member 260 to compress biasing spring 280 and align the lock member aperture 268 with the exterior aperture of housing 42, thereby allowing the male assembly to be disengaged and withdrawn from the female assembly.

As will be apparent to one of ordinary skill in the art, when the power to the electromagnetic coil or other device is turned off, there will be no magnetic force to attract the male member into a locked engaged position with the female member. This aspect of the invention can serve as a safety feature.

Alternatively, the switch contacts 212 can be positioned on the exterior of the housing 42 adjacent aperture 44 to cause power to activate the coil for a predetermined period of time when the forward end 28 of the male member is proximate the aperture. In either embodiment, the coil is deactivated after the slide lock member has engaged the lock means.

As will be apparent from the description of the embodiments of the invention utilizing one or more permanent magnets, the configuration of the slide lock member and its associated elements can be varied within the skill of the relevant art. Likewise, the specific electrical circuit of FIG. 65 provides but one of many practical configurations falling with the scope of the invention disclosed.

It should be apparent from the foregoing that the locking magnetic fastener of the present invention is readily adaptable to various types and forms of fasteners other than those illustrated in the present drawings. Various modifications and adaptations of the forms of the invention here shown and described can also be made to meet particular requirements. Accordingly, the foregoing examples and illustrations ire not to be interpreted as restrictive of the invention, the scope of which is to be determined by reference to the following claims.

I claim:

1. A locking magnetic fastener including manually separable male and female assemblies, a. said female assembly including a permanent magnet in an interior chamber formed by a housing;

b. said male assembly having a projecting male member including ferromagnetic material, the forward end of said male member including a cam surface;

c. said female assembly including an exterior aperture for receiving said projecting male member, said exterior aperture communicating with said interior chamber, d. said female assembly further comprising a slide lock member in juxtaposition to the permanent magnet and having a distal end projecting outward from the chamber and a proximal end within the chamber and being movable between a first position and a second position, said slide lock member including a ferromagnetic contact that is adapted to be proximate the permanent magnet in the first position and that is within the range of attraction of the permanent magnet in said second position;

e. said slide lock member including a cam follower surface responsive to the cam surface on the male assembly, said cam follower surface extending across at least a portion of the opening defined by and is partially aligned with the exterior aperture of said female assembly in the first position and movable toward the periphery of said exterior aperture in the second position to permit passage of the forward end of the male member; said cam follower surface aligned in the first position to engage the cam surface towards the forward end of said projecting male ferromagnetic member, said cam follower surface operatively configured to laterally move said ferromagnetic contact member on the distal end of the slide lock member away from the permanent magnet in opposition to magnetically induced attractive force as said cam follower surface advances along said cam surface during entry of said projecting male member into said interior chamber;

f. lock means adjacent the cam surface to receive the slide lock member in locking engagement with said projecting male member to thereby mechanically retain said projecting male member in said female assembly; and g. lock release means for manually releasing said lock means.

2. The magnetic fastener of claim 1, wherein said lock means is defined by an offset in said cam surface, whereby the cam follower surface of said slide lock member moves into locking engagement with the projecting male member.

3. The magnetic fastener of claim 1, wherein the cam follower surface forms a segment of the periphery of an aperture formed in the slide lock member.

4. The magnetic fastener of claim 3 wherein the aperture in the slide lock member and the exterior aperture are of approximately the same size.

5. The magnetic fastener of claim 4 wherein the aperture in the slide lock member as the exterior aperture are of approximately the same configuration.

6. The magnetic fastener of claim 3, wherein the cam follower surface is formed on a cam tab that extends from the periphery into the aperture of the slide lock member.

7. The magnetic fastener of claim 6, wherein the cam follower surface of the cam tab is co-planar with the body of the slide lock member.

8. The magnetic fastener of claim 6, wherein the cam follower surface of the cam tab is offset from the plane of the body of the slide lock member in the direction of the exterior aperture in the housing.

9. The magnetic fastener of claim 3 wherein the permanent magnet is torroidal and the opening formed by aperture in the slide lock member is larger than the central opening formed by the walls of the torroidal magnet.

10. The magnetic fastener of claim 1, wherein said permanent magnet is torroidal and the ferromagnetic contact member on the slide has a corresponding concave surface and contacts the exterior curved surface of the permanent magnet.

11. The magnetic fastener of claim 10 where the ferromagnetic contact member depends from a portion proximate the distal end of the slide lock member.

12. The magnetic fastener of claim 10, wherein the female assembly includes a collar depending from the exterior aperture into the annulus formed by the torroidal magnet and slide lock member passes through at least one channel in the collar.

13. The magnetic fastener of claim 12 wherein the slide lock member passes through opposing channels formed in the sidewall of the collar.

14. The magnetic fastener of claim 13 wherein the slide lock member is supported by the channels.

15. The magnetic fastener of claim 10, wherein the female assembly includes a collar depending from the exterior aperture into the annulus formed by the torroidal magnet and the cam follower surface extends from the exterior to the interior of the collar through a channel formed in a sidewall of the collar.

16. The magnetic fastener of claim 15, wherein the slide lock aperture adjacent the cam follower surface extends around at least a portion of the exterior surface of the collar.

17. The magnetic fastener of claim 15, where the slide lock aperture adjacent the cam follower surface surrounds the collar.

18. The magnetic fastener of claim 1, wherein the permanent magnet is torroidal and the ferromagnetic contact is positioned proximate an interior surface of the magnet sidewall.

19. The magnetic fastener of claim 1 where the slide lock member moves linearly between the first and second positions.

20. The magnetic fastener of claim 1 where the slide lock member is pivotally mounted about a lock member pivot point.

21. The magnetic fastener of claim 20 where the slide lock member moves accurately between the first and second positions.

22. The magnetic fastener of claim 20 where the ferromagnetic contact member depends from the slide lock member between the distal and proximal ends of the slide lock member.

23. The magnetic fastener of claim 20 where tie lock member pivot point is proximate the distal end of the slide lock member.

24. The magnetic fastener of claim 20 where the pivot point is between the ferromagnetic contact member and the proximal end of the slide lock member.

25. The magnetic fastener of claim 20 wherein the slide lock member comprises a pair of elongate locking members each of which is provided with at least one depending ferromagnetic contact member.

26. The magnetic fastener of claim 25 where the lock release means is operatively joined to the locking members and the lock means is released by pushing on the lock release means.

27. The magnetic fastener of claim 1, wherein said lock release means comprises the proximal end of the slide lock member.

28. The magnetic fastener of claim 1 in which the slide lock member is spaced from the surface of the permanent magnet.

29. The magnetic fastener of claim 28 which includes a slide plate, said slide plate being interposed between the slide lock member and the permanent magnet.

30. The magnetic fastener of claim 29 wherein the slide plate is operatively configured to limit the range of movement of the slide lock member in the interior chamber.

31. The magnetic fastener of claim 30, wherein the slide plate delimits the movement of the slide lock member to said second position.

32. The magnetic fastener of claim 29 wherein the slide plate is fabricated from polymeric material.

33. The magnetic fastener of claim 29 wherein the slide plate is fabricated from a non-ferrous metal.

34. The magnetic fastener of claim 29 wherein the slide plate includes an aperture that is aligned with the exterior aperture.

35. The magnetic fastener of claim 29 wherein the slide plate moves with the slide lock member.

36. The magnetic fastener of claim 28 wherein the slide lock member is supported in sliding contact by walls defining the interior chamber.

37. The magnetic fastener of claim 28 wherein the slide lock member is supported in sliding contact by walls of the permanent magnet.

38. The magnetic fastener of claim 1 where the permanent magnet is retained in the interior chamber by a non-ferrous support member.

39. The magnetic fastener of claim 38 where the slide lock member is maintained in spaced relation from the permanent magnet by the support member.

40. The magnetic fastener of claim 38 where the support member limits the movement of the slide lock member.

41. The magnetic fastener of claim 38 where the permanent magnet is retained in a recess formed in the support member.

42. The magnetic fastener of claim 41 where the slide lock member contacts an upper wall of the support member above the recess.

43. The magnetic fastener of claim 1 where the lock means is released by pushing on the lock release means.

44. The magnetic fastener of claim 1 where the lock means is released by pulling on the lock release means.

45. The magnetic fastener of claim 1 wherein the aperture in the slide lock member and the exterior aperture are of approximately the same configuration.

46. The magnetic fastener of claim 1 wherein the aperture in the slide lock member and the exterior aperture are of approximately the same size.

47. The magnetic fastener of claim 1, wherein the aperture in the slide lock member is larger than the exterior aperture in the housing.

48. A locking magnetic fastener including manually separable male and female assemblies, a. said female assembly comprising at least one permanent magnet in an interior chamber;

b. said male assembly including a projecting male member formed in whole or in part of a ferromagnetic material, the forward end of said male projecting member including a cam surface;

c. said female assembly including an exterior aperture for receiving said projecting male member, said exterior aperture communicating with said interior chamber;

d. said female assembly further comprising at least one slide lock member above the at least one permanent magnet, at least one ferromagnetic contact member joined to the at least one slide lock member, each of the at least one slide lock members having a distal end projecting from the chamber and a proximal end in the chamber, the distal end being movable from a first position (I) in which each of the at least one ferromagnetic contact members is in contact with or proximate to one of the at least one permanent magnets, to a second position (II) in which each of the ferromagnetic contact members is within the range of attraction of the at least one permanent magnet, said at least one slide lock member defining an aperture, alone or in combination with another of said slide lock members, said aperture being partially aligned with the exterior aperture in the first position and fully aligned with the exterior aperture in the second position;

e. said at least one slide lock member including a cam follower surface which initially engages said cam surface at the forward end of said projecting male member, said cain follower surface operatively configured to move said at least one ferromagnetic contact member away from the permanent magnet in opposition to the magnetically induced attractive force as said cam surface moves along said cam follower surface during entry of said projecting male member into said interior chamber;

f. lock means adjacent the cam surface to receive the at least one slide lock member in locking engagement with said projecting male member to thereby retain said projecting male member in the female assembly; and g. lock release means for manually releasing said slide lock member from said lock means.

49. The magnetic fastener of claim 48, wherein said lock means includes a dislocation adjacent said cam surface to permit said at least one slide lock member to return to said first position.

50. The magnetic fastener of claim 48, comprising a pair of spaced-apart bar magnets and two slide lock members which cooperate lo form an aperture for receiving the projecting male member in the second position and for attracting the projecting male member in the interior of the female assembly.

51. The magnetic fastener of claim 48 wherein the slide lock members are pivotally mounted.

52. The magnetic fastener of claim 48 where the lock release means are formed at the distal end of the at least one slide lock member.

53. The locking magnetic fastener of claim 48 wherein the male and female assemblies are permanently mounted on the opposing faces of a handbag wall and a closure flap of the handbag.

54. The locking magnetic fastener of claim 53 where the female assembly is mounted on the flap and the lock release means extends through the exterior surface of the flap.

55. The locking magnetic fastener of claim 54 where the mated fastener is unlocked by moving the proximal end of the lock release means away from the female assembly housing.

56. The locking magnetic fastener of claim 53 where the lock release means is between the opposing faces and proximate the edge of the flap, whereby the mated fastener is unlocked by manually moving the proximal end of the lock release means with a finger inserted between the handbag wall and overlying flap.

57. The locking magnetic fastener of claim 56 where the proximal end of the lock release means is moved toward the female assembly housing to release the lock.

58. The locking magnetic fastener of claim 57 where the lock release means comprises two projecting proximal ends, whereby the mated fastener is unlocked by moving both of the proximal ends towards the female assembly housing.

59. The locking magnetic fastener of claim 48 where the projecting male member is formed of ferromagnetic metal.

60. The locking magnetic fastener of claim 48 where the projecting male member is plated with a non-ferromagnetic material.

61. The locking magnetic fastener of claim 48 where the slide lock member is fabricated from a non-ferrous metal and is in sliding contact with the at least one permanent magnet.

62. The locking magnetic fastener of claim 48 where the slide lock member is formed from a ferrous material and is in spaced apart relation to the at least one permanent magnet.

63. A locking magnetic fastener comprising:

a. a male assembly having a projecting male member terminating in a forward end, the forward end of said male member including a cam surface, said male member including lock means;

b. a female assembly comprising (i) a housing having an exterior aperture for receiving the projecting male member;

(ii) a permanent magnet in an interior chamber formed by the housing, (iii) a slide lock member which is slidable with respect to the housing and the permanent magnet, the distal end of the slide lock member extending from the housing and the proximal end terminating in the housing, the slide lock member including a ferromagnetic contact member that is movable from a first position (I) to a second position (II), both positions being within the attractive range of the permanent magnet, the slide lock member further including a receiving aperture that in the first position (I) is partially aligned with the exterior aperture and in the second position (II) is fully aligned with the exterior aperture and to receive the projecting male member, the slide lock member further including a cam follower surface to engage said cam surface at the forward end of the projecting male member, said cam follower surface operatively configured, whereby said ferromagnetic contact member is caused to move away from the permanent magnet and against the magnet's attractive force as said cam surface moves along said cam follower surface during the progressive entry of said ferromagnetic projecting male member into said interior chamber and in the direction of the magnet when the lock means is engaged.

64. The locking magnetic fastener of claim 63 where the receiving aperture in the slide lock member includes the cam follower surface.

65. The locking magnetic fastener of claim 63 where the projecting male member comprises ferromagnetic material.

66. The locking magnetic fastener of claim 65 where the ferromagnetic contact member is located between the permanent magnet and a wall of the housing.

67. The locking magnetic fastener of claim 66 where the ferromagnetic contact member is located proximate the distal end of the slide lock member.

68. The locking magnetic fastener of claim 67 where the ferromagnetic contact member is located between the permanent magnet and the proximal end of the slide lock member.

69. The locking magnetic fastener of claim 65 where the ferromagnetic contact member depends from the slide lock member on the same side as, and proximate to the permanent magnet in the first position.

70. The locking magnetic fastener of claim 63 where the permanent magnet is torroidal.

71. The locking magnetic fastener of claim 63 where the forward end of the projecting male member is comprised of a non-ferromagnetic element and a ferromagnetic element.

72. The locking magnetic fastener of claim 71 where the non-ferromagnetic element is forward of the ferromagnetic element.

73. A female assembly for use in cooperation with a male assembly to provide a locking magnetic fastener, said female assembly comprising:

a. a housing that defines an interior chamber, an exterior aperture formed in a first wall of the housing for receiving a portion of the male assembly;

b. a permanent magnet positioned in the interior chamber opposite the first wall of the housing;

c. a slide lock member which is slidable with respect to the housing and the permanent magnet, the slide lock member comprising:

(i) a distal end extending through an aperture in a second wall of the housing and a proximal end terminating in the interior chamber;

(ii) a ferromagnetic contact member that is movable from a first position (I) to a second position (II), both positions being within the attractive range of the permanent magnet;

(iii) a receiving aperture that in the first position (I) is partially aligned with the exterior aperture and in the second position (II) is fully aligned with the exterior aperture and to receive a portion of the male assembly;

(iv) a cam follower surface to engage a cam surface formed in the male assembly, said cam follower surface operatively configured to move said ferromagnetic contact member on the slide lock member away from the permanent magnet in opposition to the magnetically induced attractive force as said cam surface moves along said cam follower surface during the progressive entry of said portion of the male assembly into said interior chamber and in the direction of the magnet when the lock means is engaged;

(v) a lock release formed at the distal end of the slide lock member, whereby the position of the interior aperture can be changed in response to a manual force applied to the lock release.

74. The female assembly of claim 73 where the cam follower surface is formed by the periphery of the receiving aperture.

75. The female assembly of claim 73 where the ferromagnetic contact member is mounted on the body of the slide lock member and the body is non-ferromagnetic material.

76. The female assembly of claim 75 where the ferromagnetic contact member is located between the permanent magnet and a wall of the housing.

77. The female assembly of claim 76 where the ferromagnetic contact member is located proximate the distal end of the slide lock member.

78. The female assembly of claim 77 where the ferromagnetic contact member is located between the permanent magnet and the proximal end of the slide lock member.

79. The female assembly of claim 78 where the ferromagnetic contact member depends from the slide lock member on the same side as, and proximate to the permanent magnet in the first position.

80. The female assembly of claim 73 where the permanent magnet is torroidal.

81. The slide lock member of claim 1 where the slide lock member includes surface projections on the surface proximate the housing.

82. The magnetic fastener of claim 1 in which the magnetically induced attractive force between the ferromagnetic material of the male member is sufficient to hold the male assembly and female assembly in mated position independently of the lock means.

83. A locking magnetic fastener including manually separable male and female assemblies, a. said female assembly including a permanent magnet in an interior chamber formed by a housing;

b. said male assembly having a projecting male member, the forward end of said male member including a cam surface;

c. said female assembly including an exterior aperture for receiving said projecting male member, said exterior aperture communicating with said interior chamber, d. said female assembly further comprising a slide lock member in juxtaposition to the permanent magnet and having a distal end projecting outward from the chamber and a proximal end within the chamber and being movable between a first position and a second position, said slide lock member including a ferromagnetic contact that is adapted to be proximate the permanent magnet in the first position and that is within the range of attraction of the permanent magnet in said second position;

e. said slide lock member including a cam follower surface responsive to the cam surface on the male assembly, said cam follower surface extending across at least a portion of the opening defined by and is partially aligned with the exterior aperture of said female assembly in the first position and movable toward the periphery of said exterior aperture in the second position to permit passage of the forward end of the male member; said cam follower surface aligned in the first position to engage the cam surface towards the forward end of said projecting male ferromagnetic member, said cam follower surface operatively configured to laterally move said ferromagnetic contact member on the distal end of the slide lock member away from the permanent magnet in opposition to magnetically induced attractive force as said cam follower surface advances along said cam surface during entry of said projecting male member into said interior chamber;

f. lock means adjacent the cam surface to receive the slide lock member in locking engagement with said projecting male member to thereby mechanically retain said projecting male member in said female assembly; and g. lock release means for manually releasing said lock means.

84. The magnetic fastener of claim 83 in which the male member is formed form non-ferromagnetic material.

85. The magnetic fastener of claim 83 in which the male assembly is formed from non-ferromagnetic material.

86. The magnetic fastener of claim 83 in which the projecting male member is formed as a hollow body.

* * * * *